US008974038B2

(12) United States Patent
Iwamuro et al.

(10) Patent No.: US 8,974,038 B2
(45) Date of Patent: Mar. 10, 2015

(54) LIQUID HOLDING CONTAINER AND LIQUID CONSUMING APPARATUS

(71) Applicant: Seiko Epson Corporation, Tokyo (JP)

(72) Inventors: Takeshi Iwamuro, Nagano (JP); Hidetoshi Kodama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/064,340

(22) Filed: Oct. 28, 2013

(65) Prior Publication Data

US 2014/0132678 A1 May 15, 2014

(30) Foreign Application Priority Data

Nov. 12, 2012 (JP) ..... 2012-248730

(51) Int. Cl.
*B41J 2/14* (2006.01)
*B41J 2/175* (2006.01)

(52) U.S. Cl.
CPC ..... *B41J 2/175* (2013.01); *B41J 2/1752* (2013.01)
USPC ..... 347/49; 347/86

(58) Field of Classification Search
CPC ..... B41J 2/17503; B41J 2/17513; B41J 2/17502; B41J 2/17509; B41J 2/175023
USPC ..... 347/49, 84, 85, 86, 87
See application file for complete search history.

(56) References Cited

U.S. PATENT DOCUMENTS

| | | | | |
|---|---|---|---|---|
| 6,168,266 | B1 * | 1/2001 | Ishinaga et al. | 347/86 |
| 6,959,985 | B2 * | 11/2005 | Steinmetz et al. | 347/86 |
| 7,210,771 | B2 * | 5/2007 | Neese et a | 347/85 |
| 8,678,567 | B2 * | 3/2014 | Shimizu et al. | 347/85 |
| 2012/0038719 | A1 | 2/2012 | Shimizu et al. | |

FOREIGN PATENT DOCUMENTS

| | | |
|---|---|---|
| JP | 2012-051307 A | 3/2012 |
| JP | 2012-144017 A | 8/2012 |

* cited by examiner

*Primary Examiner* — Anh T. N. Vo
(74) *Attorney, Agent, or Firm* — Global IP Counselors, LLP

(57) ABSTRACT

A liquid holding container includes an inlet port to which ink to be supplied to a printer is introduced. The liquid holding container has a first part where at least a portion is positioned to be outside the printer and a second part where at least a portion is inserted into the printer. At least a portion of the bottom section of the first part is lower than at least a portion of the bottom section of the second part.

19 Claims, 26 Drawing Sheets

LIQUID HOLDING CONTAINER AND LIQUID CONSUMING APPARATUS

CROSS-REFERENCE TO RELATED APPLICATIONS

This application claims priority to Japanese Patent Application No. 2012-248730 filed on Nov. 12, 2012. The entire disclosure of Japanese Patent Application No. 2012-248730 is hereby incorporated herein by reference.

BACKGROUND

1. Technical Field

The present invention relates to a liquid holding container which accommodates liquid which is supplied to a liquid consuming apparatus, and the liquid consuming apparatus.

2. Related Art

In the prior art, ink jet printers, which perform printing (recording) by ejecting ink (a liquid) from a liquid ejecting head with regard to a target such as paper, are known as one type of liquid consuming apparatus. Then, a configuration was proposed (for example, Japanese Unexamined Patent Application Publication No. 2012-51307) for such printers where ink is supplied to the liquid ejecting head from a liquid holding container where the holding capacity of the ink is comparatively large in order to supply ink continuously and stably to the liquid ejecting head in a case where printing which consumes a comparatively large amount of ink is performed.

In such printers, the liquid holding container is configured to be provided separately from the printer and arranged to be able to be attached and detached with regard to a side surface of the printer or the like. Then, when ink is introduced into the liquid holding container, it is possible to introduce the ink by exposing an ink inlet port by detaching the liquid holding container from the side surface of the printer. Alternatively, a separate liquid holding container (an ink reservoir) is configured to be housed in a state of being placed inside an accommodation case which is provided in a leg section of the printer. Then, when ink is introduced into the liquid holding container, an ink introduction operation is performed by detaching the liquid holding container from inside the accommodation case and moving the liquid holding container to a location where the ink introduction operation is easy.

SUMMARY

However, the liquid holding container which is described in Japanese Unexamined Patent Application Publication No. 2012-51307 is a container for printers which are for general users and is not appropriate for printers for large scale printing such as for industrial or commercial printing. For the printers for large scale printing, the volume of the liquid holding container inevitably becomes large since a large amount of ink is necessary in the printing. However, when the volume of the liquid holding container is large, there are problems in the liquid holding container according to the above mentioned publication such as that it is difficult for the user to move the liquid holding container when introducing the ink.

Such a situation is not limited to printers for large scale printing and the problems are often common to cases where there is an attempt to increase the size of the liquid holding container where it is possible for the user to introduce ink.

The present invention was made in consideration of the above situation and an object of the present invention is to provide at least a liquid holding container where it is possible for a user to introduce ink and it is possible to reduce the possibility that problems will occur even in a case where the size of the liquid holding container is increased, and a liquid consuming apparatus where the liquid holding container is mounted.

It is preferable that a liquid holding container for solving the problem described above be a liquid holding container where an inlet port, where liquid which is supplied to a liquid consuming apparatus is introduced, is formed and the liquid holding container have a first part where at least a portion is positioned to be outside the liquid consuming apparatus in a state where the liquid holding container is mounted in the liquid consuming apparatus, and a second part where at least a portion is inserted into the liquid consuming apparatus in a state where the liquid holding container is mounted in the liquid consuming apparatus, wherein at least a portion of a bottom section of the first part is lower than at least a portion of a bottom section of the second part.

According to this configuration, since it is a configuration where an inlet port, where liquid which is supplied to the liquid consuming apparatus is introduced, is formed and which has the first part where at least a portion is positioned to be outside the liquid consuming apparatus and the second part where at least a portion is inserted into the liquid consuming apparatus, wherein at least a portion of the bottom section of the first part is lower than at least a portion of the bottom section of the second part, it is possible to prevent a problem such that the size of the entirety of the liquid consuming apparatus which includes the liquid holding container is larger in the horizontal direction compared to, for example, a case of a configuration where the bottom surface of the first part and the bottom surface of the second part are the same height and the first part extends in the horizontal direction. In addition, when the first part which is positioned outside the liquid consuming apparatus extends in the horizontal direction, a force which is applied to the second part is increased to the extent that the distance from the second part which is inserted in the liquid consuming apparatus is lengthened, and there is a possibility that the second part will be damaged or the like compared to, for example, a case where the bottom section of the first part is lower than the bottom section of the second part (a case where the first part is extended in the direction of gravity). In addition, there is a possibility that, for example, the liquid consuming apparatus may be inclined to the first part side for the same reason. Due to this, it is possible to reduce the possibility that the problems of damage to the second part, inclining of the liquid consuming apparatus, and the like will occur by the bottom section of the first part being lower than the bottom section of the second part.

In the liquid holding container described above, it is preferable that the volume of the first part be larger than the volume of the second part.

According to this configuration, since the first part with a larger volume compared to the second part is positioned outside the liquid consuming apparatus, it is easy for the user to grasp the remaining amount of ink in the liquid holding container and it is possible to reduce the possibility that problems will occur such that printing goes ahead regardless of whether the ink is overflowing from the liquid holding container due to excessive introduction of ink or the remaining amount of ink being small compared to, for example, a case where the second part with a smaller volume compared to the first part is positioned outside the liquid consuming apparatus.

In the liquid holding container described above, it is preferable that the height of the upper section of the first part be equal to the height of the upper section of the second part.

According to this configuration, since the height of the upper section of the first part and the height of the upper section of the second part are equal, it is possible to achieve an increase in the volume of the liquid holding container and to prevent the position of the inlet port being raised along with the increase in the volume of the liquid holding container. For example, when the height of the inlet port is raised, problems and the like occur such that it is necessary for the container where the ink to be introduced is accommodated to be lifted up to the height of the inlet port when the user introduces the ink. As a result, it is possible to prevent the problems such as these and the like by the height of the upper section of the first part and the height of the upper section of the second part being equal.

In the liquid holding container described above, it is preferable that the length of the first part in the short side direction and the length of the second part in the short side direction be equal.

According to this configuration, since the lengths of the first part and the second part in the short side direction are equal, it is easy for the user to estimate the remaining amount in the second part which is inserted into the liquid consuming apparatus and where it is difficult to grasp the remaining amount of ink in the inner section of the second part. Due to this, it is possible to reduce the possibility that problems will occur such that printing goes ahead regardless of whether the ink is overflowing from the liquid holding container due to excessive introduction of ink or the remaining amount of ink being small.

It is preferable that the liquid holding container described above have an outlet port which is connected to the liquid consuming apparatus and where the liquid flows out to the liquid consuming apparatus, and that the outlet port be provided in the second part.

According to this configuration, since the outlet port which is connected with the liquid consuming apparatus is provided in the second part which is inserted into the liquid consuming apparatus, it is possible to reduce the possibility that problems will occur such that the connection between the liquid consuming apparatus and the outlet port will be disconnected compared to a case where the outlet port is provided in the first part which is positioned outside of the liquid consuming apparatus. In detail, since the first part is positioned outside of the liquid consuming apparatus, there are cases where an impact is directly applied to the first part due to the user placing an object on the upper section of the first part or there being an accidental collision or the like. In this case, when the outlet port is provided in the first part, it is possible that the connection between the liquid consuming apparatus and the outlet port may be disconnected due to such an impact. On the other hand, when the outlet port is provided in the second part, impacts are also indirectly applied to the second part, but it is possible to weaken the impacts which are received compared to a case where the outlet port is provided in the first part.

It is preferable that the liquid holding container described above have an engaging section which engages with the liquid consuming apparatus, that the first part be configured by at least a first surface on the insertion direction side of the liquid holding container and a second surface which opposes the first surface, and that the engaging section be provided on the first surface.

According to this configuration, since the engaging section which engages with the liquid consuming apparatus is provided in the first part on the first surface on the insertion direction side of the liquid holding container, it is possible to prevent an increase in the size of the liquid consuming apparatus compared to a case where the engaging section is provided on the second surface which opposes the first surface. In addition, since the first surface is positioned on the insertion direction side, it is possible to reduce the possibility that problems will occur such that the engaging section will inhibit the user from observing the remaining amount inside the liquid holding container from the outside.

In the liquid holding container described above, it is preferable that the first part be configured by at least an upper section, a first surface of the second part side, and a second surface which opposes the first surface, and that the inlet port be formed in the first part at a position which is closer to the second surface than the first surface.

According to this configuration, since the inlet port is formed in the first part at a position which is closer to the second surface, which opposes the first surface, than the first surface of the second part side, it is possible to reduce the possibility that problems will occur such that the ink will be attached to and foul the liquid consuming apparatus even in a case where ink accidentally overflows to the outside of the inlet port when the user introduces the ink. In addition, since the first surface is the surface which is closer to the liquid consuming apparatus compared to the second surface, it is possible to reduce the possibility that problems will occur such that it is not possible for the user to recognize the state of the introduction due to the liquid consuming apparatus by providing the inlet port at a position which is close to the second surface.

In the liquid holding container described above, it is preferable that an atmosphere linking port which links at least one of the first part and the second part to the outside be formed in the liquid holding container, and that the atmosphere linking port be formed in the first part between the ink inlet port and the second part.

According to this configuration, since the atmosphere linking port is formed in the first part between the ink inlet port and the second part, it is possible to reduce the possibility that problems will occur such that, when the user introduces ink from an ink refill container where ink for introduction is accommodated, ink, which drips downward along a portion of the ink refill container which may be a blind spot of the user, enters the atmosphere linking port and blocks the atmosphere linking port.

In the liquid holding container described above, it is desirable that the second part be connected with the liquid consuming apparatus so as to be able to swing.

According to this configuration, since the second part and the liquid consuming apparatus are connected so as to be able to swing, it is possible to maintain a connection even in a case where force is applied to the first part when the ink is introduced, and it is possible to reduce the possibility that problems will occur such that the connection will be disconnected.

It is desirable that the liquid consuming apparatus be mounted with the liquid holding container described above.

It is preferable that a liquid consuming apparatus for solving the problems described above be a liquid consuming apparatus which is mounted with a liquid holding container where an inlet port is formed, and that the liquid holding container be configured to have a first part where at least a portion is positioned to be outside the liquid consuming apparatus in a state where the liquid holding container is mounted in the liquid consuming apparatus and a second part where at least a portion is inserted into the liquid consuming apparatus in a state where the liquid holding container is mounted in the liquid consuming apparatus, wherein at least a portion of a bottom section of the first part is lower than at least a portion of a bottom section of the second part.

According to this configuration, since it is a configuration where the inlet port, where liquid which is supplied to the liquid consuming apparatus is introduced, is formed and the liquid holding container has the first part where at least a portion is positioned to be outside the liquid consuming apparatus and the second part where at least a portion is inserted into the liquid consuming apparatus, wherein at least a portion of the bottom section of the first part is lower than at least a portion of the bottom section of the second part, it is possible to prevent a problem such that the size of the entirety of the liquid consuming apparatus which includes the liquid holding container is larger in the horizontal direction compared to, for example, a case of a configuration where the bottom surface of the first part and the bottom surface of the second part are the same height and the first part extends in the horizontal direction. In addition, when the first part which is positioned outside the liquid consuming apparatus extends in the horizontal direction, a force which is applied to the second part is increased to the extent that the distance from the second part which is inserted in the liquid consuming apparatus is lengthened, and there is a possibility that the second part will be damaged or the like compared to, for example, a case where the bottom section of the first part is lower than the bottom section of the second part (a case where the first part is extended in the direction of gravity). In addition, there is a possibility that, for example, the liquid consuming apparatus may be inclined to the first part side for the same reason. Due to this, it is possible to reduce the possibility that the problems of damage to the second part, inclining of the liquid consuming apparatus, and the like will occur by the bottom section of the first part being lower than the bottom section of the second part.

In the liquid holding container of the liquid consuming apparatus described above, it is preferable that the volume of the first part be larger than the volume of the second part.

According to this configuration, since the first part with a larger volume compared to the second part is positioned outside the liquid consuming apparatus, it is easy for the user to grasp the remaining amount of ink in the liquid holding container, and it is possible to reduce the possibility that problems will occur such that printing goes ahead regardless of whether the ink is overflowing from the liquid holding container due to excessive introduction of ink or the remaining amount of ink being small compared to, for example, a case where the second part with a small volume compared to the first part is positioned outside the liquid consuming apparatus.

In the liquid holding container of the liquid consuming apparatus described above, it is preferable that the height of the upper section of the first part and the height of the upper section of the second part be equal.

According to this configuration, since the height of the upper section of the first part and the height of the upper section of the second part are equal, it is possible to achieve an increase in the volume of the liquid holding container and prevent the position of the inlet port being raised along with an increase in the volume of the liquid holding container. For example, when the height of the inlet port is raised, problems and the like occur such that it is necessary for the container where the ink to be introduced is accommodated to be lifted up to the height of the inlet port when the user introduces the ink. As a result, it is possible to prevent the problems such as these and the like by the height of the upper section of the first part and the height of the upper section of the second part being equal.

In the liquid holding container of the liquid consuming apparatus described above, it is preferable that the length of the first part in a short side direction and the length of the second part in a short side direction be equal.

According to this configuration, since the lengths of the first part and the second part in the short side directions are equal, it is easy for the user to estimate the remaining amount in the second part which is inserted into the liquid consuming apparatus and where it is difficult to grasp the remaining amount of ink in the inner section of the second part. Due to this, it is possible to reduce the possibility that problems will occur such that printing goes ahead regardless of whether the ink is overflowing from the liquid holding container due to excessive introduction of ink or the remaining amount of ink being small.

It is preferable that the liquid holding container of the liquid consuming apparatus described above have an outlet port which is connected to the liquid consuming apparatus and where the liquid flows out to the liquid consuming apparatus, and that the outlet port be provided in the second part.

According to this configuration, since the outlet port which is connected with the liquid consuming apparatus is provided in the second part which is inserted into the liquid consuming apparatus, it is possible to reduce the possibility that problems will occur such that the connection between the liquid consuming apparatus and the outlet port will be disconnected compared to a case where the outlet port is provided in the first part which is positioned outside of the liquid consuming apparatus. In detail, since the first part is positioned outside of the liquid consuming apparatus, there are cases where an impact is directly applied to the first part due to the user placing an object on the upper section of the first part or there being an accidental collision or the like. In this case, when the outlet port is provided in the first part, it is possible that the connection between the liquid consuming apparatus and the outlet port may be disconnected due to such an impact. On the other hand, when the outlet port is provided in the second part, impacts are also indirectly applied to the second part, but it is possible to weaken the impacts which are received compared to a case where the outlet port is provided in the first part.

It is preferable that the liquid holding container of the liquid consuming apparatus described above have an engaging section which engages with the liquid consuming apparatus, that the first part be configured by at least a first surface on the insertion direction side of the liquid holding container and a second surface which opposes the first surface, and that the engaging section be provided on the first surface.

According to this configuration, since the engaging section which engages with the liquid consuming apparatus is provided in the first part on the first surface on the insertion direction side of the liquid holding container, it is possible to prevent an increase in the size of the liquid consuming apparatus compared to a case where the engaging section is provided on the second surface which opposes the first surface. In addition, since the first surface is positioned on the insertion direction side, it is possible to reduce the possibility that problems will occur such that the engaging section will inhibit the user from observing the remaining amount inside the liquid holding container from the outside.

In the liquid holding container of the liquid consuming apparatus described above, it is preferable that the first part be configured by at least an upper section, a first surface of the second part side, and a second surface which opposes the first surface, and that the inlet port be formed in the first part at a position which is closer to the second surface than the first surface.

According to this configuration, since the inlet port is formed in the first part at a position which is closer to the second surface which opposes the first surface than the first surface of the second part side, it is possible to reduce the possibility that problems will occur such that the ink will be attached to and foul the liquid consuming apparatus even in a case where ink accidentally overflows to the outside of the inlet port when the user introduces the ink. In addition, since the first surface is the surface which is closer to the liquid consuming apparatus compared to the second surface, it is possible to reduce the possibility that problems will occur such that it is not possible for the user to recognize the state of the introduction due to the liquid consuming apparatus by providing the inlet port at a position which is close to the second surface.

In the liquid holding container of the liquid consuming apparatus described above, it is preferable that an atmosphere linking port which links at least one of the first part and the second part to the outside be formed in the liquid holding container, and that the atmosphere linking port be formed in the first part between the inlet port and the second part.

According to this configuration, since the atmosphere linking port is formed in the first part between the ink inlet port and the second part, it is possible to reduce the possibility that problems will occur such that, when the user introduces ink from an ink refill container where ink for introduction is accommodated, ink which drips downward along a portion of the ink refill container which may be a blind spot of the user enters the atmosphere linking port and blocks the atmosphere linking port.

In the liquid holding container of the liquid consuming apparatus described above, it is desirable that the second part be connected with the liquid consuming apparatus so as to be able to swing.

According to this configuration, since the second part and the liquid consuming apparatus are connected so as to be able to swing, it is possible to maintain a connection even in a case where force is applied to the first part when the ink is introduced, and it is possible to reduce the possibility that problems will occur such that the connection will be disconnected.

BRIEF DESCRIPTION OF THE DRAWINGS

Referring now to the attached drawings which form a part of this original disclosure:

FIG. 9A is a perspective diagram illustrating a state where the inlet port is covered with a covering body and FIG. 9B is a perspective diagram illustrating a state where the covering body is detached from the inlet port.

FIG. 12A is a diagram of a cross section along line B-B in FIG. 10 and FIG. 12B is a diagram of a cross section along line C-C in FIG. 10.

DETAILED DESCRIPTION OF EXEMPLARY EMBODIMENTS

Below, an embodiment of a liquid holding container and an ink jet printer (referred to below as a "printer") which is an example of a liquid consuming apparatus which consumes liquid which is supplied from the liquid holding container will be described with reference to the diagrams.

Figure 1:
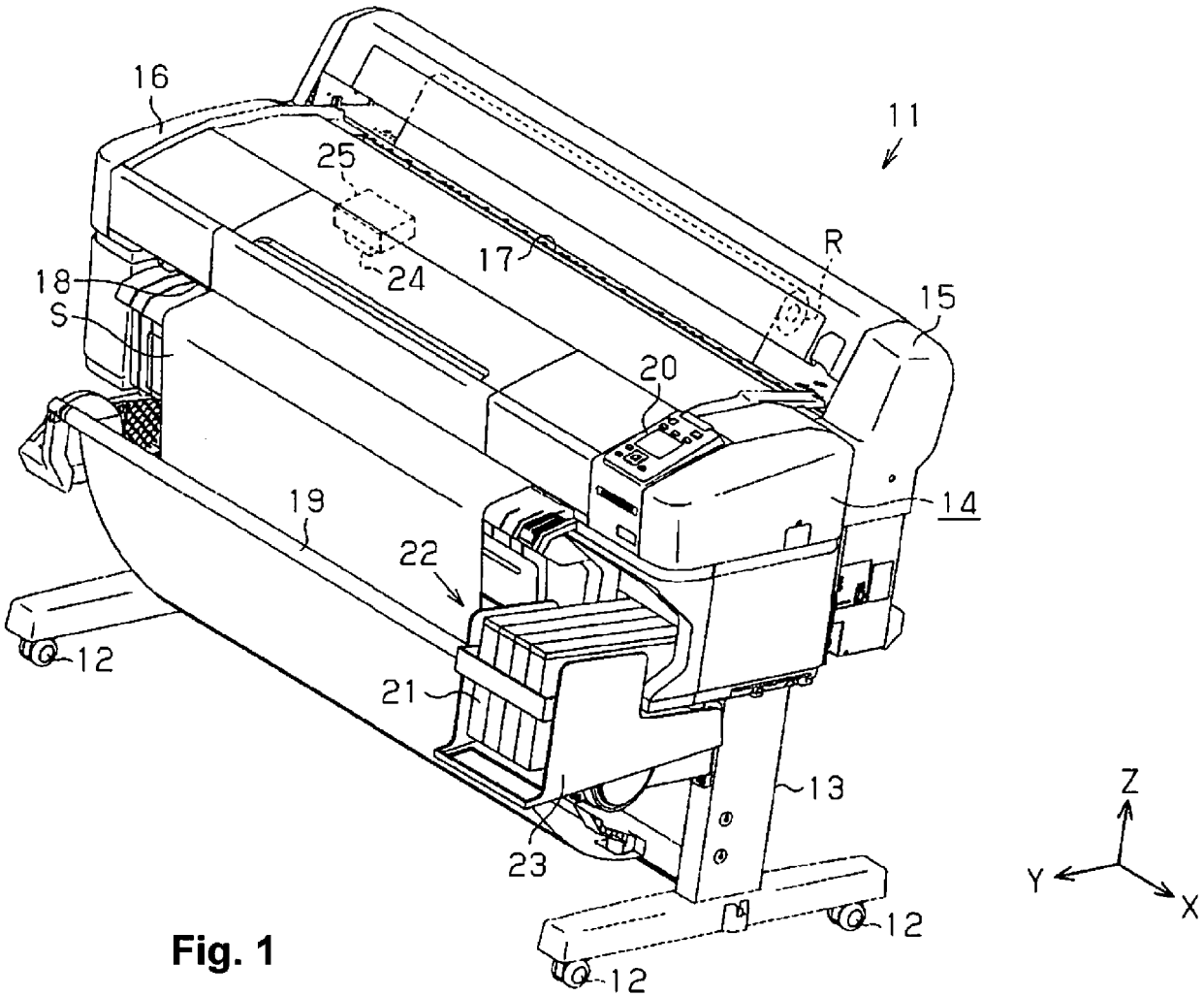
FIG. 1 is a perspective diagram of a printer where a liquid holding container which is an embodiment is fixed.

As shown in FIG. 1, a printer 11 of the present embodiment is provided with a leg section 13 where a wheel 12 is attached at a lower end, and an apparatus body 14 with a substantially rectangular shape which is assembled on the leg section 13. Here, in the present embodiment, the direction along the direction of gravity is the up and down direction Z, and the longitudinal direction of the apparatus body 14 which intersects with the up and down direction Z (to be perpendicular in the present embodiment) is the left and right direction X. In addition, the direction which intersects with both of the up and down direction Z and the left and right direction X (to be perpendicular in the present embodiment) is the front and back direction Y.

As shown in FIG. 1, a feeding section 15 which protrudes upward is provided in a rear section of the apparatus body 14. Roll paper R where paper S as a medium with a long shape is wound in layers in a cylindrical shape is loaded inside the feeding section 15. An insertion opening 17 for introducing the paper S which is fed out from the feeding section 15 inside a housing section 16 is formed in the housing section 16, which configures the exterior of the apparatus body 14, at a position at the front side of the feeding section 15.

On the other hand, a discharge opening 18 for discharging the paper S to the outside of the housing section 16 is formed in the front surface side of the apparatus body 14. Here, a medium transporting mechanism (which is not shown in the diagram), which transports the paper S, which is fed from the feeding section 15, from the insertion opening 17 side toward the discharge port 18 side, is accommodated inside the housing section 16. Then, a medium receiving unit 19, which receives the paper S which is discharged from the discharge port 18, is provided in the front surface side of the apparatus body 14 at a position which is below the discharge port 18.

In addition, an operation panel 20 for performing setting operations and input operations is provided in an upper section of apparatus body 14 at one end side (the right end side in FIG. 1) which is the outer side of a transport path of the paper S in the left and right direction X. Furthermore, a liquid holding container 21, which is able to accommodate ink which is an example of a liquid, is mounted in a lower section of the apparatus body 14 at one end side (the right end side in FIG. 1) which is the outer side of the transport path of the paper S in the left and right direction X.

A plurality (four in the present embodiment) of the liquid holding containers 21 are provided to correspond to the types and colors of the inks. Then, a liquid holding unit 22 is configured by arranging the plurality of liquid holding containers 21 to line up in the left and right direction X. In other words, it is possible for the direction where the plurality of liquid holding containers 21 are lined up to be the X direction. Here, the liquid holding unit 22 has a portion which is exposed to the front side (the outer side) of the apparatus body 14 in a state where each of the liquid holding containers 21 is mounted in the apparatus body 14. Then, both sides in the left and right direction X and the lower side in the up and down direction Z of the exposed portion of the liquid holding unit 22 are covered by a frame member 23 with a cross section with a substantially U-shape which is fixed to the apparatus body 14 side.

In addition, a carriage 25 which is mounted onto a liquid ejecting head 24 is accommodated inside the housing section 16 in a state where it is possible for the carriage 25 to move reciprocally in the left and right direction X which is the main scanning direction. Here, a liquid supply mechanism, which is not shown in the diagram, for supplying ink which is accommodated in the liquid holding containers 21 to the liquid ejecting head 24, is accommodated inside the housing section 16. Then, recording (printing) is performed by ejecting ink droplets from the liquid ejecting head 24 with regard to the paper S which is transported by the medium transport mechanism, and the ink inside the liquid holding containers 21 is consumed through the ejection of ink droplets in this manner.

Next, a mounting section 31 where the liquid holding containers 21 are mounted in a fixed state with regard to the apparatus body 14 and the liquid holding containers 21 which are fixed to the apparatus body 14 via the mounting section 31 will be described. Here, in order to avoid complicating the diagram in FIG. 2, only one supply section 32 which is a portion of the liquid supply mechanism which supplies ink from each of the liquid holding containers 21 to the liquid ejecting head 24 side is illustrated and the liquid holding container 21, which corresponds to the one supply section 32 which is illustrated, is illustrated in a state before being mounted in the mounting section 31 as shown by the two-dot chain line and the white arrows. In addition, a liquid holding body 33 which configures the liquid holding container 21 and a slider 34 which is an example of an auxiliary holding member are illustrated in a separated state in FIG. 3.

Figure 2:
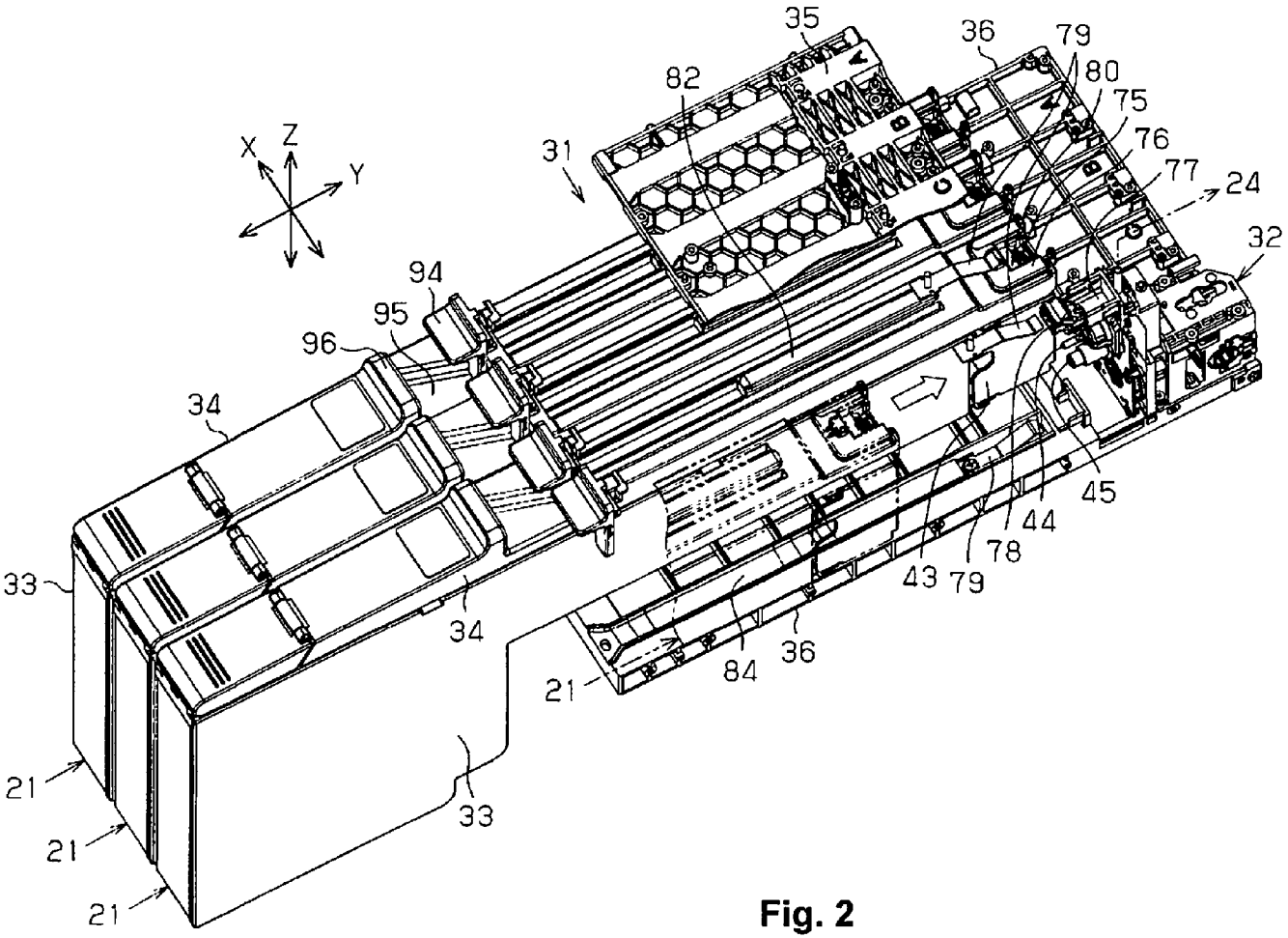
FIG. 2 is a perspective diagram illustrating a state where the liquid holding container is mounted in a mounting section.

As shown in FIG. 2, the mounting section 31, which has an upper frame 35 and a lower frame 36 which are disposed to open a predetermined gap in the vertical direction (the up and down direction Z), is provided in the printer 11. In addition, the supply sections 32 which are portions of the liquid supply mechanism are attached to the mounting section 31 to correspond to each of the liquid holding containers 21. Here, the upper frame 35 is illustrated in FIG. 2 in a state where a portion in the left and right direction X is cut away and removed.

In the present embodiment, the liquid holding containers 21 are fixed so as to be unable to move with regard to the printer 11 in a state where one end side (the right end side in FIG. 2) in the longitudinal direction of the liquid holding containers 21 is positioned inside the mounting section 31. Then, in a state where the liquid holding containers 21 are fixed to the printer 11, the inks which are accommodated in the liquid holding containers 21 are each supplied to the liquid ejecting head 24 side using the supply sections 32 which are attached to correspond to the one end side of each of the liquid holding containers 21 in the mounting section 31. Accordingly, in the present embodiment, a state where the liquid holding containers 21 are mounted in the mounting section 31 of the printer 11 and fixed so as to be unable to move with regard to the printer 11 is a state of the posture which the liquid holding containers 21 take during use. Here, the state of being fixed refers to a state where it is not possible for the user to detach the liquid holding containers 21 from the printer 11, for example, the fixed state refers to a state where the liquid holding containers 21 are screwed to the printer 11, a state where the ink is being supplied from the liquid holding containers 21 to the printer 11 and the printer 11 is performing a printing operation, or the like.

Figure 3:
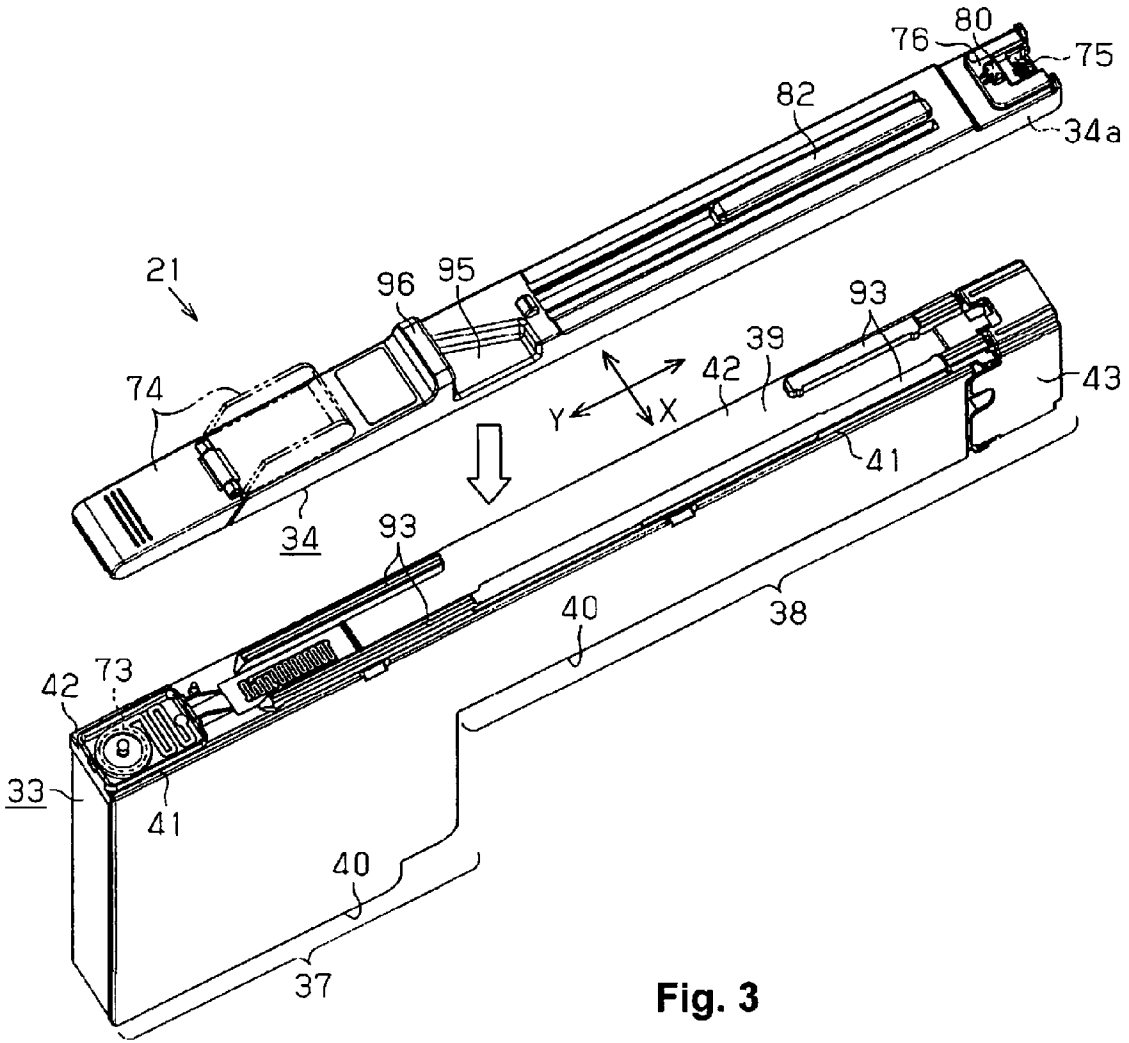
FIG. 3 is a perspective diagram illustrating the liquid holding container in a state of being separated from a slider.

Here, as shown in FIG. 2 and FIG. 3, the liquid holding containers 21 of the present embodiment are provided with the liquid holding body 33 which accommodates ink and the slider 34 which is disposed to overlap with the upper side in the direction against gravity in the vertical direction with regard to the liquid holding body 33.

The liquid holding bodies 33 have a rectangular shape which substantially has a L-shape in a side surface view where the mounting direction of being mounted in the mounting section 31 is the longitudinal direction (the front and back direction Y) and which has a substantially constant width in the short side direction (the left and right direction X) which is perpendicular to the longitudinal direction and the horizontal direction. That is, the side surface shape of the liquid holding body 33 when viewed from the short side direction (the left and right direction X) of the liquid holding body 33 has a first holding body section 37 with a substantially square shape and a second holding body section 38 with a long substantially rectangular shape in the front and back direction Y more to the rear side than the first holding body section 37 and where an outlet port 52 which will be described later is formed. Then, flat surface sections 41 and 42 which continuously extend without steps in the longitudinal direction (the front and back direction Y) are formed on an upper surface 39 of the liquid holding body 33 at both end portions in the short side direction. That is, it is possible to say that the heights in the height direction (the vertical direction) of the upper surface (it is also possible for the upper surface to be referred to as the upper section or the top surface) in the plurality of surfaces which configure the first holding body section 37 and the upper surface (it is also possible for the upper surface to be referred to as the upper section or the top surface) in the plurality of surfaces which configure the second holding body section 38 are equal. It is possible for the slider 34 to slide along the flat surface sections 41 and 42. On the other hand, a lower surface 40 of the liquid holding body 33 has a shape with a stepped surface where the first holding body section 37 is lower than the second holding body section 38 in the longitudinal direction (the front and back direction Y) of the liquid holding body 33. That is, it is possible to say that the bottom surface (the bottom section) out of the plurality of surfaces which configure the first holding body section 37 is at a position which is lower in the height direction (the vertical direction) than the bottom surface (the bottom section) out of the plurality of surfaces which configure the second holding body section 38. Here, it is sufficient if at least a portion of the bottom surface (the bottom section) out of the plurality of surfaces which configure the first holding body section 37 is at a position which is lower in the height direction (the vertical direction) than at least a portion of the bottom surface (the bottom section) out of the plurality of surfaces which configure the second holding body section 38. Furthermore, the volume of the first holding body section 37 is larger than the volume of the second holding body section 38. Here, in an embodiment where the slider 34 is not used, for reasons which will be described later, the heights in the height direction (the vertical direction) of the upper surface (it is also possible for the upper surface to be referred to as the upper section or the top surface) in the plurality of surfaces which configure the first holding body section 37 and the upper surface (it is also possible for the upper surface to be referred to as the upper section or the top surface) in the plurality of surfaces which configure the second holding body section 38 may be equal or not equal, but it is desirable that the height of the upper surface of the first holding body section 37 from the upper surface of the second holding body section 38 be lower than the height of the bottom surface of the second holding body section 38 from the bottom surface of the first holding body section 37.

Then, in the present embodiment, the first holding body section 37 is configured by at least a first surface (it is also possible for the first surface to be referred to as the first side surface or the first side section) at the mounting direction side (the insertion direction side) of the liquid holding container 21 and a second surface (it is also possible for the second surface to be referred to as the second side surface or the second side section) which opposes the first surface, but the liquid holding container 21 is fixed with regard to the printer 11 so as to be unable to move by a fixed section 37*a* (refer to FIG. 13, FIG. 14, and FIG. 20) which is an engaging section which is provided on the first surface being screwed with regard to a fixing section (which is not shown in the diagrams) which is provided at the apparatus body 14 side using a screw 37*b* (refer to FIG. 20). Then, in the present embodiment, in a state where the liquid holding body 33 which is fixed by screwing is mounted in the printer 11, at least a portion of the second holding body section 38 becomes a second part (it is also possible for the second part to be referred to as the part which is mounted or inserted into the printer 11 or the apparatus body 14) where at least a portion of the second part is positioned inside the apparatus body 14 of the printer 11, while the second holding body section 38 excluding the second part and the first holding body section 37 become a first part where at least a portion is exposed in front of the apparatus body 14 by being positioned outside the apparatus body 14 of the printer 11. Here, it is also possible for the first surface which is the surface of the first holding body section 37 in the mounting direction to be referred to as the surface of the second holding body section 38 side out of the surfaces which configure the first holding body section 37.

In addition, as described above, since the bottom surface of the first holding body section 37 is at a position which is lower in the height direction than the bottom surface of the second holding body section 38, at least a portion of the bottom surface (the bottom section) of the first part is at a position which is lower than the bottom surface (the bottom section) of the second part.

In addition, as described above, since the volume of the first holding body section 37 is larger than the volume of the second holding body section 38, the volume of the first part is larger than the volume of the second part.

In addition, as described above, since the outlet port 52 is formed in the second holding body section 38, it is possible to say that the outlet port 52 is formed in the second part.

Furthermore, as described above, since the heights of the upper surface out of the plurality of surfaces which configure the first holding body section 37 and the upper surface out of the plurality of surfaces which configure the second holding body section 38 are equal in the height direction (the vertical direction), the heights of upper surface out of the plurality of surfaces which configure the first part and the upper surface out of the plurality of surfaces which configure the second part are equal in the height direction (the vertical direction).

Furthermore, as described above, since the liquid holding body 33 has a rectangular shape which substantially has a L-shape in a side surface view where the mounting direction of being mounted in the mounting section 31 is the longitudinal direction (the front and back direction Y) and which has a substantially constant width in the short side direction (the left and right direction X) which is perpendicular to the longitudinal direction and the horizontal direction, the length of the first part in the short side direction and the length of the second part in the short side direction are equal.

Furthermore, a connection section 43, which is formed as a separate member to a housing member (an holding body case 130 shown in FIG. 13) which configures the liquid holding body 33 and which is attached to as to be able to relatively move with regard to the second holding body section 38, is provided in the second holding body section 38 at the rear end side (the mounting direction side of the liquid holding container 21) which is the opposite side to the first holding body section 37 side in the longitudinal direction of the second holding body section 38. An ink flow path, which directs ink which is accommodated inside the liquid holding body 33 to an ink supply needle 44 which is provided in a supply section 32 which is attached to the mounting section 31 side, and a transfer mechanism, which transfers the state of the presence or absence of the ink inside the liquid holding body 33 to an ink remaining amount detection rod 45 which is provided in the supply section 32 in a similar manner, are formed in the connection section 43.

Here, the configuration of the connection section 43 where the ink flow path and the transfer mechanism are formed will be described with reference to FIG. 4 and FIG. 5. Here, in FIG. 4 and FIG. 5, constituent members which relate to the supply needle 44 and the remaining amount detection rod 45 out of the constituent members of the supply section 32 are illustrated and other constituent members are omitted as appropriate.

Figure 4:
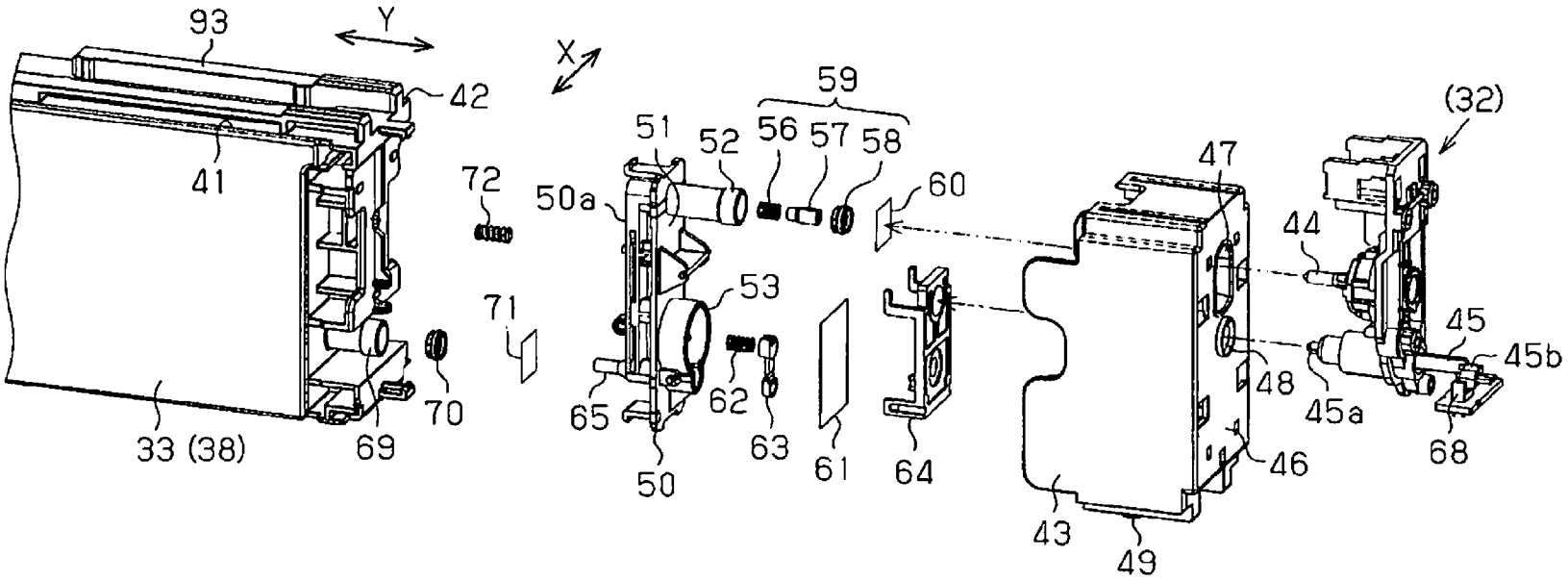
FIG. 4 is an exploded perspective diagram illustrating a configuration of a connection section which is provided in the liquid holding container.
Figure 5:
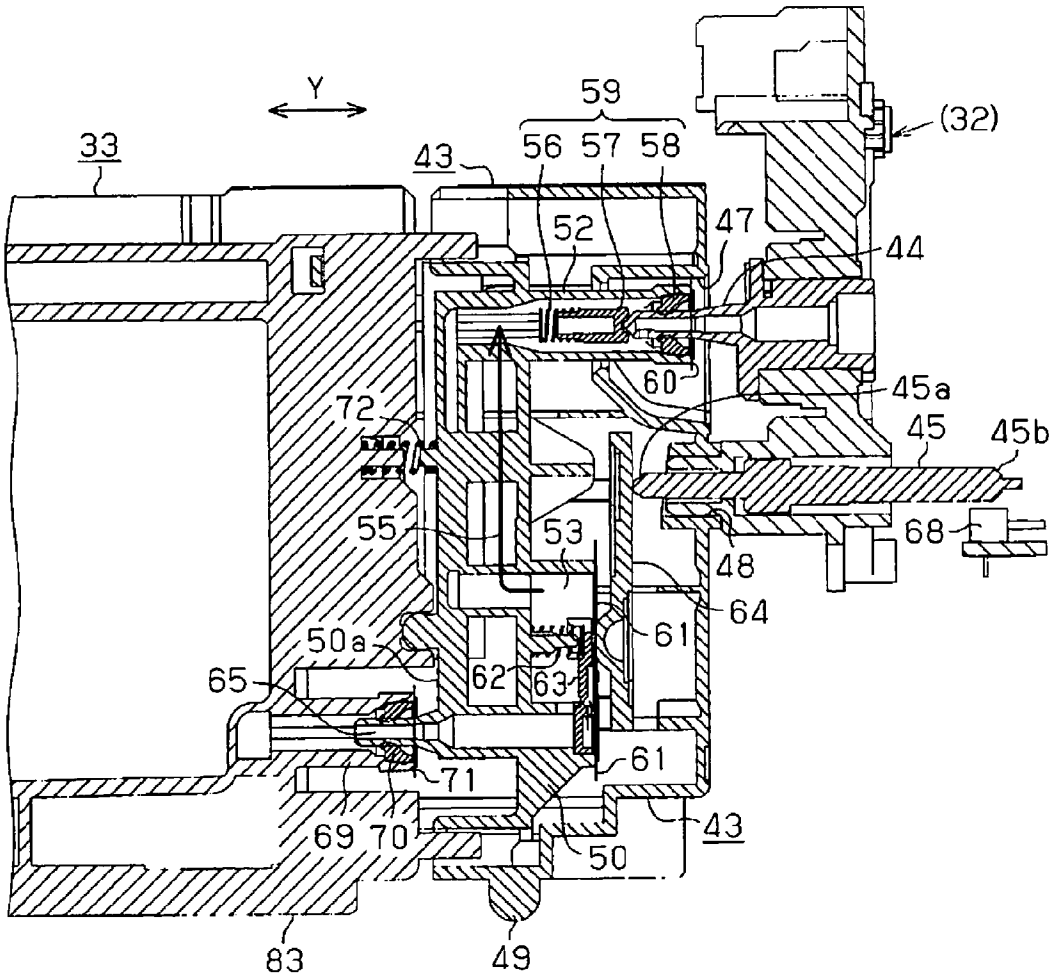
FIG. 5 is a cross sectional diagram illustrating a configuration of the connection section which is provided in the liquid holding container.

As shown in FIG. 4 and FIG. 5, the connection section 43 which is provided in the second holding body section 38 has a housing with a substantial box shape with a bottom where one side is opened, and a bottom wall section of the housing configures an end surface 46 on the supply section 32 side in the second holding body section 38 of the liquid holding body 33. Then, a needle insertion hole 47 where the supply needle 44 of the supply section 32 is inserted is formed in the end surface 46 of the connection section 43 and a rod insertion hole 48 where the remaining amount detection rod 45 is inserted is formed at a position which is adjacent with regard to the needle insertion hole 47. In addition, a protruding part 49 with a substantially cylindrical shape is formed at the surface of bottom surface side in the connection section 43.

An attached member 50 with a substantially plate shape, which has a predetermined thickness in the direction where the supply needle 44 is inserted into the needle insertion hole 47, is provided inside the housing of the connection section 43. The outlet port 52 with a substantially cylindrical shape where the supply needle 44 is inserted via the needle insertion hole 47 and a liquid chamber 53 with a similar substantially cylindrical shape are formed in the attached member 50 at an end surface 51 on one side which is the supply section 32 side in the thickness direction of the attached member 50. Then, an outflow flow path 55 which links a liquid chamber 53 and the outlet port 52 is formed through the attached member 50 as shown by the thick solid line arrow in FIG. 5. In addition, the attached member 50 is attached with regard to the liquid holding body 33 so as to be able to swing.

Since the supply needle 44 is inserted in the outlet port 52 via the needle insertion hole 47, an opening and closing valve 59 which is formed of a spring 56, a valve member 57, and packing 58, which suppress the ink which is supplied from the liquid holding body 33 side from flowing out, is built into the outlet port 52. In addition, a seal 60 which covers the opening of the outlet port 52 is provided by welding such that the ink does not flow out before the supply needle 44 is inserted.

In addition, a film 61 which has flexibility is welded to the liquid chamber 53 so as to cover the opening of the liquid chamber 53. As a result, the volume of the liquid chamber 53 changes due to changes in the shape of the film 61 along with pressure changes inside. In addition, a spring 62 which presses the film 61 toward the outer side of the liquid chamber 53 is provided inside the liquid chamber 53. Here, a pressure receiving plate 63 which transmits pressing force of the spring 62 to the film 61 is inserted between the spring 62 and the film 61.

In addition, a moving member 64 is attached to the outer surface of the liquid chamber 53 in the attached member 50. The moving member 64 is configured to freely rotate centering on a predetermined rotation fulcrum which extends in the horizontal direction (the left and right direction X) which is perpendicular to the longitudinal direction (the front and back direction Y) of the liquid holding body 33, and comes into contact with regard to the film 61 which configures a portion of the inner surface of the liquid chamber 53 from the outside of the liquid chamber 53.

On the other hand, in an end surface 50*a* on the other end side in the thickness direction of the attached member 50, an inflow port 65 with a substantially cylindrical shape is formed to protrude in the thickness direction of the attached member 50. Then, a directing port (a directing port section) 69 with a substantially cylindrical shape where an inflow port 65 is inserted is provided at the liquid holding body 33 (the second holding body section 38) side to correspond to the inflow port 65. By the insertion of the inflow port 65 into the directing port 69, there is a configuration which links the inside of the liquid holding body 33 (the second holding body section 38) and the liquid chamber 53. Here, packing 70 which suppresses the ink which is accommodated in the liquid holding body 33 from leaking and flowing out is built into the directing port 69, and a seal 71 which covers an opening in the directing port 69 is provided by welding in the directing port 69 such that the ink does not flow out from the liquid holding body 33 before the inflow port 65 is inserted into the liquid holding body 33 (the second holding body section 38).

In addition, the attached member 50 is pressed to the mounting section 31 side inside the connection section 43 by a compression spring 72 which is inserted between the attached member 50 and the liquid holding body 33 (the second holding body section 38) such that, for example, the insertion of the supply needle 44 into the outlet port 52 and the contact of the remaining amount detection rod 45 with the moving member 64 are stable.

Here, the transfer mechanism will be described with reference to FIG. 5.

As shown in FIG. 5, the film 61 of the liquid chamber 53 is configured in the connection section 43 to be pushed out via the pressure receiving plate 63 using the spring 62 such that the volume of the liquid chamber 53 is increased. As a result, along with the increase in the volume of the liquid chamber 53, the ink inside the liquid holding body 33 flows into the liquid chamber 53 through the inflow port 65. On the other hand, by the ink being sucked from the outlet port 52 toward the supply needle 44 by the supply section 32, the ink inside the liquid chamber 53 flows out from the liquid chamber 53 through the outflow flow path 55. At this time, in the present embodiment, since the inner diameter of the outflow flow path 55 is set to be larger than the inner diameter of the inflow port 65, the outflow amount of ink from the liquid chamber 53 does not keep up with the inflow amount of ink to the liquid chamber 53 and the pressure inside of the liquid chamber 53 is negative. As a result, the film 61 changes shape so as to be sucked into the liquid chamber 53 against the pressing force of the spring 62. That is, FIG. 5 illustrates a state where the film 61 is sucked into the liquid chamber 53.

The negative pressure which is generated in the liquid chamber 53 is eliminated gradually by the ink inside the liquid holding body 33 flowing into the liquid chamber 53 through the inflow port 65. Due to this, the film 61 is pushed out to the outer side of the liquid chamber 53 again by the force of the spring 62 and the volume of the liquid chamber 53 is restored. As a result, after a predetermined time has passed since the supply of ink to the liquid ejecting head 24 stopped in the supply section 32, the original state before the start of the supply of ink to the liquid ejecting head 24 is restored. In addition, when ink is supplied again from the supply section 32 to the liquid ejecting head 24 side, the pressure inside the liquid chamber 53 becomes negative and the film 61 enters a state of being sucked to the inner side of the liquid chamber 53. On the other hand, when the ink which is inside the liquid holding body 33 runs out by being consumed, the ink does not flow into the liquid chamber 53 even when the pressure inside the liquid chamber 53 is negative. That is, the negative pressure inside the liquid chamber 53 is not eliminated and the state where the film 61 is sucked to the inner side of the liquid chamber 53 is maintained even after a predetermined time has passed since the supply of ink by the supply section 32 stopped.

A spring (which is not shown in the diagram) which presses the remaining amount detection rod 45 so as to come into contact with the moving member 64 is attached to the remaining amount detection rod 45. In addition, another end portion 45*b* on the opposite side to one end portion 45*a* which comes into contact with the moving member 64 in the remaining amount detection rod 45 is a part which is a detection target for a sensor 68 with a concave shape. The sensor 68 is a transmissive photo-sensor and is provided with a light receiving section and a light emitting section which are not shown in the diagram which oppose each other. The presence or absence of the ink inside the liquid holding body 33 is detected by a detection signal which is output from the sensor 68.

That is, since the ink does not flow into the liquid chamber 53 from inside the liquid holding body 33 when the ink inside the liquid holding body 33 runs out, a state is maintained where the shape of the film 61 is changed in the direction where the volume of the liquid chamber 53 decreases. Accordingly, the moving member 64 rotates centering on the rotation fulcrum due to the moving member 64 being pushed by the one end portion 45*a* of the remaining amount detection rod 45 which is pressed by a spring which is not shown in the diagram, and the other end portion 45*b* of the remaining amount detection rod 45 is inserted between the light emitting section and the light receiving section of the sensor 68 due to the remaining amount detection rod 45 moving to the liquid holding body 33 side. As a result, the sensor 68 detects that there is no ink inside the liquid holding body 33 based on the light being maintained in an interrupted state.

Next, returning to FIG. 2 and FIG. 3, the slider 34 will be described.

As shown in FIG. 3, in the first part which is positioned outside the printer 11 in the liquid holding body 33, an inlet port (inlet port section) 73 which introduces ink into the liquid holding body 33 is provided in the upper surface 39 of the liquid holding body 33. In more detail, the inlet port 73 is formed in the first part at a position which is closer to the second surface than the first surface described above. In the present embodiment, the first liquid holding body section 37 is equivalent to the first part and the inlet port 73 is provided in the first holding body section 37. Then, there is a configuration where it is possible to cover the inlet port 73 which is positioned outside the printer 11 using the slider 34 so as to not be exposed other than during the introduction of ink.

That is, the slider 34 has a substantially rectangular shape which has a longitudinal direction and is formed with an outer shape which substantially overlaps with the upper surface 39 of the liquid holding body 33. Then, when the slider 34 is disposed in a state which substantially overlaps with the upper surface 39 of the liquid holding body 33 by one end side of the slider 34 being inserted inside the mounting section 31, the slider 34 is configured to cover the top of the inlet port 73 of the ink which is provided in the liquid holding body 33 with an opening and closing cover 74 which is able to freely open and close. In detail, the opening and closing cover 74 which is displaced between a position which covers the inlet port 73 and a position which opens the inlet port 73 is provided in the slider 34 in the end portion in the longitudinal direction of the slider 34. Here, in the following description, cases referring to the "insertion direction" indicate the "insertion direction" of the slider 34 with regard to the mounting section 31 unless otherwise specified.

In the present embodiment, at a position more to the second holding body section 38 (the second part) side than the inlet port 73 in a state where the inlet port 73 is covered, the opening and closing cover 74 is axially supported to freely rotate on the slider 34 such that an axis which extends along the short side direction of the liquid holding body 33 is the center of rotation. Accordingly, as shown by the two-dot chain line in FIG. 3, in a case where the inlet port 73 is opened, it is possible for the user to lift up the near side of the opening and closing cover 74 which is the front end side in the longitudinal direction of the slider 34 and rotate the front side of the opening and closing cover 74 by approximately 180 degrees to the printer 11 side which is the second holding body section 38 side.

As a result, it is possible to displace the opening and closing cover 74 so as to be positioned at the rear side with regard to the inlet port 73 by setting the opening and closing cover 74 to a state where the inlet port 73 is opened as shown by the two-dot chain line in FIG. 3 from the state where the inlet port 73 is covered as shown by the solid line in FIG. 3. Here, in the present embodiment, there is a configuration where the inlet port 73 is provided in the vicinity of the end portion of the front side in the first holding body section 37 of the liquid holding body 33 and the length of the front and back direction Y which is necessary in order for the opening and closing cover 74 to cover the inlet port 73 is not long.

In addition, a holder 76 is attached and provided in the slider 34 at an end portion 34*a* at the rear side in the direction of inserting into the mounting section 31 as an example of a holding member of a memory section which is able to be loaded with a circuit substrate 75 which is mounted with a memory where relationship information which relates to the ink which is introduced from the inlet port 73 to the liquid holding body 33 is recorded. Then, when the slider 34 is inserted inside the mounting section 31 in a state of overlapping with the upper surface 39 of the liquid holding body 33, it is possible for the circuit substrate 75 which is attached to the holder 76 to engage with a communication section 77 which is provided at the mounting section 31 side of the printer 11. Due to the engagement with the communication section 77, a contact portion, which includes a terminal which is formed on the circuit substrate 75 which is loaded on the holder 76, is electrically connected by coming into contact with an electric terminal 78 which is provided in the communication section 77. As a result, the relationship information, which is recorded in the memory which is mounted onto the circuit substrate 75, is transferred to the printer 11 side.

Here, in the printer 11 of the present embodiment, when the slider 34 is inserted inside the mounting section 31 of the printer 11 in a state of overlapping with the upper surface 39 of the liquid holding body 33, the slider 34 is positionally aligned inside the printer 11 along with the connection section 43 by a pair of plate springs 79 which are attached to the mounting section 31.

That is, as shown in FIG. 2, the plate springs 79, which have shapes which are inclined such that the gap between the plate springs 79 is narrowed in the insertion direction, are fixed by screws to the upper frame 35 and the lower frame 36 in the vertical direction. Then, the plate spring 79 of the upper frame 35 abuts against a protruding part 80, which is provided in the holder 76 which is provided in the slider 34, in a pressing state, while the plate spring 79 of the lower frame 36 abuts against the protruding part 49 (refer to FIG. 5), which is provided in the connection section 43, in a pressing state. As a result, the slider 34 (the holder 76) and the connection section 43 are positionally aligned in the up and down direction Z by the pair of plate springs 79.

In addition, the slider 34 which is inserted in a state of overlapping with the liquid holding body 33 and the second holding body section 38 of the liquid holding body 33 are both in a state of being positionally aligned in the mounting section 31. That is, as shown in FIG. 2, a guiding groove (which is not shown in the diagram) where a convex ridge section 82, which is provided to extend along the longitudinal direction at the upper surface side of the slider 34 is inserted while in sliding contact, is provided on the lower surface on the upper frame 35 of the mounting section 31. In addition, a guiding groove 84, where a concave ridge section 83 (refer to FIG. 5 and FIG. 23) which is provided to extend along the longitudinal direction at the lower surface side of the liquid holding body 33 is engaged, is provided on the upper surface on the lower frame 36 of the mounting section 31. Accordingly, the short side directions of the slider 34 and the second holding body section 38 are each positionally aligned by the engagement of the respective concave ridge sections and the guiding grooves. As a result, the slider 34 (and the holder 76 which is attached to the slider 34) and the connection section 43 which is provided in the second holding body section 38 are each positionally aligned in the short side direction. That is, the circuit substrate 75 and the holder 76 are positioned in the second part in a state where the liquid holding container 21 is mounted in the printer 11 (the mounting section 31) (it is also possible for this state to be referred to as a state where ink is being supplied from the liquid holding container 21 to the printer 11).

Here, in the liquid holding container 21 of the present embodiment, the holder 76 and the opening and closing cover 74 which are provided in the slider 34 are attached so as to be freely attached and detached with regard to the slider 34. Then, in the state where the holder 76 and the opening and closing cover 74 are attached, the slider 34 is configured to be able to slide with regard to the upper surface 39 of the liquid holding body 33. In other words, in a state where the liquid holding body 33 is fixed to the printer 11, the slider 34 is configured to be able to be removed with regard to the mounting section 31.

Furthermore, the configuration of the slider 34 will be described in detail with reference to FIGS. 6A and 6B.

Figures 6A, 6B:
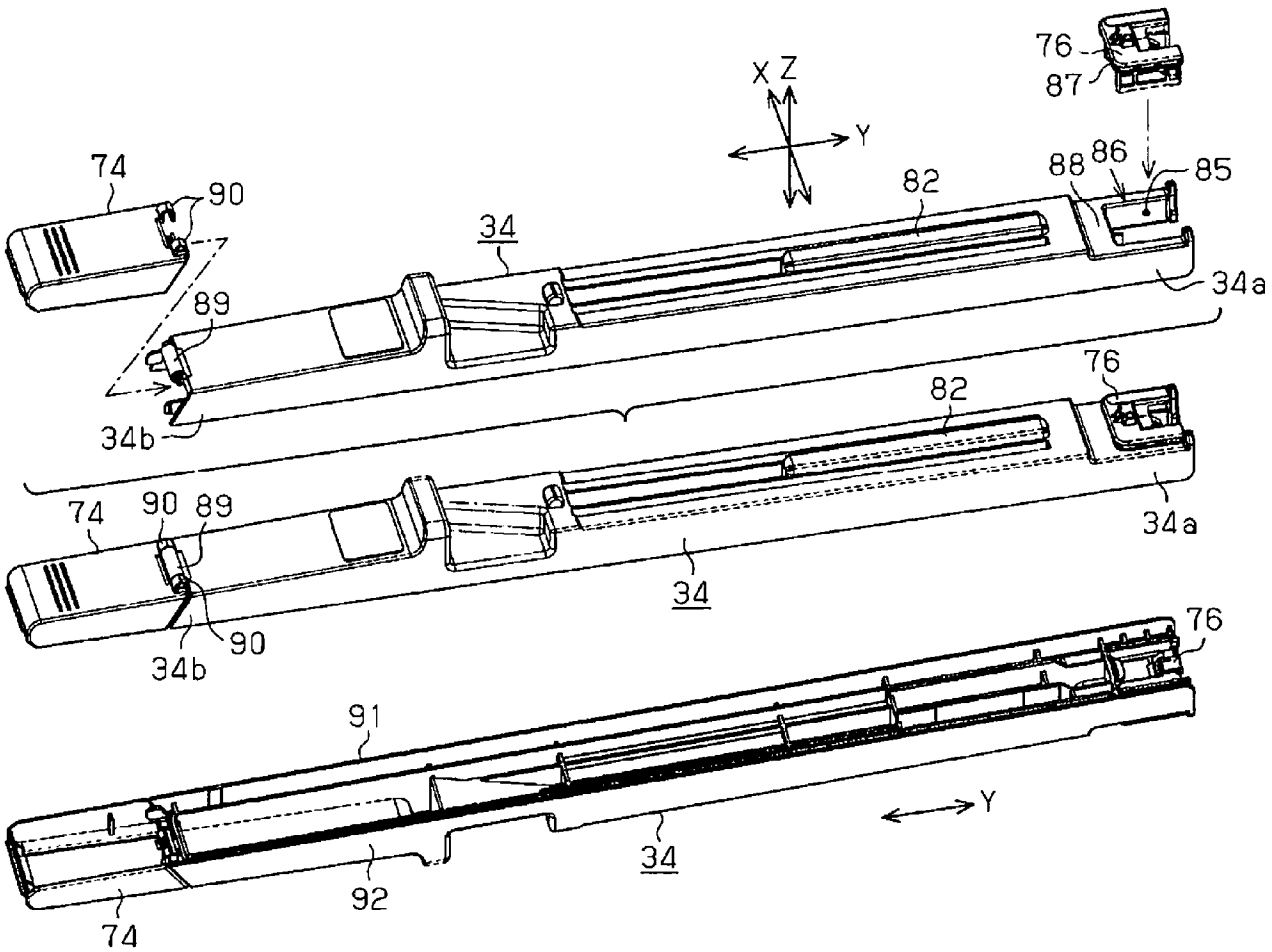
FIG. 6A is an exploded perspective diagram illustrating a configuration of the slider and FIG. 6B is a perspective diagram illustrating a rear side surface of the slider.

As shown in FIG. 6A, a holder attachment section 86, which is provided with an opening 85 with a substantial U-shape where the insertion direction rear side is cut away, is formed in the slider 34 at the end portion 34*a* at the rear side in the in the direction of inserting into the mounting section 31. Accordingly, the holder attachment section 86 is positioned in the second part in a state where the liquid holding container 21 where the slider 34 is attached is mounted in the printer 11. It is possible to insert and take out the holder 76 with regard to the opening 85 in the direction which intersects with the insertion direction, that is, the sliding direction of the slider 34. In the present embodiment, a flange shaped section 87 which is provided at the upper side in the holder 76 is inserted and attached inside the opening 85, from above which is the opposite side to the liquid holding body 33 with regard to the slider 34, so as to come into contact with an upper surface 88 with a substantial C shape which forms the opening 85 of the holder attachment section 86. In addition, the holder 76 is taken out upwards from the holder attachment section 86 and detached from the slider 34.

On the other hand, the opening and closing cover 74 is attached to the slider 34 so as to be able to rotate (to slide) by forming a rotation shaft 89 in the slider 34 in an end portion 34*b* at the near side in the direction of inserting into the mounting section 31 and fitting the rotation shaft 89 into a shaft receiving section 90 which is formed in the opening and closing cover 74.

In this manner, the slider 34 of the present embodiment where the holder 76 and the opening and closing cover 74 are attached is able to slide along the longitudinal direction (the front and back direction Y) of the liquid holding body 33 while abutting against both end portions in the width direction which is the short side direction (the left and right direction X) of the liquid holding body 33 in the upper surface 39 of the liquid holding body 33 in a state of overlapping with the liquid holding body 33.

In detail, as shown in FIG. 6B, side wall sections 91 and 92 with a straight rib shape which extend in the longitudinal direction are each formed in both side ends in the width direction which intersects with the longitudinal direction at the lower surface side of the slider 34 which overlaps with the upper surface 39 of the liquid holding body 33. On the other hand, at both side ends in the width direction which intersects with the longitudinal direction in the upper surface 39 of the liquid holding body 33, the flat surface sections 41 and 42 are formed with a linear shape which extends along the longitudinal direction as abutting surfaces which respectively abut against the side wall sections 91 and 92. Accordingly, it is possible for the side wall sections 91 and 92 which are formed in the slider 34 to move (to slide) along the longitudinal direction while respectively abutting against the flat surface sections 41 and 42 which are formed in the upper surface 39 of the liquid holding body 33.

That is, as shown in FIG. 2 and FIG. 3, a plurality of concave sections 93 which are adjacent to the inner side of the flat surface sections 41 and 42 are formed along the longitudinal direction on the upper surface 39 of the liquid holding body 33. Accordingly, the slider 34 stably moves (slides) along the longitudinal direction (the front and back direction Y) with regard to the liquid holding body 33 due to the movement in the width direction (the left and right direction X) being regulated by the plurality of concave sections 93.

Here, in the printer 11 of the present embodiment, a sliding knob 94 which is provided so as to be able to move in a sliding manner in the up and down direction is provided at the upper side of the liquid holding container 21 which is fixed in the printer 11 in a state where at least a portion of the second holding body section 38 is positioned inside the mounting section 31. By the sliding knob 94 which is provided in the printer 11 being displaced from the top to the bottom, the sliding knob 94 is engaged with a concave section 95 which is provided on the upper surface of the slider 34 and the movement (the sliding) of the slider 34 is regulated in the direction of being taken out from the mounting section 31 along the longitudinal direction. Accordingly, the engagement with the concave section 95 is released by the user moving the sliding knob 94 from the bottom to the top and the slider 34 enters a state which is able to be taken out from the mounting section 31. Then, in this state, the insertion and removal of the slider 34 with regard to the mounting section 31 is possible by the user sliding the slider 34 with regard to the liquid holding body 33. Then, in the present embodiment, a finger hooking section 96 which protrudes along the short side direction at the upper surface side of the slider 34 is formed in the slider 34, and the insertion and removal of the slider 34 by the user is easy using the finger hooking section 96.

Furthermore, in the present embodiment, the circuit substrate 75 which is loaded on the holder 76 is loaded so as to be able to be replaced. The configuration will be described with reference to FIGS. 7A and 7B. Here, the holder 76 is illustrated in FIGS. 7A and 7B in a state of being detached from the slider 34.

Figure 7A:
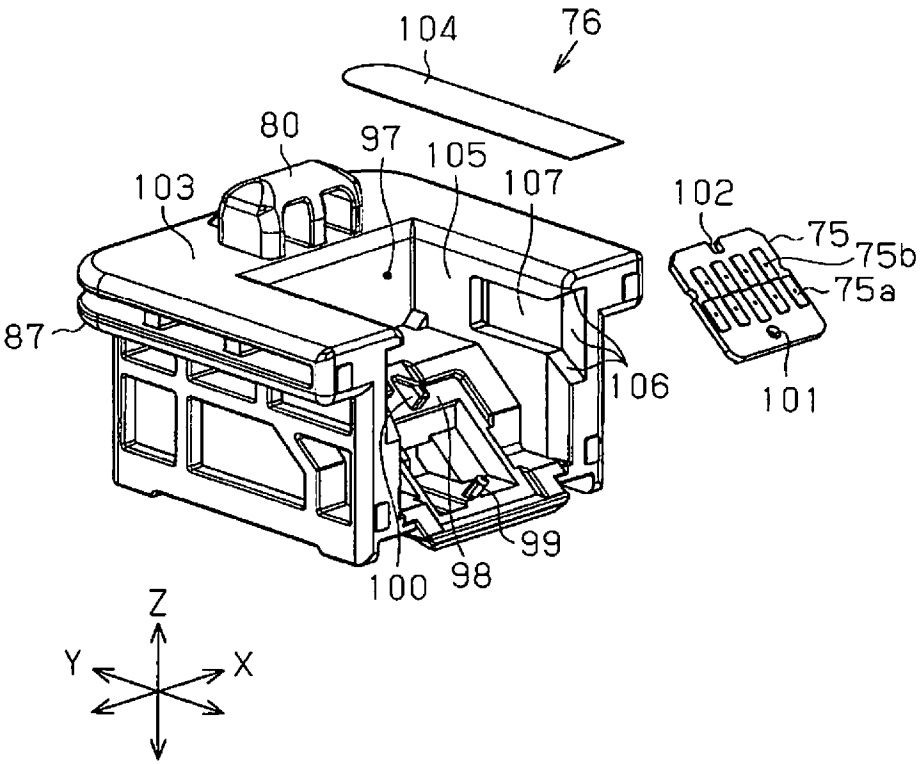
FIG. 7A is an exploded perspective diagram illustrating a configuration of a holder and FIG. 7B is a perspective diagram of a holder where a circuit substrate is loaded.

As shown in FIG. 7A, the holder 76 is configured of a plurality of walls. A concave section 97, which opens both of the far side in the insertion direction of the slider 34 and the upper side of the slider 34 with regard to the mounting section 31 in a state of being assembled with the slider 34, is provided in the holder 76 and an inclined surface 98 which is lowered in the insertion direction is provided in the concave section 97. A boss 99 with a cylindrical shape is formed at the lower end side of the inclined surface 98 while ribs 100 with a plate shape, where the insertion direction with regard to the mounting section 31 is set as the longitudinal direction, are formed at the upper end side of the inclined surface 98. Any or all of the inclined surface 98, the boss 99 with a cylindrical shape, and the ribs 100 are referred to as support sections.

On the other hand, in the present embodiment, the circuit substrate 75 which is loaded on the holder 76 has a substantial rectangular shape and a plurality (here, nine) of terminals (which include contact sections 75*b*) 75*a* are provided in the substrate which is the surface with the direction of inserting into the substrate as the longitudinal direction. Then, a circular hole 101 are formed in the circuit substrate 75 at one end portion out of the front or the rear in the insertion direction of the plurality of terminals (which include the contact sections 75*b*) 75*a* and slits 102 are formed at the other end portion out of the front or the rear. Then, the boss 99 which is provided in the holder 76 is inserted into the circular hole 101 which are formed in the circuit substrate 75, and along with this insertion, the ribs 100 which are provided in the holder 76 are inserted with regard to the slits 102 which are provided in the circuit substrate 75. Due to this, the circuit substrate 75 is loaded on the inclined surface 98 of the holder 76 in a state of being inclined with regard to the horizontal direction. In addition, the circuit substrate 75 is supported by the holder 76 such that the walls protrude further in the direction of gravity than the circuit substrate 75 or the terminals (which include the contact sections 75*b*) 75*a* even in a case where the holder 76 is placed on a flat surface in any posture (an arbitrary posture). An identification seal 104 (an identification label), which identifies the circuit substrate 75 which is loaded, is adhered to at least a portion of an upper surface 103 of the holder 76 of the present embodiment. The identification seal 104 is the same color as the liquid which is accommodated in the liquid holding container 21 which corresponds to the holder 76 or the same color as the liquid which is accommodated in a liquid introduction source 126 which will be described later.

Figure 7B:
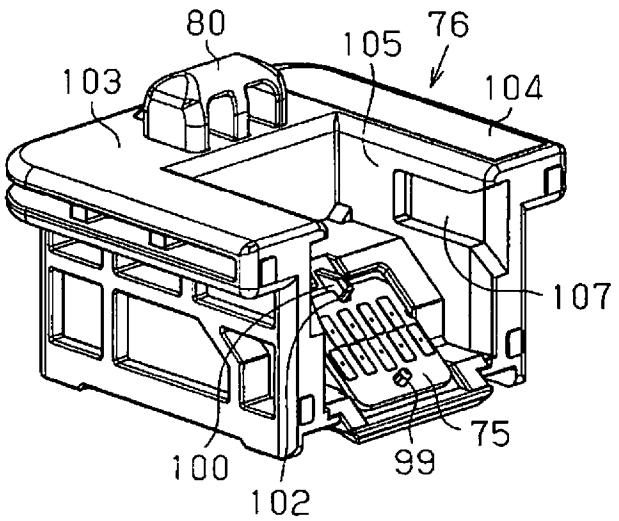

As shown in FIG. 7B, in a state where the circuit substrate 75 is loaded in the holder 76, the circuit substrate 75 is set to a state where the rotation centering on the boss 99 in the inclined surface 98 is regulated due to the ribs 100. In addition, small gaps are respectively provided between the circular hole 101 and the boss 99 and between the slits 102 and the ribs 100, and it is possible to detach the circuit substrate 75 which is loaded from the holder 76.

Here, FIGS. 7A and 7B illustrate only one side of the holder 76, but in the concave section 97, a groove shaped section 107, which extends in the insertion direction and is formed with a chamfered section 106 in the insertion direction side end, is provided in side wall sections 105 which are respectively formed on both sides in the left and right direction X which intersects with the insertion direction with regard to the mounting section 31. In addition, the protruding part 80 which abuts against the plate spring 79 which is provided in the upper frame 35 is formed on the upper surface 103 of the holder 76.

Next, the configuration of the opening and closing cover 74 will be described with reference to FIGS. 8A, 8B, and 8C. In the present embodiment, the opening and closing cover 74 is attached so as to be able to be attached and detached with regard to the slider 34 and rotation is suppressed by applying a load with regard to rotation centering on the rotation shaft 89 in the closed lid position of the inlet port 73.

Figure 8A:
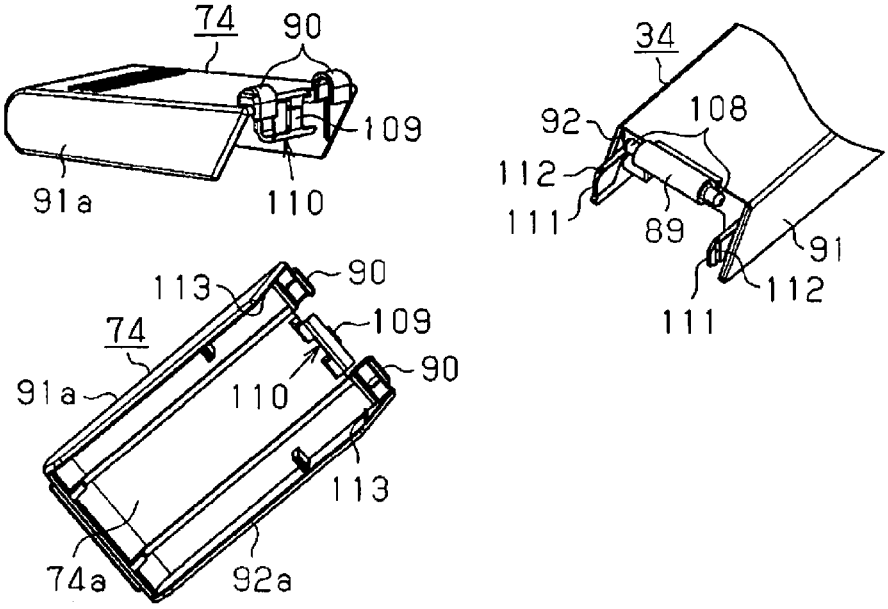
FIG. 8A is a perspective diagram illustrating a configuration of an opening and closing cover.

As shown in FIG. 8A, two of the shaft receiving sections 90 with substantially semi-cylindrical shapes, which engage with regard to shaft end sections 108 of both sides of the rotation shaft 89 which is provided in the slider 34, and an abutting section 109, which abuts with regard to the substantially center portion in the axis direction of the rotation shaft 89 from the opposite direction to the shaft receiving section 90, are formed in the opening and closing cover 74. The abutting section 109 is provided at a front end of a hook shape of a hook part 110 which substantially has a J-shape in a short side direction view where two plate shaped parts with flexibility, which are formed to protrude from the inner surface (a rear surface 74*a*) side which opposes the inlet port 73, are provided in the opening and closing cover 74. Then, when two of the shaft receiving sections 90 are engaged with the shaft end sections 108 of the rotation shaft 89, after the abutting section 109 is temporarily displaced by the rotation shaft 89 along with the bending displacement of the hook part 110, the rotation shaft 89 is engaged in a substantially abutting state by returning of the bending displacement in a state where the shaft receiving sections 90 are engaged with the shaft end sections 108 of the rotation shaft 89. Due to this, the opening and closing cover 74 is configured to be axially supported so as to be able to rotate with regard to the rotation shaft 89.

In addition, extended parts 111 which extend in the longitudinal direction are each provided in the slider 34 in the side wall sections 91 and 92 on both sides of the slider 34 in the short side direction. Groove sections 112 are formed along the up and down direction in the extended parts 111. On the other hand, in the cover side wall sections 91*a* and 92*b*, which configure a portion of the side wall sections 91 and 92 of the slider 34, in the opening and closing cover 74, concave ridge sections 113 which are able to lock together with the groove sections 112 are formed at a position which corresponds to the groove sections 112 in a state where the opening and closing cover 74 which is attached to the liquid holding body 33 covers the inlet port 73.

Figure 8B:
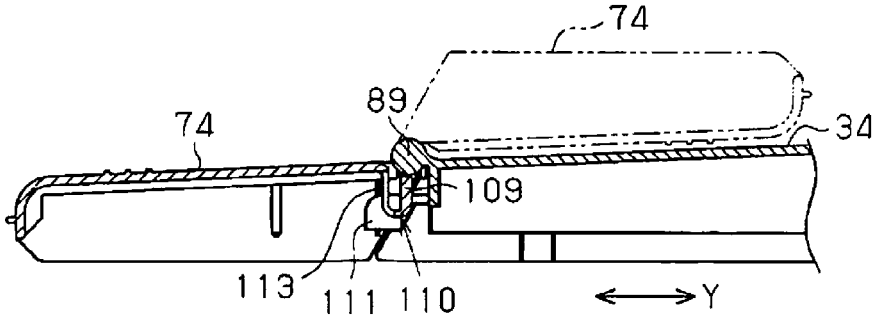
FIG. 8B is a cross sectional diagram illustrating a state where the opening and closing cover is attached to the slider.
Figure 8C:
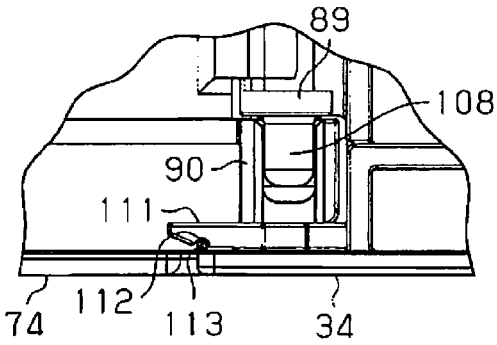
FIG. 8C is an enlarged partial diagram illustrating a configuration of an engaging section.

That is, as shown in FIGS. 8B and 8C, the opening and closing cover 74 is incorporated into the slider 34 by setting the shaft receiving section 90 and the abutting section 109 to an engaging state with regard to the rotation shaft 89 of the slider 34. When the opening and closing cover 74 which is incorporated is in the closed lid position where the inlet port 73 is covered, the concave ridge sections 113 which are formed in the cover side wall sections 91*a* and 92*a* overlap with groove sections 112 in a lateral direction view and are set to an engaging state of being placed into the groove sections 112. Accordingly, as shown by the two-dot chain line in FIG. 8B, when the opening and closing cover 74 is displaced to the open lid position of the inlet port 73 by being rotated centering on the rotation shaft 89, a rotation load is generated with regard to the opening and closing cover 74. In this regard, the groove sections 112 of the slider 34 function as an example of an engagement section which suppresses the displacement from the closed lid position to the open lid position by engaging with the opening and closing cover 74.

Next, the peripheral configuration of the inlet port 73 in the liquid holding container 21 will be described.

Figure 9A:
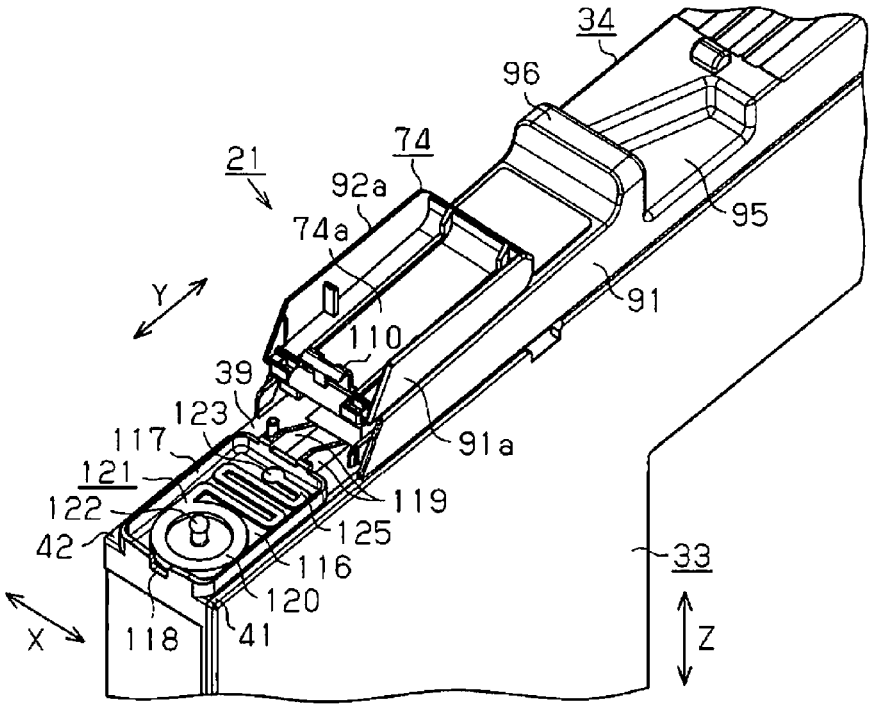
FIGS. 9A and 9B are diagrams illustrating the liquid holding container in a state where the opening and closing cover is positioned at an open lid position, where

As shown in FIG. 9A, a liquid receiving surface 116 is formed in the front side portion in the upper surface 39 of the liquid holding body 33 as an example of a liquid receiving section which extends along a direction which intersects with the up and down direction Z. The liquid receiving surface 116 is formed in a substantially rectangular shape in a planar view, and the width dimension of the liquid receiving surface 116 in the left and right direction X is slightly smaller with regard to the width dimension of the liquid holding body 33 in the left and right direction X.

In addition, a circumference wall section 117 is provided in the upper surface 39 of the liquid holding body 33 to protrude in the upward direction (the direction against gravity) which intersects with the liquid receiving surface 116 so as to encompass the surroundings of the liquid receiving surface 116. Then, a cut away groove 118 which is recessed to be below the other portions of the circumference wall section 117 is formed in the substantial center in the left and right direction X of in a wall section at the front side of the circumference wall section 117. That is, in the present embodiment, the cut away groove 118 which is an example of a concave section is formed in the circumference wall section 117 which is an example of the peripheral position of the inlet port 73. On the other hand, a pair of reinforcing ribs 119 which extend rearward while intersecting with the wall portion are formed in a wall section at the rear side of the circumference wall section 117.

In addition, a covering member 121 which is provided with a covering body 120 with a substantially cylindrical shape where it is possible to cover and open the inlet port 73 (refer to FIG. 9B) is loaded on the liquid receiving surface 116. A knob section 122, which is formed in a substantially columnar shape which protrudes in the upward direction from the upper side surface of the covering body 120, is formed in the covering body 120. The knob section 122 is a part which is grasped when the user detaches the covering body 120 from the inlet port 73 or alternatively covers the inlet port 73 with the covering body 120.

In addition, in the state shown in FIG. 9A, the covering member 121 is provided with a fixing section 123 for fixing the covering member 121 to the liquid receiving surface 116 at the rear side which is the opposite side to the front side where the covering body 120 is provided. The fixing section 123 is fixed to a fixing hole 124 (refer to FIG. 10) which is formed as an opening in the liquid receiving surface 116 such that it is possible for the fixing section 123 to rotate with the axis of the fixing hole 124 as the center of rotation and such that it is not possible for the fixing section 123 to come away from the liquid receiving surface 116. Accordingly, the covering member 121 is able to rotate with regard to the liquid receiving surface 116 with the fixing section 123 as the center of rotation while the covering member 121 is not easily detached from the liquid receiving surface 116. However, it is possible to replace the covering member 121 with a new covering member 121 by including the fixing section 123.

In addition, in a state of being loaded on the liquid receiving surface 116, the covering member 121 is provided with a joining section 125 which joins the covering body 120 and the fixing section 123 while being bent a plurality of times in a direction which intersects with the up and down direction Z (three times in the left and right direction X in the present embodiment). A cross sectional shape in the extending direction of the joining section 125 has a rectangular shape, and the length in the direction along the liquid receiving surface 116 is longer than the length in the direction (the up and down direction Z) which intersects with the liquid receiving surface 116 in the rectangular cross sectional shape of the joining section 125. As a result, when the joining section 125 is loaded on the liquid receiving surface 116, the contact area with liquid receiving surface 116 is increased and the joining section 125 is stably loaded onto the liquid receiving surface 116.

In addition, the covering body 120 which configures the covering member 121, the joining section 125, and the fixing section 123 are formed using elastomers or the like such as rubber or resin and are able to elastically change shape. Accordingly, in the state shown in FIG. 9A, by fitting the covering body 120 into the inlet port 73 in a state where the shape is elastically changed, the inlet port 73 is covered such that a gap is not generated between the covering body 120 and the inlet port 73.

As shown in FIG. 9A, it is possible to load the covering body 120 which is detached from the inlet port 73 on the rear surface 74*a* (an example of a bottom surface) of the opening and closing cover 74 which is at the open lid position. In addition, since the area of the rear surface 74*a* of the opening and closing cover 74 is larger than a projecting area in a case where the covering body 120 is projected in a direction along the up and down direction Z, it is possible to more stably load the covering body 120.

Furthermore, in a state (the state shown in FIG. 9A) where the opening and closing cover 74 is positioned in the open lid position, the rear surface 74*a* of the opening and closing cover 74 is a surface with a gradient which falls toward the front side where there is the inlet port 73. In addition, at both side ends of the rear surface 74*a* of the opening and closing cover 74 which is positioned at the open lid position, the cover side wall sections 91*a* and 92*a* are in a state of facing in an upward direction. Accordingly, when the covering body 120 is loaded so that the ink is attached to the rear surface 74*a* of the opening and closing cover 74 which is positioned at the open lid position, the cover side wall sections 91*a* and 92*a* also function as an example of a shielding section which suppresses the ink from leaking out from the opening and closing cover 74 to the outside.

Figure 9B:
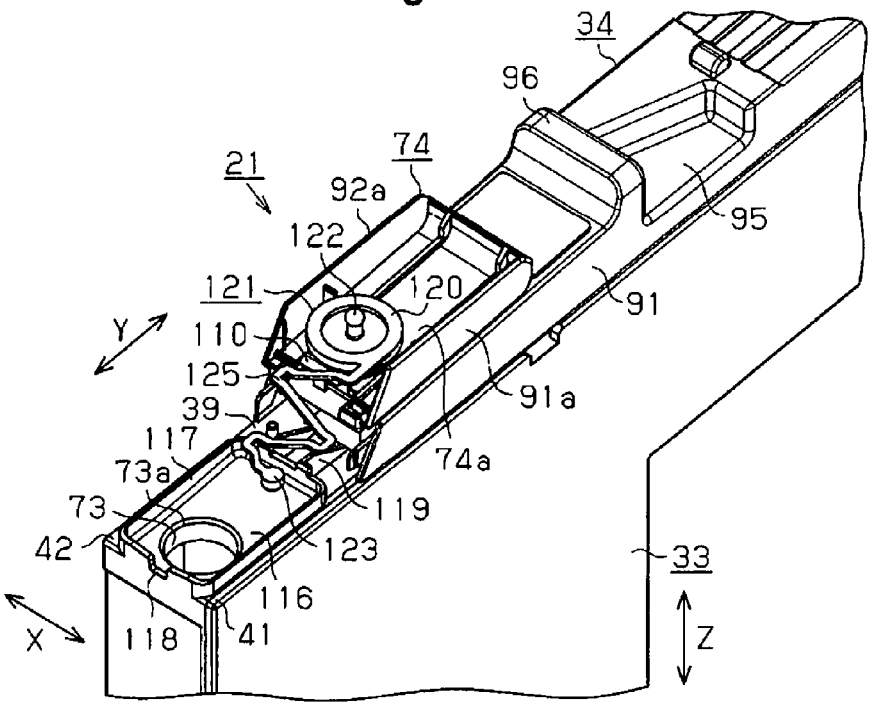

FIG. 9B shows the liquid holding container 21 in a state where the covering body 120 is detached from the inlet port 73 and the covering body 120 is loaded on the rear surface 74*a* of the opening and closing cover 74. As shown in FIG. 9B, by exposing the inlet port 73 which is formed as an opening in a portion of the liquid receiving surface 116, it is possible for the user to introduce ink into the inner section (a first ink chamber 151 (refer to FIG. 14)) of the liquid holding body 33 via the inlet port 73. In addition, an opening edge 73*a* which is the upper end edge of the inlet port 73 is formed with an inclined shape by chamfering and the ink easily flows into the inlet port 73 when introducing the ink.

In addition, as shown in FIG. 9B, the length of the joining section 125 of the covering member 121 is set to be no more than the length where it is possible to load the covering body 120 on the rear surface 74*a* of the opening and closing cover 74 in a state of being positioned in the open lid position. Here, in the state shown in FIG. 9B, the joining section 125 is in a slightly stretched state while the covering body 120 is in a state of being loaded on the rear surface 74*a* of the opening and closing cover 74 and a state of abutting against the hook part 110 of the opening and closing cover 74.

Figure 10:
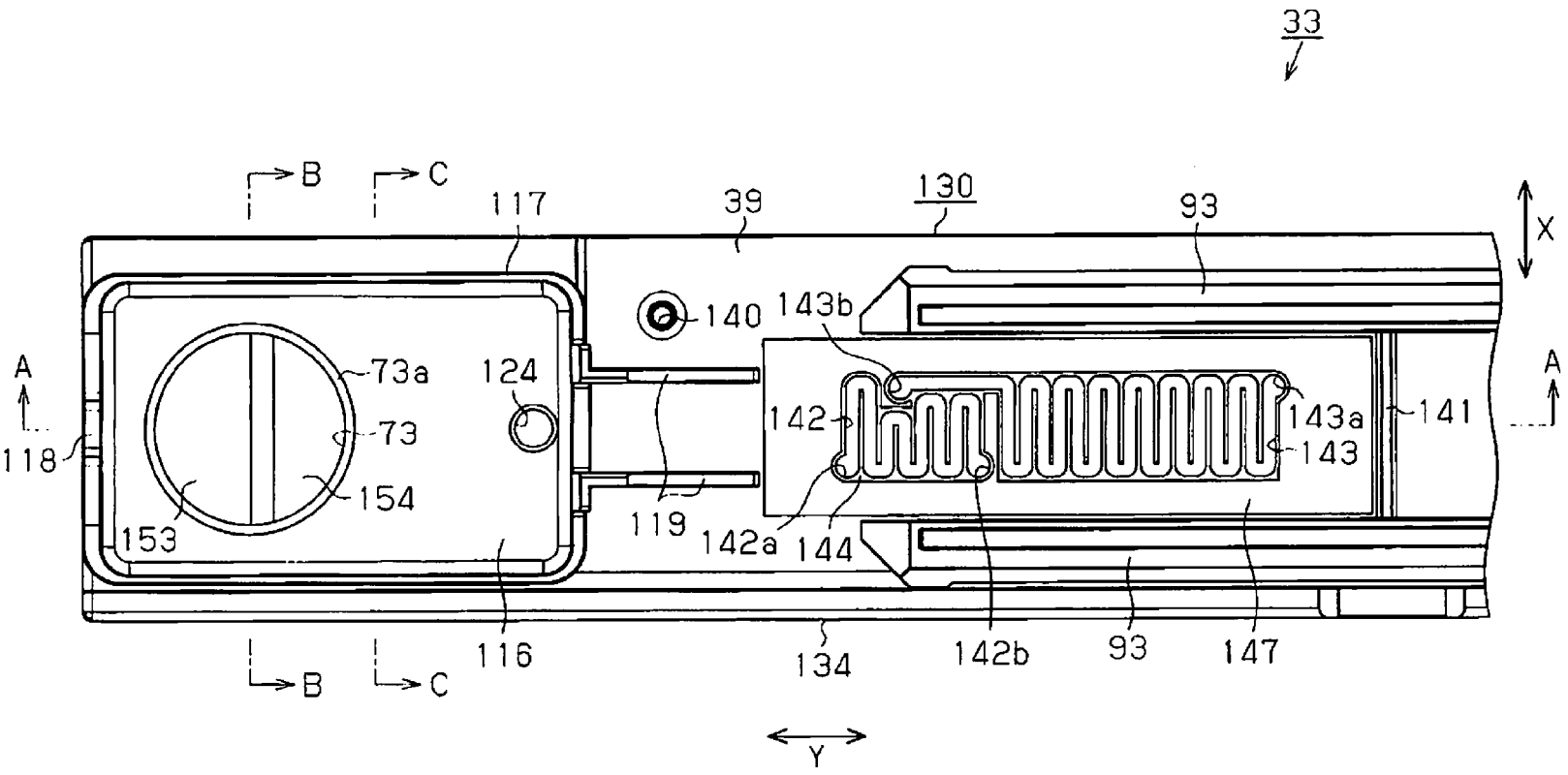
FIG. 10 is a planar diagram of a liquid holding body.

As shown in FIG. 10, in the vicinity of the wall section of the rear side (the right side in FIG. 10) of the circumference wall section 117 in the liquid receiving surface 116, the fixing hole 124 where the fixing section 123 of the covering member 121 is inserted and fixed is formed as an opening in a direction which intersects with the liquid receiving surface 116. The fixing hole 124 is provided such that the center position of the fixing hole 124 in the left and right direction X substantially coincides with the center position of the inlet port 73 in the left and right direction X. Here, the fixing hole 124 is formed as an opening on the liquid receiving surface 116 in the same manner as the inlet port 73, but is not linked with the first ink chamber 151.

Figure 11:
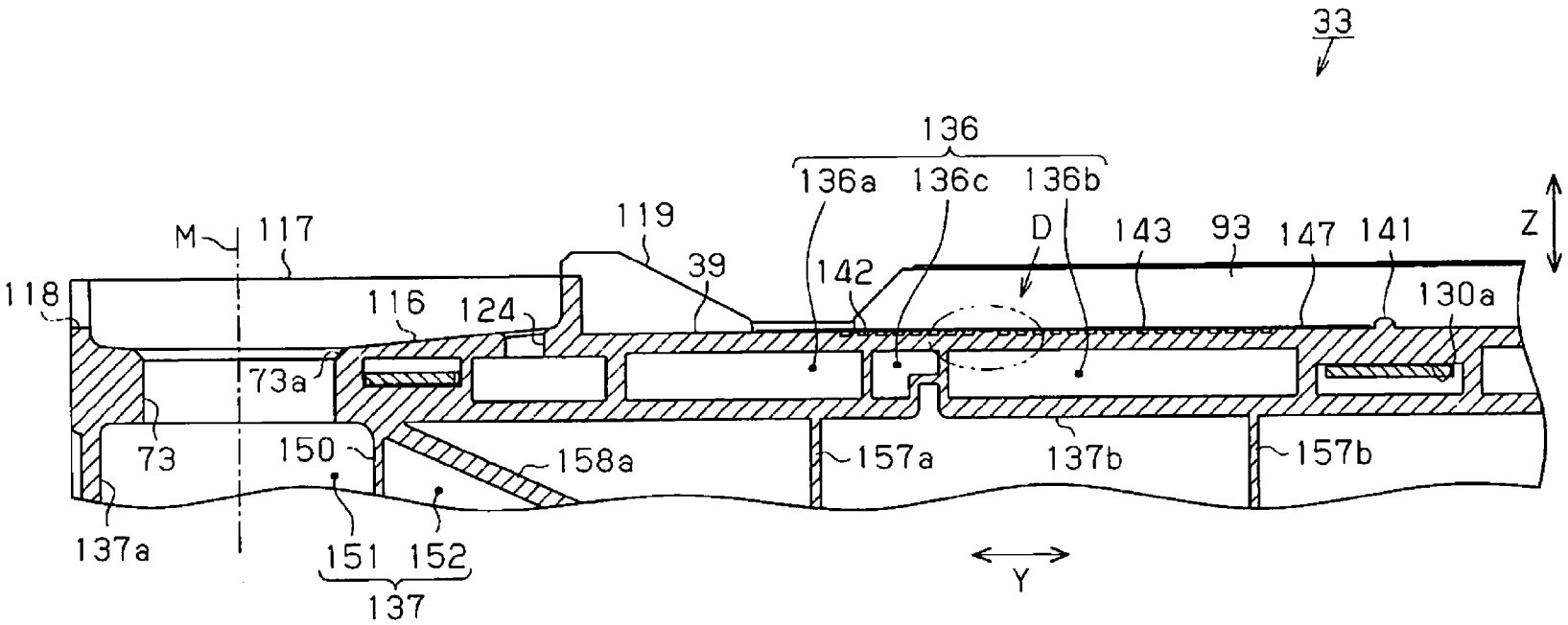
FIG. 11 is a diagram illustrating a cross sectional structure of the liquid holding body and is a diagram of a cross section along line A-A in FIG. 10.

As shown in FIG. 11, the liquid receiving surface 116 is formed so as to be inclined downward (in the direction of gravity) toward the inlet port 73 in the front and back direction Y. Accordingly, the vicinity of the fixing hole 124 at a position which is separated from the inlet port 73 is at the highest position on the liquid receiving surface 116. In other words, since the fixing section 123 of the covering member 121 which is fixed to the fixing hole 124 is positioned at a position which is higher than the surroundings of the inlet port 73 in the liquid receiving surface 116, ink does not easily become attached even when the ink flows onto the liquid receiving surface 116 when the ink is introduced into the inlet port 73 and the like.

Figure 12A:
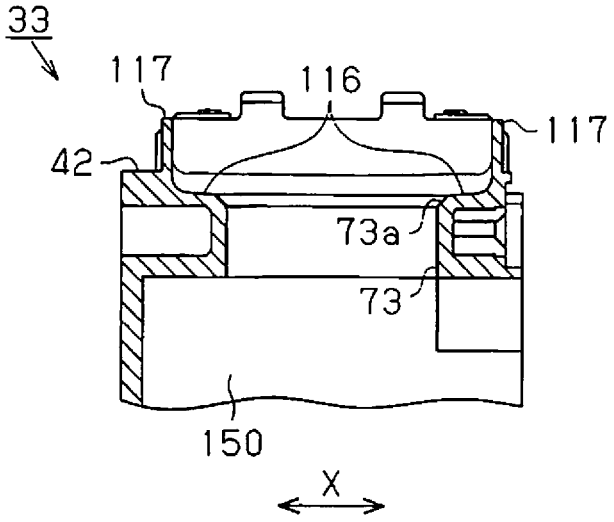
FIGS. 12A and 12B are diagrams illustrating a cross sectional structure of the liquid holding body, where
Figure 12B:
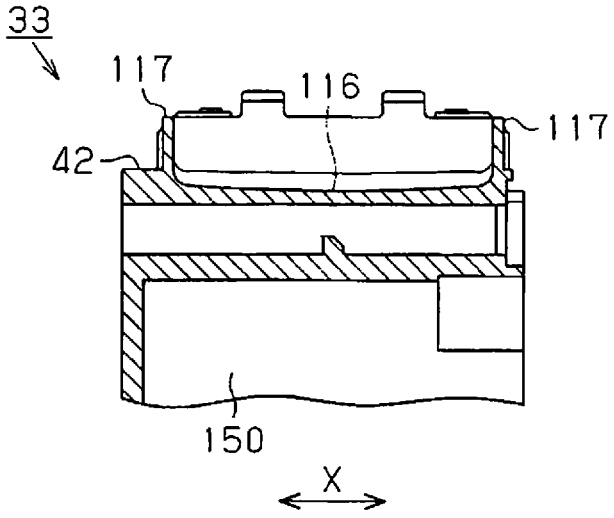

In addition, as shown in FIG. 12A, the liquid receiving surface 116 is formed so as to be inclined downward toward the inlet port 73 in the left and right direction X in addition. Furthermore, as shown in FIG. 12B, the liquid receiving surface 116 is formed so as to be inclined downward toward the center in the left and right direction X at a position close to the fixing hole 124 which is separated from the inlet port 73.

Next, the configuration of the inner section of the liquid holding body 33 will be described.

Figure 13:
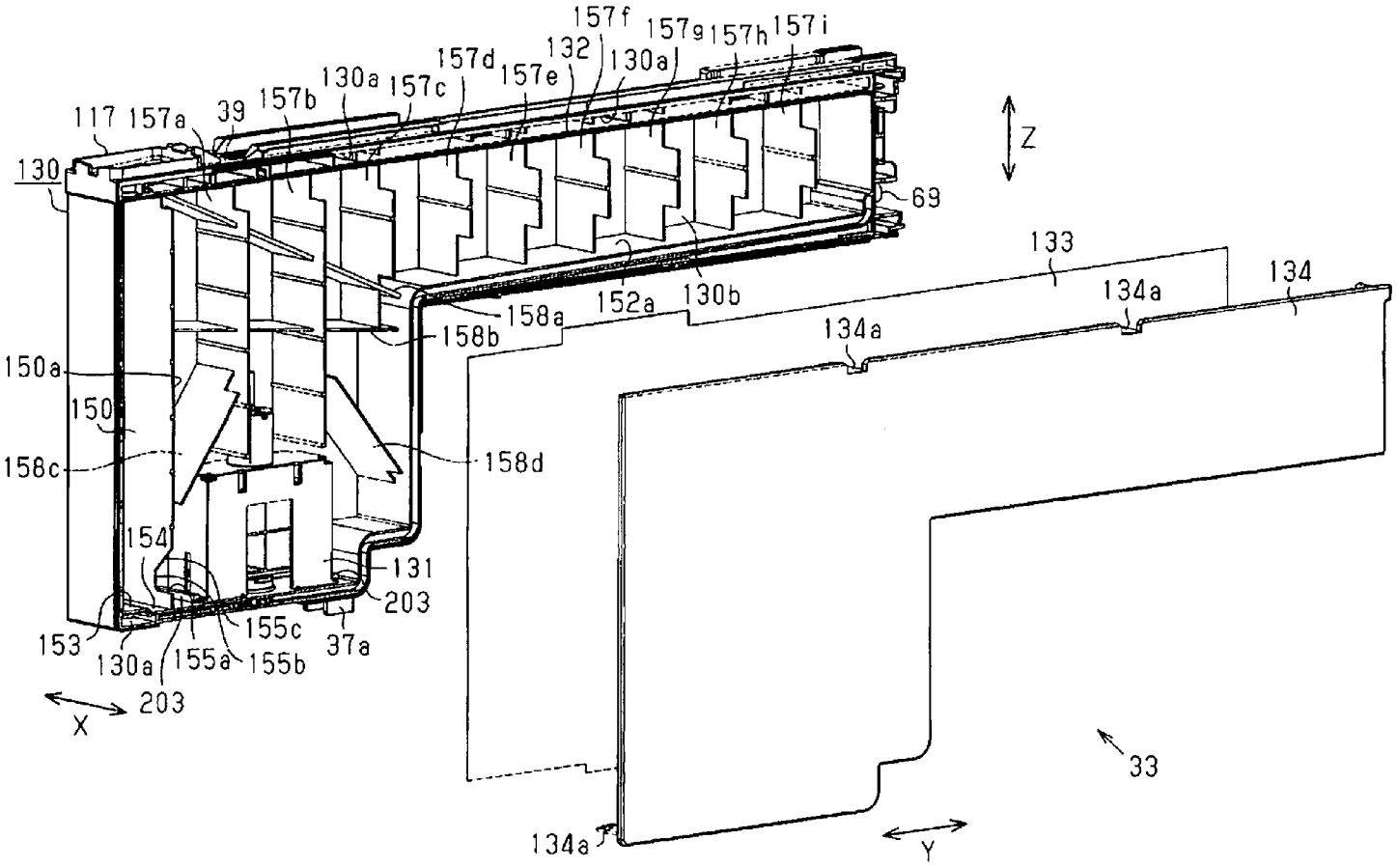
FIG. 13 is an exploded perspective diagram of the liquid holding body.

As shown in FIG. 13, the liquid holding body 33 is provided with the holding body case 130 which is formed in a substantial L-shape in a side surface view when viewed from the left and right direction X, a float valve 131 which is one type of valve mechanism which is accommodated inside the holding body case 130, a film 133 which is adhered (for example, heat welded) to a case opening section 132 in the holding body case 130, and a cover 134 made of resin which covers the case opening section 132 over the film 133. Here, the holding body case 130 is integrally formed so that the right side surface is open and is formed at the outer side of the case opening section 132 where an engaging section 130*a*, which engages a claw section 134*a* which is formed on the cover 134 made of resin, is formed with an annular shape.

Figure 14:
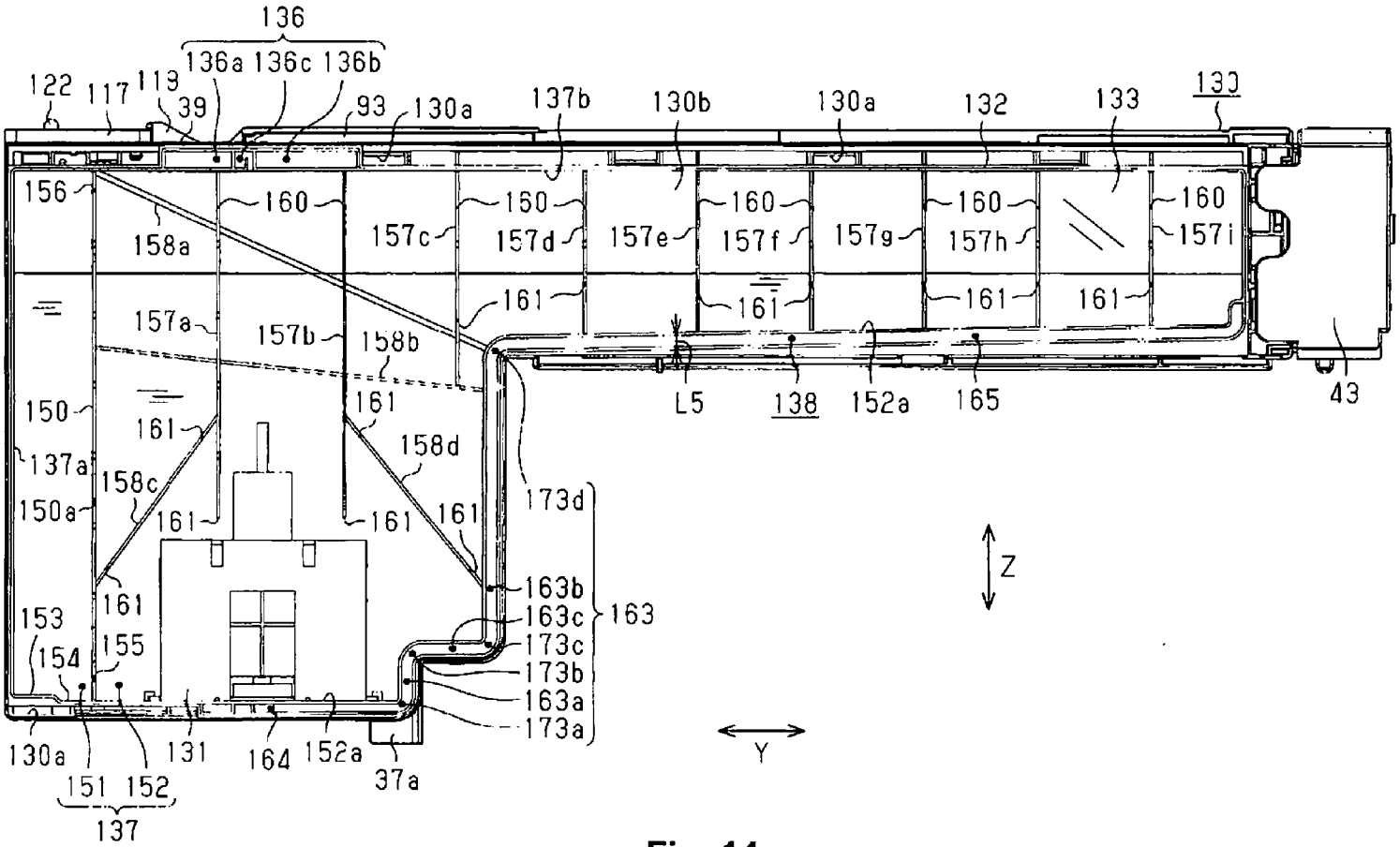
FIG. 14 is a side surface diagram of an holding body case where a film is adhered.

As shown in FIG. 14, when the film 133 is adhered to the case opening section 132 of the holding body case 130, a spatial region which is enclosed by the holding body case 130 and the film 133 functions as an air chamber 136 which is linked to the atmosphere, an ink chamber 137 as an example of a liquid holding chamber which accommodates ink, and a directing flow path 138 as an example of a liquid flow path. Here, one end of the directing flow path 138 is linked to the ink chamber 137 and, the directing port 69 (refer to FIG. 4 and FIG. 5) which directs the ink which is accommodated in the ink chamber 137 to the liquid ejecting head 24 (the printer 11 side) is formed in the other end side of the directing flow path 138.

Next, the air chamber 136 and the configuration where air is taken in to the air chamber 136 will be described.

As shown in FIG. 10, an atmosphere linking hole (atmosphere linking port) 140 which links to the atmosphere and a position aligning ridge 141 which extends along the left and right direction X are formed on the upper surface 39 where the inlet port 73 of the holding body case 130 is formed. Furthermore, at least one (two in the present embodiment) of meandering grooves 142 and 143 which are formed to meander and a meandering convex section 144 which encloses the surroundings of the meandering grooves 142 and 143 are formed between the reinforcing ribs 119 described above and the position aligning ridge 141.

Figure 15:
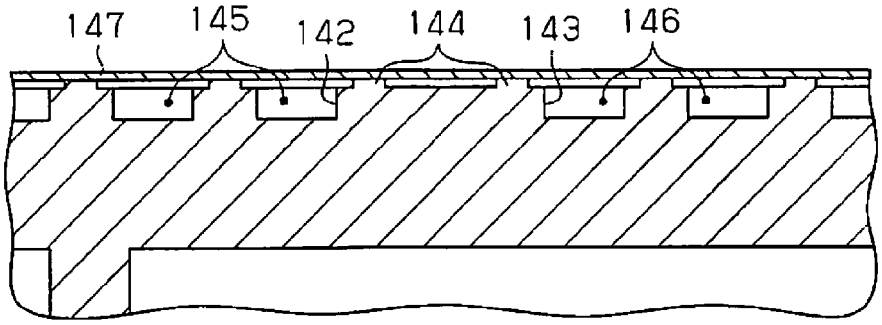
FIG. 15 is an enlarged diagram of D portion in FIG. 11.

Then, as shown in FIG. 10 and FIG. 15, an air flow path forming film 147 which forms air flow paths 145 and 146 by covering the meandering grooves 142 and 143 is adhered (for example, heat welded) to the upper surface 39 of the holding body case 130. That is, when the meandering convex section 144 is adhered in a state where the air flow path forming film 147 is positionally aligned by the reinforcing ribs 119 and the position aligning ridge 141, a first air flow path 145 is formed by the first meandering groove 142 and the air flow path forming film 147. Furthermore, a second air flow path 146 is formed by the second meandering groove 143 and the air flow path forming film 147.

As shown in FIG. 10 and FIG. 11, the atmosphere linking hole 140 is formed in the first part between the inlet port 73 and the second part and links with a first air chamber 136*a*. In addition, one end 142*a* of the first meandering groove 142 links with the first air chamber 136*a* while the other end 142*b* links with a second air chamber 136*b*. Furthermore, one end 143*a* of the second meandering groove 143 links with the second air chamber 136*b* while the other end 143*b* links with a third air chamber 136*c*.

Figure 16:
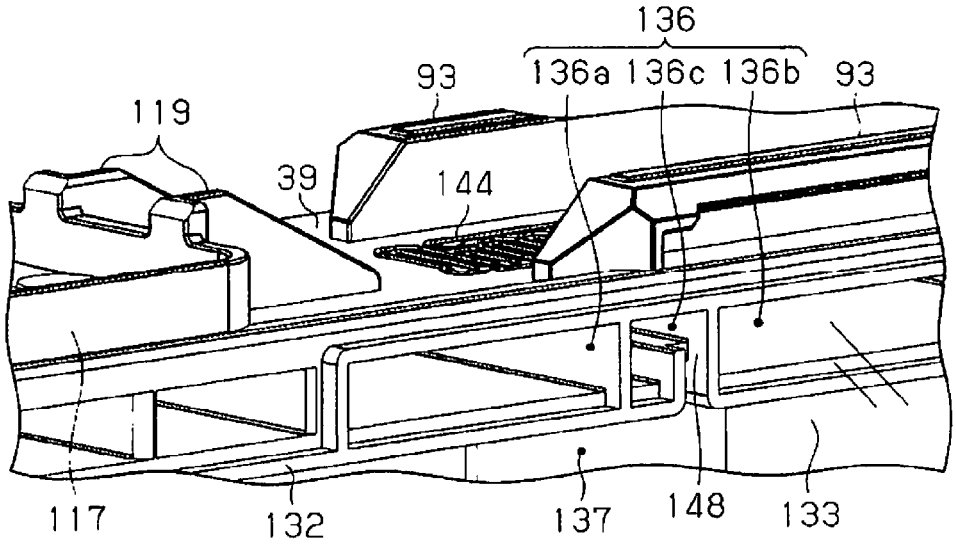
FIG. 16 is an enlarged diagram of the holding body case where the film is adhered.

As shown in FIG. 16, an air intake port 148 is formed in the third air chamber 136*c* and the third air chamber 136*c* and the ink chamber 137 are linked via the air intake port 148. As a result, for example, when the pressure in the ink chamber 137 decreases by introducing the ink which is accommodated in the ink chamber 137, outside air which is taken in from the atmosphere linking hole 140 is taken in to the ink chamber 137 via the first air chamber 136*a*, the first air flow path 145, the second air chamber 136*b*, the second air flow path 146, and the third air chamber 136*c*.

Next, the ink chamber 137 will be described.

As shown in FIG. 14, in the shape of the ink chamber 137, the height dimension in the up and down direction Z at the front side is larger than the height dimension in the up and down direction Z at the rear side in the same manner as the shape of the liquid holding body 33. Furthermore, the ink chamber 137 is partitioned into the first ink chamber 151 which is an example of a first liquid holding chamber and a second ink chamber 152 which is an example of a second liquid holding chamber by a partition wall 150 which intersects with a ceiling surface 137*b* which is an example of an inlet port forming surface where the inlet port 73 is formed in the ink chamber 137.

Here, the partition wall 150 is provided so as to extend along the up and down direction Z and intersects with an opposing surface (the bottom surface) 153 which opposes the ceiling surface 137*b*. In addition, the width of the partition wall 150 in the left and right direction X is substantially equal to the width from a side wall 130*b* on the left side of the holding body case 130 to the case opening section 132. In addition, the partition wall 150 is perpendicular to the side wall 130*b* of the holding body case 130 at a position in the ink chamber 137 close to the front side where the height in the up and down direction Z is larger and the partition wall 150 is integrally molded with the holding body case 130 so as to protrude from the side wall 130*b* toward the case opening section 132 side (the near side in FIG. 14). As a result, the height at the first ink chamber 151 side of the second ink chamber 152 in the up and down direction Z is substantially equal to the height of the first ink chamber 151 in the up and down direction Z, and furthermore, is larger than the height at the rear side, which is separated from the first ink chamber 151, in the up and down direction Z. Then, the volume of the first ink chamber 151 is smaller than the volume of the second ink chamber 152.

In detail, as shown in FIG. 11, the partition wall 150 is formed to be substantially line symmetric with a front wall surface 137*a* in the first ink chamber 151 centering on an introduction virtual line M which extends along the up and down direction Z passing through the center of the opening of the inlet port 73. That is, the inlet port 73 is formed in the ceiling surface 137*b* of the first ink chamber 151 more to the front side than the partition wall 150.

Figure 17:
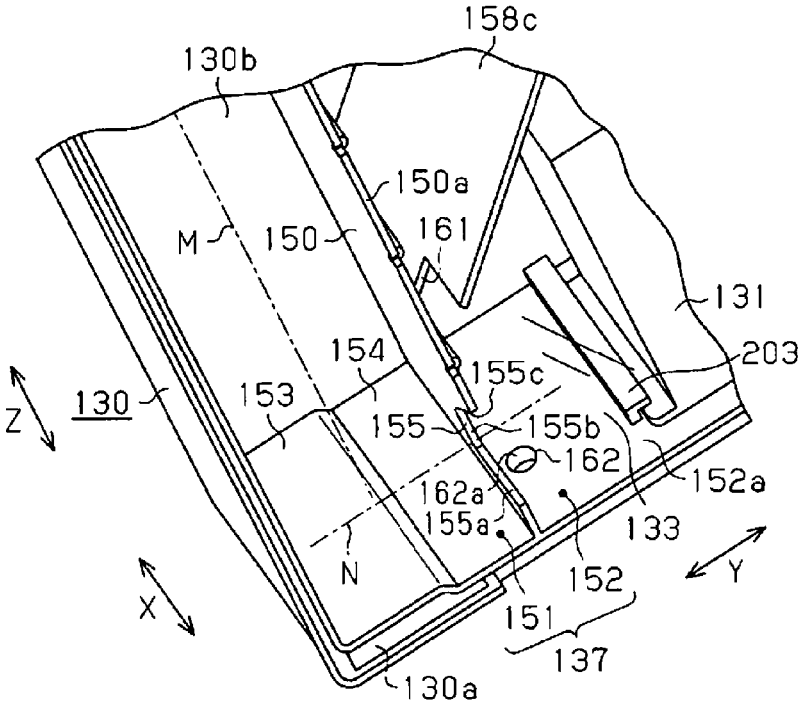
FIG. 17 is an enlarged diagram of the holding body case where the film is adhered.

In addition, as shown in FIG. 17, at a position, which is close to the partition wall 150, on an opposing surface 153 in the first ink chamber 151, a concave section 154 which is recessed in the direction of gravity so as to be separated from the inlet port 73 is provided to be shifted from the inlet port 73 to a position in the direction which intersects with the direction of gravity. That is, the concave section 154 is provided across the left and right direction X at a position which is shifted from the introduction virtual line M in the front and back direction Y.

As shown in FIG. 14 and FIG. 17, when the film 133 is adhered to the partition wall 150, a portion which is formed with a recess from an adhered surface 150*a* to the side wall 130*b* side functions as a wall linking opening (wall linking opening section) 155 which is an example of a linking opening and functions as a wall ventilation opening (a wall ventilation opening section) 156 which is an example of a ventilation opening. That is, the first ink chamber 151 and the second ink chamber 152 are linked via the wall linking opening 155 and the wall ventilation opening 156. Here, the wall ventilation opening 156 is formed at the upper end of the partition wall 150 so as to come into contact with the ceiling surface 137*b* and is positioned more to the upper side than the wall linking opening 155.

On the other hand, the wall linking opening 155 is positioned more to the opposing surface 153 side at the lower side than the wall ventilation opening 156 and is formed at a position which is separated upwards from the concave section 154. Furthermore, a lower surface 155*a*, which is positioned at the lower side inside the wall linking opening 155 is formed in the wall linking opening 155 substantially horizontally to be substantially perpendicular with regard to a far surface 155*b* of the left side, and an upper surface 155*c* which is positioned at the upper side (the side in the direction against gravity) is not perpendicular with regard to the far surface 155*b*. That is, the upper surface 155*c* is inclined in a direction which intersects with the horizontal direction, and the separation from the lower surface 155*a* increases as the separation from the far surface 155*b* increases. In addition, in the wall linking opening 155, a linking port axis N which (extends in the front and back direction Y in the present embodiment and) is perpendicular with an opening cross section passing through the center of the opening of the wall linking opening 155 has a relationship with the introduction virtual line M so as not to be parallel and not intersect with each other. That is, the wall linking opening 155 is formed at a position which is twisted with regard to the inlet port 73.

Furthermore, the area of the wall linking opening 155 is equivalent to the area of a portion which is formed with a recess in the partition wall 150, smaller than the area of the partition wall 150, and smaller than the area of the inlet port 73. Furthermore, the area of the wall ventilation opening 156 is smaller than the area of the wall linking opening 155.

In addition, as shown in FIG. 14, at least one (nine in the present embodiment) of intersecting rib sections 157*a* to 157*i* which intersect with the ceiling surface 137*b* and extend along the up and down direction Z are formed in the second ink chamber 152 to have gaps in the front and back direction Y. Furthermore, at least one (four in the present embodiment) of lateral inclined rib sections 158*a* to 158*d* which intersect with the up and down direction Z and the front and back direction (the horizontal direction) Y is formed in the second ink chamber 152 as an example of a dome section. Here, the intersecting rib sections 157*a* to 157*i* and the lateral inclined rib sections 158*a* to 158*d* are perpendicular to the side wall 130*b* of the holding body case 130 and are integrally molded with the holding body case 130 so as to protrude from the side wall 130*b* toward the case opening section 132 side (the near side in FIG. 14).

The width of the intersecting rib sections 157*a* to 157*i* in the left and right direction X is substantially equal to the width from the side wall 130*b* of the holding body case 130 up to the case opening section 132. Furthermore, a portion of the upper end, which comes into contact with the ceiling surface 137*b*, of the intersecting rib sections 157*a* to 157*i* is formed with a recess toward the side wall 130*b* side. As a result, when the film 133 is adhered to adhering surfaces (the right end surfaces) of the intersecting rib sections 157*a* to 157*i*, the portion which is formed with a recess functions as a rib ventilation opening (a rib ventilation opening section) 160 which is an example of a ventilation opening. Here, the area of the rib ventilation opening 160 is larger than the area of the wall ventilation opening 156, and furthermore, the size of the rib ventilation opening 160 in the up and down direction Z is larger than the size of the wall ventilation opening 156 in the up and down direction Z. That is, the lower side opening end of the wall ventilation opening 156 is positioned at a position which is closer to the ceiling surface 137*b* than the lower side opening end of the rib ventilation opening 160. Accordingly, the wall ventilation opening 156 is formed to be closer to the ceiling surface 137*b* than the rib ventilation opening 160.

The first intersecting rib section 157*a* which is closest to the partition wall 150 and the second intersecting rib section 157*b* which is second closest to the partition wall 150 are formed to have gaps with a bottom surface 152*a* at a position toward the front where the size of the second ink chamber 152 in the up and down direction Z is large. As a result, when the film 133 is adhered to the adhering surface of the first intersecting rib 157*a* and the second intersecting rib 157*b*, the lower ends of the first intersecting rib 157*a* and the second intersecting rib 157*b* function as rib linking openings (rib linking opening sections) 161 which is an example of a linking opening where it is possible for ink to pass through. Here, the bottom surface 152*a* of the second ink chamber 152 is a surface which is positioned in the second ink chamber 152 at the lower side in the up and down direction Z and is partially bent and inclined to conform to the shape of the second ink chamber 152. Then, the float valve 131 is accommodated between the first intersecting rib section 157*a* and the second intersecting rib section 157*b* and the bottom surface 152*a*.

The third intersecting rib section 157*c* to the ninth intersecting rib section 157*i* are formed at a position which is close to the rear of the second ink chamber 152. Furthermore, the third intersecting rib section 157*c* to the ninth intersecting rib section 157*i* are formed such that a portion of the lower ends has a recess toward the side wall 130*b* side. As a result, when the film 133 is adhered to the adhering surfaces (the right end surfaces) of the third intersecting rib section 157*c* to the ninth intersecting rib section 157*i*, a portion, which is formed with a recess in the side wall 130*b* side in the lower ends of the third intersecting rib section 157*c* to the ninth intersecting rib section 157*i*, functions as the rib linking opening 161 which is an example of a linking opening where it is possible for ink to pass through. That is, in the second ink chamber 152, the spaces which are spaced by the intersecting rib sections 157*a* to 157*i* are linked via the rib linking opening 161 and the rib ventilation opening 160 which is formed more to the ceiling surface 1376 side than the rib linking opening 161.

As shown in FIG. 13 and FIG. 14, the first lateral inclined rib section 158*a* which is at the highest position is formed so as to be a downwardly inclined surface from the intersection of the partition wall 150 and the ceiling surface 137*b* toward the rear. Furthermore, the second lateral inclined rib section 158*b* which is the second highest position is formed so as to be a downwardly inclined surface which is less inclined than the first lateral inclined rib section 158*a* from a position below the first lateral inclined rib section 158*a* toward the rear in the partition wall 150. That is, the first lateral inclined rib section 158*a* and the second lateral inclined rib section 158*b* are formed to intersect with the partition wall 150 and to intersect with the front and back direction Y. Here, the widths of the first lateral inclined rib section 158*a* and the second lateral inclined rib section 158*b* in the left and right direction X are smaller than the widths of the partition wall 150 and the intersecting rib sections 157*a* to 157*i*. As a result, in a case where the film 133 is adhered to the case opening section 132, gaps are formed between the first lateral inclined rib section 158*a* and the second lateral inclined rib section 158*b* and the film 133. Accordingly, the spaces which are divided by the first lateral inclined rib section 158*a* and the second lateral inclined rib section 1586 are linked with each other via the gaps.

Furthermore, the third lateral inclined rib section 158*c* which is an example of a first dome section and the fourth lateral inclined rib section 158*d* which is an example of a second dome section are formed at the upper side position of the float valve 131 which is more to the bottom surface 152*a* side than the second lateral inclined rib section 158*b*. The third lateral inclined rib section 158*c* is formed between the partition wall 150 and the first intersecting rib section 157*a* and the fourth lateral inclined rib section 158*d* is formed more to the rear side than the second intersecting rib section 157*b*. Then, the third lateral inclined rib section 158*c* and the fourth lateral inclined rib section 158*d* are line symmetric with an axis (which is not shown in the diagram) along the direction of gravity which passes through the center of the float valve 131 as a reference and are formed so as to each be downwardly inclined surfaces from the center to the end sections of the float valve 131. That is, the distance between the upper end of the third lateral inclined rib section 158*c* and the upper end of the fourth lateral inclined rib section 158*d* is shorter than the distance between the lower end of the third lateral inclined rib section 158*c* and the lower end of the fourth lateral inclined rib section 158*d*.

Here, the width of the third lateral inclined rib section 158*c* and the fourth lateral inclined rib section 158*d* in the left and right direction X and the width of the partition wall 150 are substantially equal. Furthermore, both ends of the third lateral inclined rib section 158*c* and the fourth lateral inclined rib section 158*d* are formed with a recess toward the side wall 130*b* side. As a result, when the film 133 is adhered to the adhering surfaces (the right end surfaces) of the third lateral inclined rib section 158*c* and the fourth lateral inclined rib section 158*d*, the portion which is formed with a recess to the side wall 130*b* side functions as the rib linking opening 161 where it is possible for ink to pass through. Accordingly, the spaces which are divided by the third lateral inclined rib section 158*c* and the fourth lateral inclined rib section 158*d* are linked with each other via the rib linking opening 161.

Figure 18:
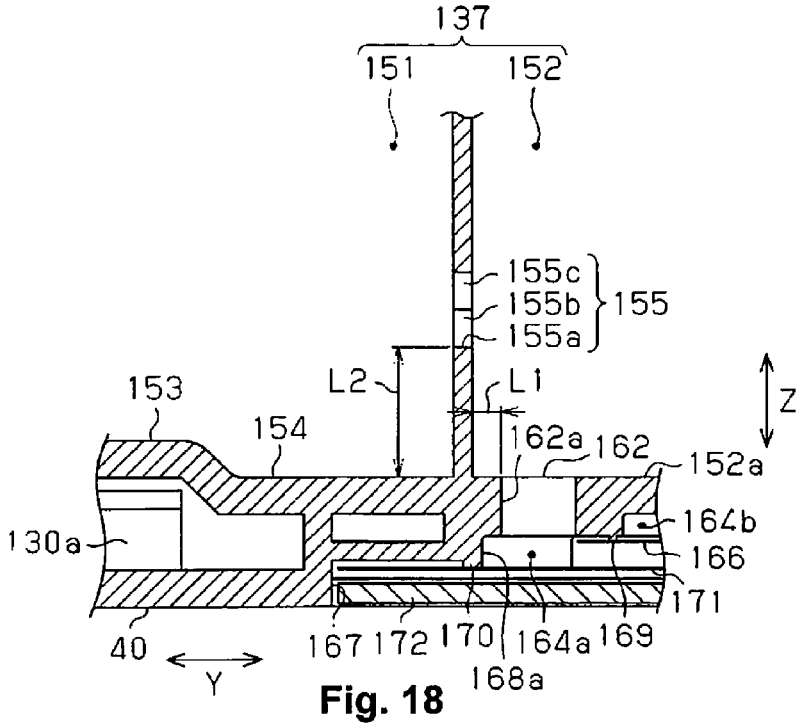
FIG. 18 is a partial cross sectional diagram of the holding body case.

As shown in FIG. 17 and FIG. 18, a flow path opening (a flow path opening section) 162 which links with the directing flow path 138 is formed in the bottom surface 152*a* of the second ink chamber 152. That is, the lateral inclined rib sections 158*a* to 158*d* are positioned at a position on the upper side of the flow path opening 162 and the float valve 131 and are provided so as to cover the flow path opening 162 and the float valve 131 from above. Here, a distance L1 between the flow path opening 162 and the partition wall 150 in the front and back direction Y is shorter than a distance L2 between the opposing surface 153 and the wall linking opening 155 in the up and down direction Z. Here, the distance L2 in the present embodiment is equivalent to the distance between the upper end of the concave section 154 which is formed in the opposing surface 153 and the lower end of the wall linking opening 155. That is, the flow path opening 162 is formed at a position which is close to the partition wall 150 in the bottom surface 152*a* of the second ink chamber 152.

Next, the directing flow path 138 will be described.

As shown in FIG. 14, the directing flow path 138 is formed at the lower side of the second ink chamber 152 along the bottom surface 152*a* of the second ink chamber 152. Then, the directing flow path 138 has a bent flow path section 163 which is formed so as to bend to conform to the shape of the liquid holding body 33 and where the ink flows while the direction (referred to below as the "flow direction") in which the ink flows is changed. Furthermore, the directing flow path 138 has a joining flow path section 164 which couples the flow path opening 162 and the bent flow path section 163 and an inclined flow path section 165 which couples the bent flow path section 163 and the directing port 69.

Figure 19:
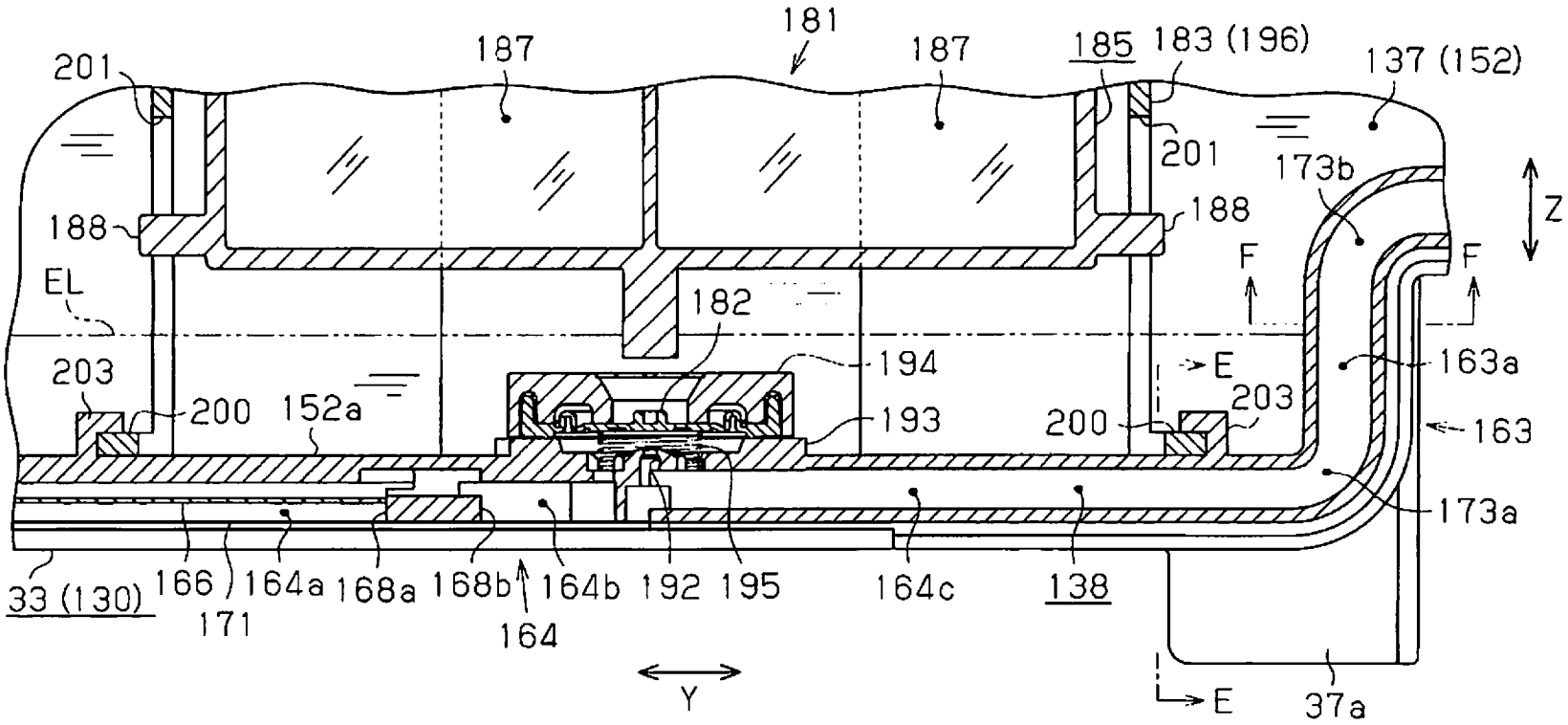
FIG. 19 is a partial cross sectional diagram of the holding body case.

As shown in FIG. 18 and FIG. 19, the joining flow path section 164 is provided with a filter 166 which has a substantially rectangular shape in a bottom surface view from below. That is, the joining flow path section 164 is divided into a first joining flow path section 164*a* on the flow path opening 162 side by the filter 166 and into a second joining flow path section 164*b* of the float valve 131 side by the filter 166. Furthermore, the joining flow path section 164 is provided with a third joining flow path section 164*c* which is joined with the bent flow path section 163 more to the directing port 69 side than the float valve 131.

Figure 20A:
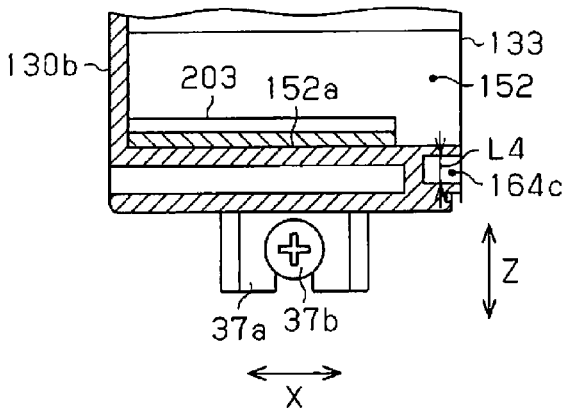
FIG. 20A is a diagram of a cross section along line E-E in FIG. 19
Figure 20B:
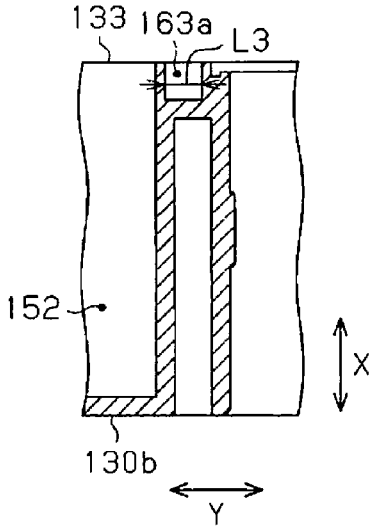
FIG. 20B is a diagram of a cross section along line F-F in FIG. 19.

As shown in FIGS. 20A and 20B, the cross sectional area of the bent flow path section 163 is larger than the cross sectional area of the third joining flow path 164*c*. Here, the directing flow path 138 has a substantially equal width in the left and right direction X across the flow direction. As a result, a width L3 in the direction (the front and back direction Y in a first longitudinal flow path section 163*a*) which is perpendicular with the flow direction of the bent flow path section 163 (the first longitudinal flow path section 163*a* in FIG. 20B) and which is perpendicular with the left and right direction X is wider than a width L4 in a direction (the up and down direction Z) which is perpendicular with the flow direction of the third joining flow path section 164*c* and which is perpendicular with the left and right direction X. Furthermore, the cross sectional area of the inclined flow path section 165 is substantially equal to the cross sectional area of the bent flow path section 163. Accordingly, a width L5 (refer to FIG. 14) in the direction which is perpendicular with the flow direction of the inclined flow path section 165 and which is perpendicular with the left and right direction X is wider than the width L4 of the third joining flow path section 164*c*.

Figure 21:
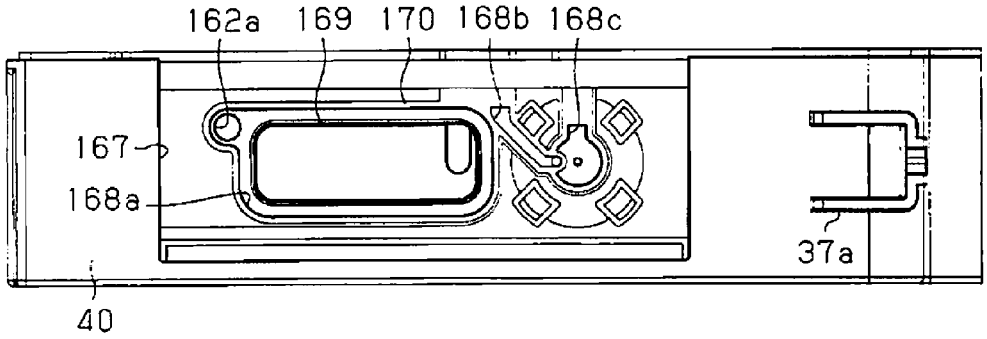
FIG. 21 is a bottom surface diagram of the holding body case.

As shown in FIG. 18 and FIG. 21, a step section 167 with a substantially rectangular shape, which is recessed to the upper side which is the ink chamber 137 side, is formed on the lower surface 40 which is close to the front side where the height of the holding body case 130 in the up and down direction Z is large. In addition, first to third flow path concave sections 168*a* to 168*c* are formed with a recess toward the ink chamber 137 side in the step section 167. In the first flow path forming concave section 168*a*, the other end side of a through hole 162*a* where one end is the flow path opening 162 is opened by forming a through hole in the bottom surface 152*a* of the second ink chamber 152. Furthermore, the first flow path forming concave section 168*a* is formed with different steps so that the inner side of an annular convex section 169, which has a substantially rectangular shape in a bottom surface view and is where the filter 166 is adhered, is deeper compared to the outer side of the annular convex section 169. Furthermore, a flow path convex section 170 is formed at the peripheral edges of the first to third flow path forming concave sections 168*a* to 168*c*. That is, the through hole 162*a* and the annular convex section 169 are enclosed by the flow path convex section 170.

Accordingly, the joining flow path section 164 is formed by the filter 166 being adhered to the annular convex section 169 and the flow path forming film 171 being adhered (for example, heat welded) to the flow path convex section 170. That is, when the flow path forming film 171 is adhered to the flow path convex section 170, the first flow path forming concave section 168*a* functions as a first joining flow path section 164*a* and the second joining flow path section 164*b*. In addition, the second flow path forming concave section 168*b* functions as the second joining flow path section 164*b*. Furthermore, the third flow path forming concave section 168*c* functions as the third joining flow path 164*c*. Then, a protective member 172 with a substantially rectangular plate shape which protects the flow path forming film 171 is attached to the step section 167.

As shown in FIG. 14, the bent flow path section 163 is provided with at least one (two in the present embodiment) of the longitudinal flow path sections 163*a* and 163*b* which extend along the up and down direction Z, a plurality of (four in the present embodiment) bent sections 173*a* to 173*d* which are formed at both ends of the longitudinal flow path sections 163*a* and 163*b*, and a lateral flow path section 163*c* which extends along the front and back direction Y.

That is, the first bent section 173*a* is positioned at the lowest side and couples the rear end of the third joining flow path section 164*c* and the lower end of the first longitudinal flow path section 163*a*. The second bent section 173*b* is positioned more to the upper side than the first bent section 173*a* and couples the upper end of the first longitudinal flow path section 163*a* and the front end of the lateral flow path section 163*c*. The third bent section 173*c* couples the rear end of the lateral flow path section 163*c* and the lower end of the second longitudinal flow path section 163*b*. The fourth bent section 173*d* couples the upper end of the second longitudinal flow path section 163*b* and the front end of the inclined flow path section 165. Accordingly, the bent flow path section 163 has a flow direction in which the ink flows which is different to the inclined flow path section 165 and is bent with regard to the inclined flow path section 165.

The inclined flow path section 165 is formed so as to extend along the direction which intersects with the front and back direction (the horizontal direction) Y so that the end portion on the rear side which is the directing port 69 side is positioned above (in the direction against gravity) the end portion on the front side which is the flow path opening 162 side which is linked with the fourth bent section 173*d*. That is, the inclined flow path section 165 is a surface which is continuously upwardly inclined from the flow path opening 162 side toward the directing port 69 side. Then, the inclined flow path section 165 is linked with the directing port 69 by bending the rear end side upward.

Here, the directing flow path 138 is positioned in the second ink chamber 152 at the side of the direction of gravity and extends along the bottom surface 152*a*. As a result, the bottom surface 152*a* of the second ink chamber 152 at the portion which corresponds to the joining flow path section 164 and the lateral flow path section 163*c* is substantially horizontal while the bottom surface 152*a* of the second ink chamber 152 at the portion which corresponds to the inclined flow path section 165 is a surface which is inclined downward toward the flow path opening 162 side.

Next, the float valve 131 will be described.

Figure 22:
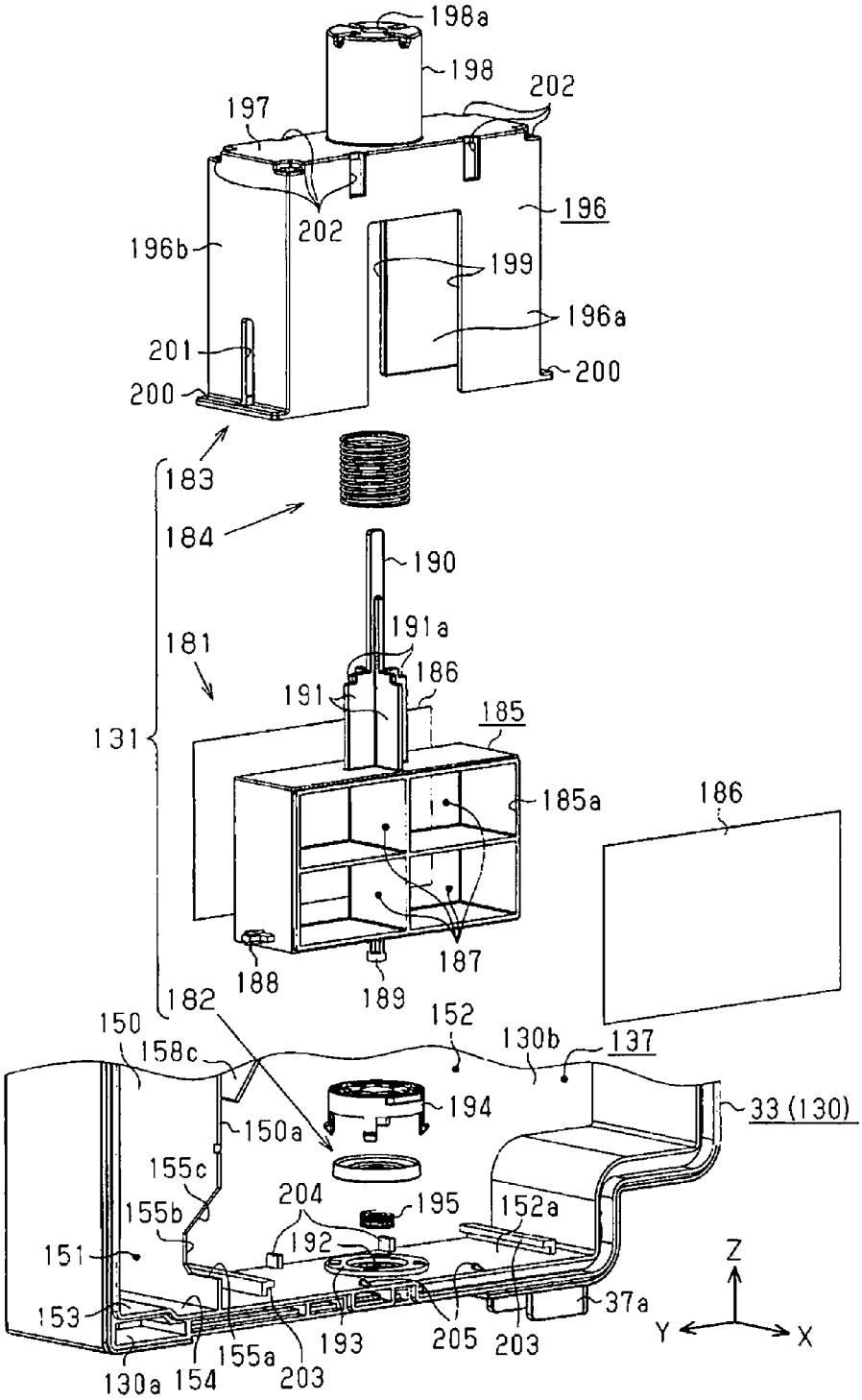
FIG. 22 is an exploded perspective diagram illustrating a portion of the holding body case and each constituent member in a float valve.

As shown in FIG. 22, the float valve 131 has a float member 181 which is arranged inside the ink chamber 137, a valve body 182 which is arranged below the float member 181, a regulating case 183 which is an example of a regulating member which is arranged on the upper side of the float member 181, and a coil spring 184 as an example of a pressing member which is arranged between the float member 181 and the regulating case 183. Here, in FIG. 22, in order to illustrate show the attachment structure of the float valve 131 inside the ink chamber 137 in a simplified manner, a portion of the holding body case 130 where the ink chamber 137 is formed is illustrated along with each of the constituent members described above which configure the float valve 131.

Below, each of the constituent members of the float valve 131 will be described.

First, the float member 181 has a frame body 185 with a rectangular shape where the inner side is partitioned into a plurality (four in the present embodiment) of spatial regions. A thin film member 186 which is formed of, for example, a transparent film or the like is adhered to an opening section 185*a* of both left and right side surfaces in the frame body 185 along the front and back direction Y. As a result, a plurality (four in the present embodiment) of sealed gas chambers 187 are formed in the float member 181 at the inner side of the thin film member 186 by the opening section 185*a* of the frame body 185 being blocked by the thin film member 186. Accordingly, due to the buoyancy which is produced by the gas chambers 187, it is possible for the float member 181 to float in the up and down direction Z along with changes in the remaining amount of ink inside the ink chamber 137.

On the other hand, convex sections 188 which protrude in the front and back direction Y are each formed in the lower sections of the side surfaces at both the front and back along the left and right direction X where the opening section 185*a* is not formed in the frame body 185. In addition, a pressurizing section 189 which has a substantially columnar shape protrudes vertically upward from the center position of the lower surface in the frame body 185. In addition, a rod shaped section 190, which is arranged on the same axis as the pressurizing section 189 of the lower surface, protrudes so as to extend to be long vertically upward from the center position in the upper surface in the frame body 185.

Furthermore, a plate shaped section 191, which forms a cross shape in a planar view from above centered on the rod shaped section 190, is formed in the upper surface of the frame body 185 around the rod shaped section 190 such that the protruding length from the upper surface of the frame body 185 is substantially half of the protruding length of the rod shaped section 190. The size of the cross section cross shape of the plate shaped section 191 is formed to be larger than the outer diameter dimensions of the coil spring 184. Then, a spring seat 191*a* for loading and supporting the coil spring 184 is formed to be cut away in a rectangular shape at the front end edge in an outward direction from the rod shaped section 190 in the upper end portion of the plate shaped section 191 which forms the cross section cross shape.

Next, the valve body 182 is a diaphragm valve with a substantially round plate shape, which is formed of elastomers or the like which have flexibility, and is arranged at a position which is above a valve opening 192 (refer to FIG. 19 and the like) which is formed as an opening in the bottom surface 152*a* of the second ink chamber 152 so as to be positioned in the directing flow path 138 at an interface between the second joining flow path section 164*b* and the third joining flow path section 164*c*. That is, an attachment seat 193 with an annular shape which encloses the valve opening 192 is formed on the bottom surface 152*a* of the second ink chamber 152, an attachment tool 194 with an annular shape is similarly configured to lock from above with regard to the attachment seat 193, and the valve body 182 is arranged a position which is above the valve opening 192 in a state of being interposed between the attachment seat 193 and the attachment tool 194.

In addition, when the coil spring 184 described above is a first pressing member which has a first pressing force, a coil spring 195 which functions as a second pressing member which has a second pressing force is arranged in the inner side of the attachment seat 193 so as to normally abut against the valve body 182 from below. Then, due to the coil spring 195, the valve body 182 is normally pressed toward an open valve position (the position shown in FIG. 19 and FIG. 28) which opens the directing flow path 138 by being upwardly separated from the valve opening 192.

Here, the force relationship between the first pressing force of the coil spring 184 and the second pressing force of the coil spring 195 is set as the following force relationship with the premise that the first pressing force of the coil spring 184 is larger than the second pressing force of the coil spring 195.

Figure 28:
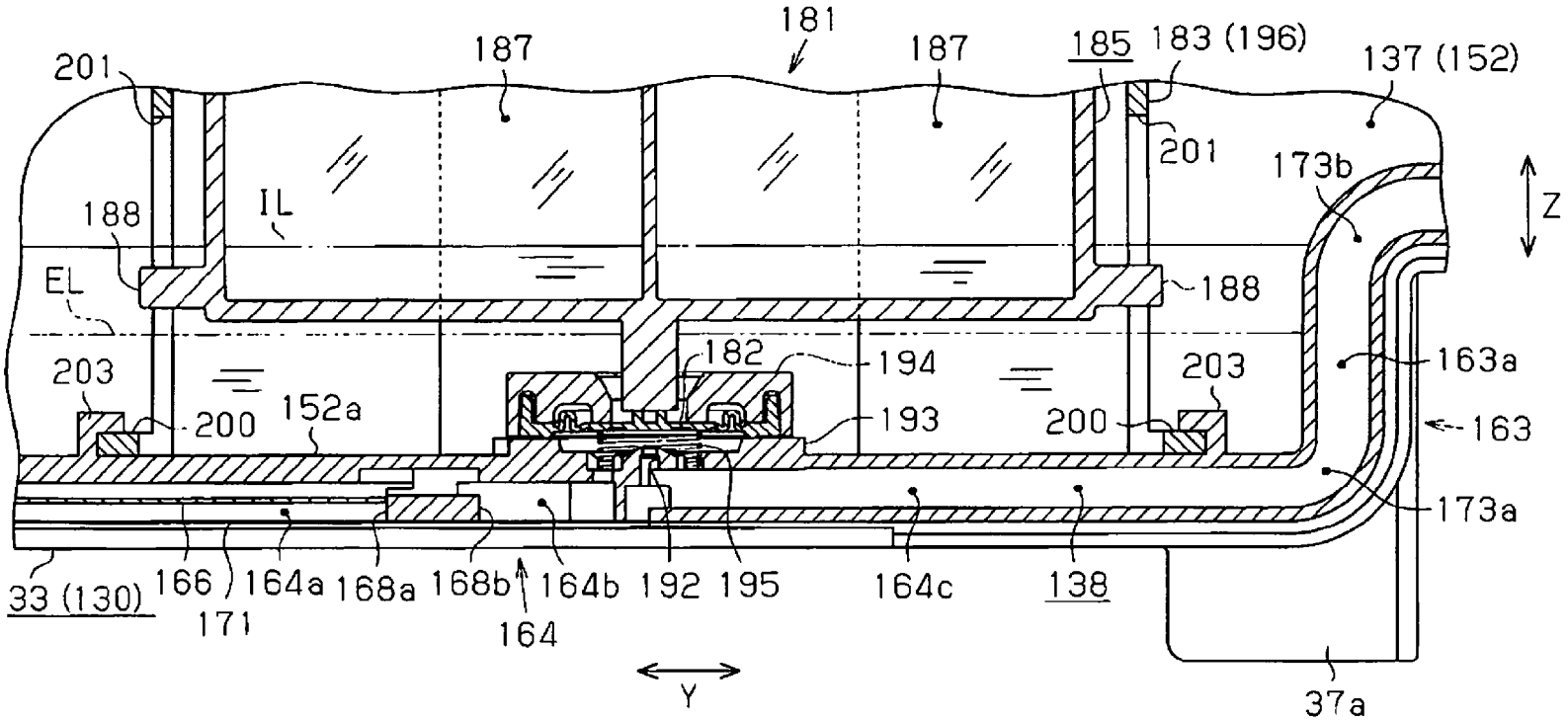
FIG. 28 is a partial cross sectional diagram illustrating a state of the float valve when the remaining amount of the ink approaches a threshold value remaining amount.
Figure 29:
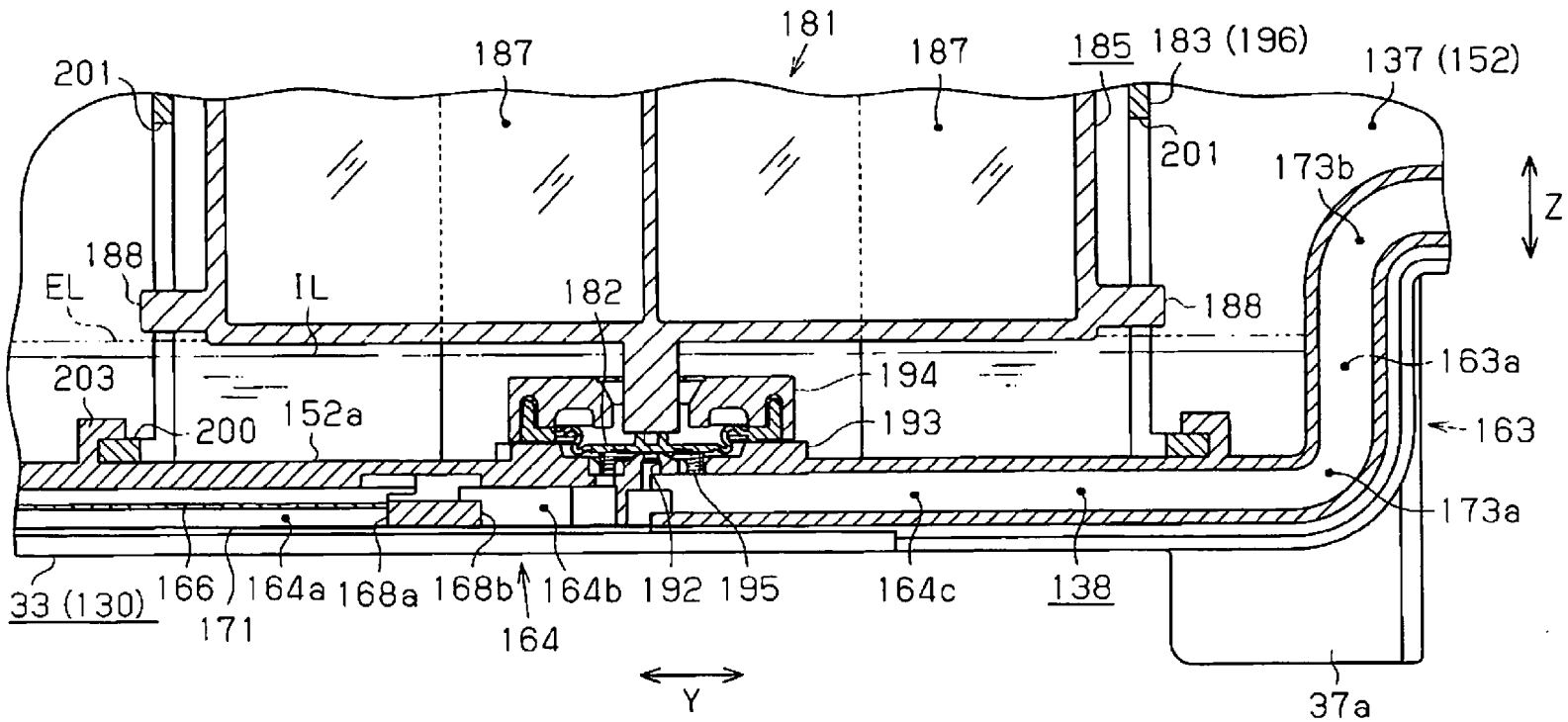
FIG. 29 is a partial cross sectional diagram illustrating a state of the float valve when the remaining amount of ink is less than the threshold value remaining amount.

That is, in a case where the remaining amount of ink in the ink chamber 137 is, for example, as shown in FIG. 29, less than a threshold remaining amount which is a small remaining amount which is set in advance, the sum of the buoyancy of the float member 181 which floats in the remaining ink at this time and the second pressing force of the coil spring 195 is set to be smaller than the first pressing force of the coil spring 184. On the other hand, in a case where the remaining amount of ink in the ink chamber 137 is, for example, as shown in FIG. 19 and FIG. 28, the threshold remaining amount or more, the sum of the buoyancy of the float member 181 which floats in the remaining ink at this time and the second pressing force of the coil spring 195 is set to be equal to or larger than the first pressing force of the coil spring 184.

Next, the regulating case 183 is a box shape which is opened from below and which is formed to have an annular wall section 196 which forms a rectangular loop where it is possible to insert and remove the float member 181 in the up and down direction Z and an upper wall section 197 which closes off an upward opening in the annular wall section 196. That is, the annular wall section 196 is formed with an annular shape where it is possible to surround the surroundings of a floating region in the up and down direction Z in the float member 181 so as to open a gap with the side surface of the float member 181.

In addition, a cylindrical section 198, where the upward opening is closed off, is formed at the center position of the upper wall section 197 so as to link with the inner space of the annular wall section 196 via the downward opening of the cylindrical section 198. Then, an insertion hole 198*a* where it is possible to insert the rod shaped section 190 which protrudes upward from the upper surface of the float member 181 is formed to pass through the upper wall section of the cylindrical section 198. In addition, a spring seat (which is not shown in the diagram) which opposes the spring seat 191*a*, which is formed to be cut away in the plate shaped section 191 on the float member 181 side, in the up and down direction Z is formed to bulge downward at a part which has a cross shape in a planar view from above centering on the insertion hole 198*a* in the upper wall section of the cylindrical section 198.

In addition, the annular wall section 196 of the regulating case 183 is an opposing part which opposes the thin film member 186 of the float member 181 in a state where each of the constituent members of the float valve 131 is assembled with each left and right side wall 196*a* along the front and back direction Y. Then, at the substantial center of each of the left and right side walls 196*a* in the front and back direction Y, a cut away section 199 with a rectangular shape which extends along the up and down direction Z in which the float member 181 floats is formed to be cut away upward from the lower end edge of each of the side walls 196*a*. The cut away section 199 is formed with a shape where the width dimension in the front and back direction Y is larger than the outer diameter dimension of the cylindrical section 198 of the upper wall section 197 and the height dimension in the up and down direction Z is larger than the height dimension of the frame body 185 in the float member 181 in the up and down direction Z.

Furthermore, a flange section 200 with a belt shape which has a predetermined width in the front and back direction Y is formed to protrude horizontally toward the front and back from the lower end portion of each front and back side wall 196*b* along the left and right direction X in the annular wall section 196 of the regulating case 183. Then, a guide slot 201 where it is possible to insert a convex section 188 on the float member 181 side is formed along the up and down direction Z from a position which is the substantial center of the flange section 200 in the left and right direction X and the substantial center of the flange section 200 in the front and back direction Y up to a position which is slightly below the substantial center of each of the side walls 196 in the up and down direction Z. In addition, through holes 202 which permit the flow of ink by linking the inside and outside of the regulating case 183 are each formed in the regulating case 183 at a part from each of the two locations at the left and right on both long sides of the upper wall section 197 to the upper end portion of each of the left and right side walls 196*a* of the annular wall section 196 and parts which are the four corners of the upper end portion of the annular wall section 196.

Next, the coil spring 184 is arranged between the float member 181 and the regulating case 183 to be able to contract in the up and down direction Z. That is, the coil spring 184 is loaded on the spring seat 191*a* which is formed on the upper end of the plate shaped section 191 in the periphery of the rod shaped section 190 by inserting the rod shaped section 190 of the float member 181 into the coil spring 184 from below. Then, from this state, when the frame body 185 of the float member 181 is inserted into the annular section 196 from below while the rod shaped section 190 of the float member 181 is being inserted into the insertion hole 198*a* of the cylindrical section 198 with regard to the regulating case 183, the upper end of the coil spring 184 abuts against a spring seat (which is not shown in the diagram) which is formed to bulge downward from the upper wall of the cylindrical section 198 of the regulating case 183.

Then, the float valve 131 is accommodated in the holding body case 130 by the regulating case 183 which is inserted with the float member 181 being attached to the bottom surface 152*a* of the second ink chamber 152 of the ink chamber 137 while maintaining a state where the float member 181 is pushed into the regulating case 183 such that the coil spring 184 is further contracted from this state.

Next, the attachment structure of the float valve 131 in the holding body case 130 will be described.

As shown in FIG. 22, engagement rail sections 203 with a cross section of a reverse L-shape where it is possible to slide and insert each of the front and back flange sections 200 of the regulating case 183 along the left and right direction X are formed on the bottom surface 152*a* of the second ink chamber 152 in the holding body case 130 at two positions at the front and back which interpose the attachment seat 193 of the valve body 182 by spacing at a distance which is equivalent to the dimension of the regulating case 183 in the front and back direction Y. In addition, at two positions of the front and back which are at the far side of the holding body case 130 between each of the engagement rail sections 203 and the attachment seat 193, position aligning sections 204 are formed which are able to abut against the side wall 196*a* which is the far side out of both the left and right side walls 196*a* along the front and back direction Y of the regulating case 183 which slides to move toward the far side of the holding body case 130 in a state where the flange section 200 is inserted into the engagement rail sections 203.

Furthermore, at two positions of the near side which corresponds to the position aligning section 204 which is at the far side in the left and right direction X in the bottom surface 152*a* of the second ink chamber 152, a protruding section 205 is formed which is able to lock from the near side which is the opening side of the holding body case 130 in the lower end portion of the side wall 196*a* which is the near side in the regulating case 183 where the side wall 196*a* which is the rear side abuts against the position aligning section 204. The protruding section 205 is a structural body, which is able to elastically change shape and which extends upward and diagonally to the far side of the holding body case 130, and is provided in an inclined posture such that it is possible for the lower end edges of each of the side walls 196*a* to ride up while sliding from the near side to the far side when the regulating case 183 slides and moves to the far side by inserting the flange section 200 into the engagement rail section 203. Then, after the side wall 196*a* which is the near side rides up, the regulating case 183 is set not to come out from the far side to the near side of the holding body case 130 by locking with the surface which is the near side of the side wall 196*a* by elastically returning to the original inclined posture.

Figure 23:
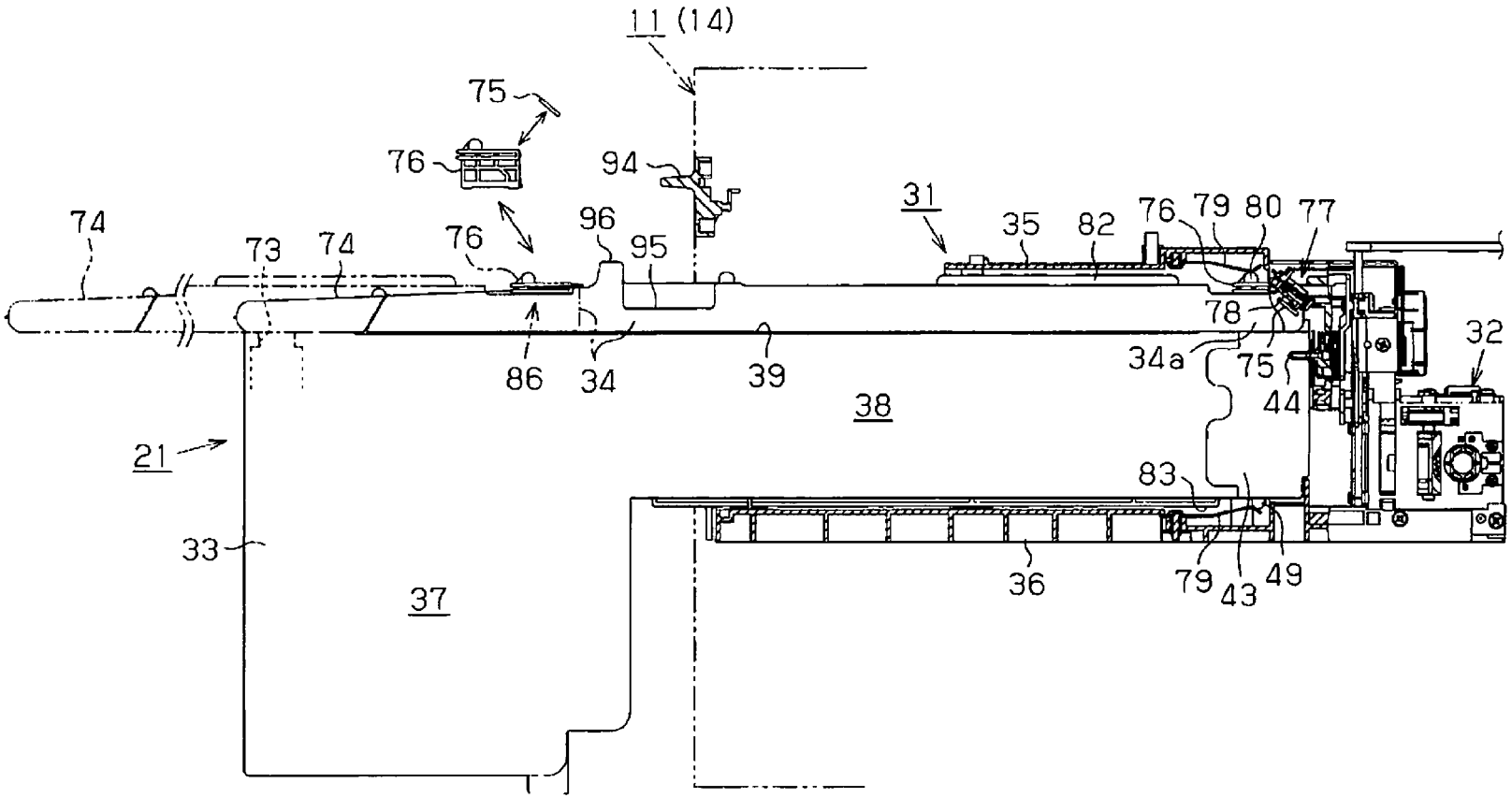
FIG. 23 is an explanatory diagram of an operation of the slider in the liquid holding container which is mounted on the holder.

Next, the operation of the liquid holding container 21 of the present embodiment will be described. Here, in FIGS. 24A, 24B, and 24C, the slider 34 and the liquid holding body 33 are omitted from the illustration. As shown in FIG. 23, in the liquid holding container 21 which is fixed to the printer 11 so as to be unable to move by positioning a portion of the second holding body section 38 inside the mounting section 31, the engagement of the sliding knob 94 with the concave section 95 of the slider 34 is released when the sliding knob 94 is displaced upward. By doing so, it is possible for the user to take out the slider 34 from the printer 11 (the mounting section 31) by sliding the slider 34 in the direction which is opposite to the insertion direction along the longitudinal direction of the slider 34.

By the slider 34 being taken out, the slider 34 moves a part which is positioned inside the printer 11, that is, a part, which is in the upper surface 39 of the liquid holding body 33, which overlaps with a part (the second part) which is positioned inside the printer 11 in the second holding body section 38 which includes the connection section 43, outside of the printer 11. In the present embodiment, as shown by the two-dot chain line in FIG. 23, the slider 34 moves the holder 76 which is attached to the end portion 34*a* which is the far side in the insertion direction of the slider 34 up to a position outside the printer 11 where it is possible for the user to take out the holder 76 from the holder attachment section 86 of the slider 34. Accordingly, the part, which is in the upper surface 39 of the liquid holding body 33, of the slider 34, which overlaps with the part (the second part) which is positioned inside the printer 11 in the second holding body section 38 which includes the connection section 43, functions as a moving part which moves between inside the printer 11 and outside the printer 11.

As a result, the user takes out and detaches the holder 76 which is moved to the outside of the printer 11 from the slider 34 (the holder attachment section 86). Then, in a case where, for example, there is the circuit substrate 75 which is already loaded on the holder 76, the circuit substrate 75 is replaced with the circuit substrate 75 which records relationship information (for example, hue, saturation, and brightness of the ink, viscosity of the ink, the type of the solute of the ink, and the like) which relates to the ink which is introduced from the inlet port 73 with regard to the liquid holding body 33. Then, the user inserts the slider 34 inside the printer 11 (the mounting section 31) along the upper surface 39 of the liquid holding body 33 after the holder 76 where the replaced circuit substrate 75 is loaded is again inserted into and attached to the slider 34 (the holder attachment section 86).

By the insertion of the slider 34, the holder 76 comes into contact with and is electrically connected with the electric terminal 78 of the communication section 77 where the circuit substrate 75 which is loaded to be inclined with regard to the insertion direction is provided in the supply section 32, and the relationship information which is recorded in the circuit substrate 75 is transferred to the printer 11 side. At the timing of this connection, the circuit substrate 75 is positionally aligned with regard to the electric terminal 78. In a state where the relationship information which is recorded in the circuit substrate 75 is transferred (read) to the printer 11 side, the holder 76 is positioned in the inner section of the printer 11 and a portion (the first part) of the slider 34 is positioned outside the printer 11. In other words, in a state where the relationship information which is recorded in the circuit substrate 75 is read to the printer 11 side, the circuit substrate 75 and the holder 76 are positioned at a position which it is not possible for the user to touch by hand.

Figure 24A:
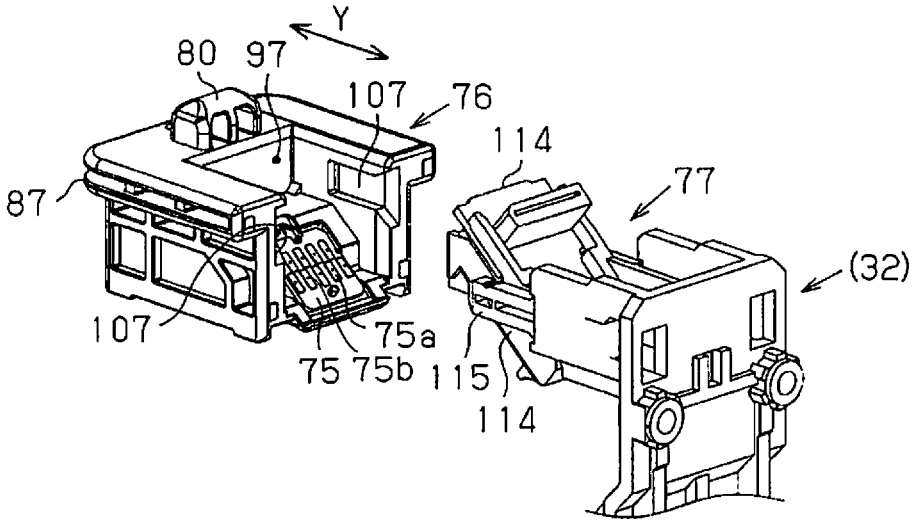
FIG. 24A is a perspective diagram illustrating the holder and a communication section before engagement.

That is, as shown in FIG. 24A, a terminal section 114 which is provided with the electric terminal 78 which comes into contact with the plurality of terminals (which include the contact section 75*b*) 75*a* which are formed on the circuit substrate 75, and a protrusion shaped section 115 which protrudes in the short side direction and extends in the insertion direction in both sides of the short side direction, are provided in the communication section 77 which is provided in the supply section 32. The terminal section 114 engages with the concave section (engaging section) 97 of the holder 76, and the protrusion shaped section 115 engages with the groove shaped section 107 of the holder 76. The concave section 97 is a surface of a wall which configures the holder 76 and is formed on the surface of the circuit substrate 75 side.

Figure 24B:
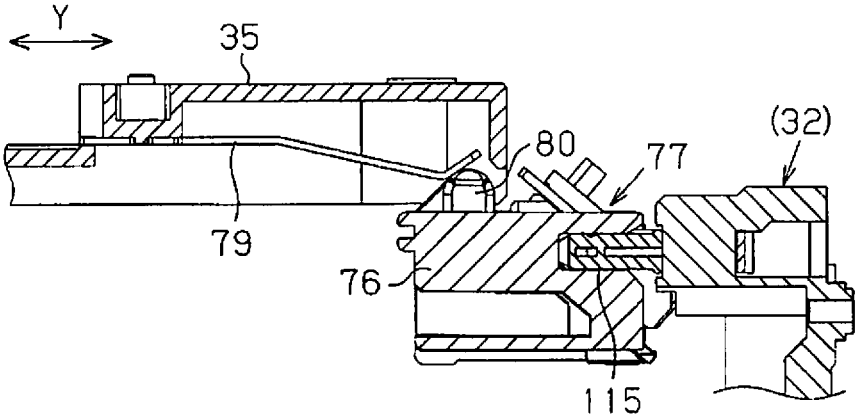
FIG. 24B is a side surface diagram illustrating an engaging state of the circuit substrate holder and the communication section using a partial cross section.

At this time, as shown in FIG. 24B, when the slider 34 is inserted into the mounting section 31, the holder 76 is moved toward the communication section 77 while the protruding part 80 of the holder 76 is pushed downward by the plate spring 79 which is fixed to the upper frame 35 so as to not separate from the slider 34. With this movement, the holder 76 is engaged by the protruding shaped section 115 of the communication section 77 being directed by the chamfered section 106 and inserted into the groove shaped section 107 and the holder 76 is positionally aligned with regard to the communication section 77. In this regard, the groove shaped section 107 of the holder 76 functions as an example of a position aligning shaped section which performs positional alignment in the printer 11.

Figure 24C:
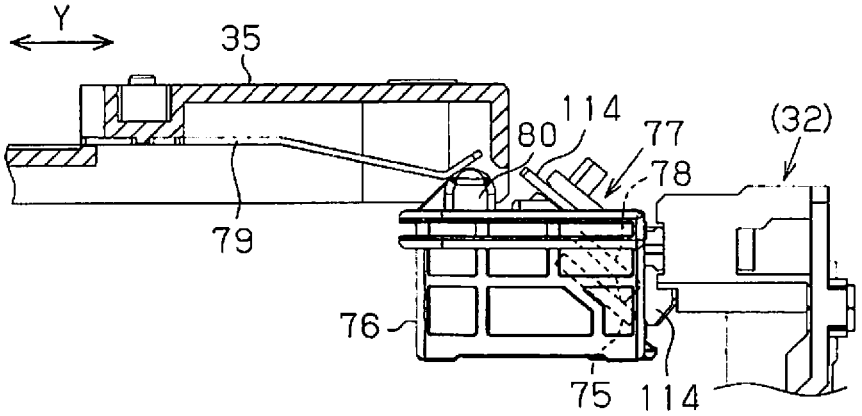
FIG. 24C is a side surface diagram illustrating the circuit substrate holder and the communication section after engagement.

As a result, as shown in FIGS. 24A and 24C, the circuit substrate 75 which is loaded on the holder 76 is positionally aligned with regard to the terminal section 114 of the communication section 77, and the plurality of electric terminals 78 which are provided in the terminal section 114 are in suitable contact with the plurality (here, nine) of terminals (which include the contact section 75*b*) 75*a* of the circuit substrate 75. Here, with this contact, since the terminals (which include the contact section 75*b*) 75*a* of the circuit substrate 75 are in an inclined state of being lowered forward in the insertion direction, the electric terminals 78 rub and comes into contact with the surfaces of the terminals (which include the contact section 75*b*) 75*a*.

Next, the operation relating to the introduction of ink in the liquid holding container 21 will be described.

Here, when the ink is introduced to the liquid holding body 33, the opening and closing cover 74 as shown in FIG. 9A is displaced to the open lid position and the inlet port 73 is exposed by loading the covering body 120 on the rear surface 74*a* of the opening and closing cover 74 as shown in FIG. 9B.

At this time, after the covering body 120 is detached from the inlet port 73, the user rotates the covering member 121 with regard to the liquid receiving surface 116 by an arbitrary angle (180 degrees in the present embodiment) with the fixing section 123 as the rotation center and loads the covering body 120 on the rear surface 74*a* of the opening and closing cover 74. In addition, in the state shown in FIG. 9B, since the rear surface 74*a* of the opening and closing cover 74 is positioned at a position which is higher than the liquid receiving surface 116 in the up and down direction Z, the joining section 125 is in a state of being slightly stretched in the state where the covering body 120 is loaded on the rear surface 74*a* of the opening and closing cover 74. By doing so, the restoring force which accompanies the elastic shape changing (the stretching) of the joining section 125 operates on the covering body 120 from the opening and closing cover 74 toward the front. With regard to this point, in the present embodiment, since the covering body 120 abuts against the hook part 110 of the opening and closing cover 74, the covering body 120 is suppressed from falling from the opening and closing cover 74 and the like. In addition, since the rear surface 74*a* of the opening and closing cover 74 which is positioned at the open lid position is in a state where the side where the hook part 110 is formed is the lowest, the ink is suppressed from spreading over the whole of the surface (in particular, the surface area to the rear) of the opening and closing cover 74 even when, for example, the covering body 120 where ink is attached is loaded on the rear surface 74*a* of the opening and closing cover 74.

Figure 25:
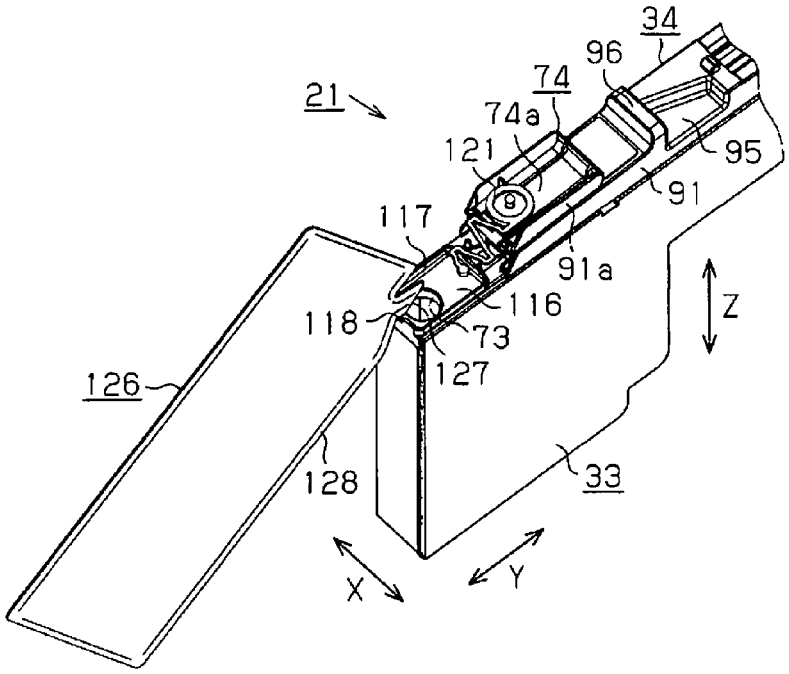
FIG. 25 is a perspective diagram illustrating a positional relationship between the liquid holding container and a liquid holding source when introducing the ink.
Figure 26:
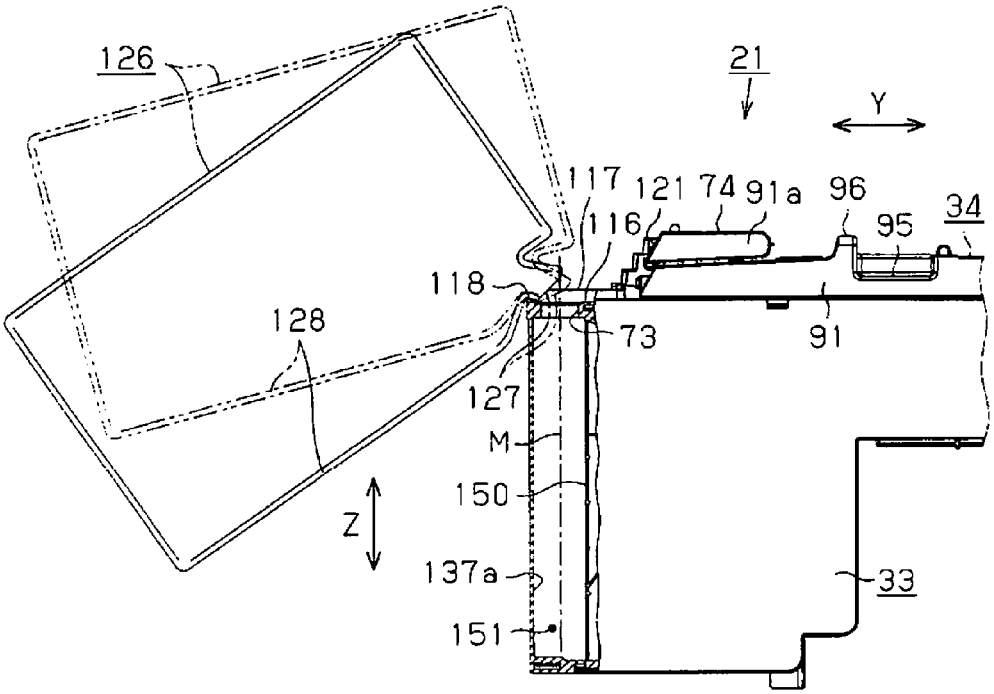
FIG. 26 is a partial cross sectional side surface diagram illustrating a positional relationship between the liquid holding container and the liquid holding source when introducing the ink.

Then, as shown in FIG. 25 and FIG. 26, an edge portion 128 of the overlapping film or the like is welded and the ink is introduced to the liquid holding body 33 from the liquid introduction source 126 where a pouring opening 127 is formed. When introducing the ink, by the edge portion 128 in the vicinity of the pouring opening 127 of the liquid introduction source 126 abutting against and being fit into the cut away groove 118 which is formed in the circumference wall section 117 of the liquid holding body 33, the liquid introduction source 126 is positionally aligned with regard to the liquid holding body 33. Then, as shown in FIG. 26, by tilting the liquid introduction source 126 such that the pouring opening 127 of the liquid introduction source 126 faces downward so that a point where the liquid introduction source 126 and the liquid holding body 33 abut against each other is the center of the tilting, the ink inside the liquid introduction source 126 is introduced inside the first ink chamber 151 via the inlet port 73 of the liquid holding body 33.

At this time, when the user vigorously tilts the liquid introduction source 126, the ink which flows out from the pouring opening 127 of the liquid introduction source 126 may be diverted from the inlet port 73 and pour into the surroundings of the inlet port 73 in the liquid receiving surface 116. Also in this case, by the circumference wall section 117 which encloses the surroundings of the liquid receiving surface 116 damming and stopping the ink which pours onto the liquid receiving surface 116, the ink is suppressed from flowing out from the liquid receiving surface 116 to the outside. Then, since the liquid receiving surface 116 is inclined downward toward the inlet port 73 in each of the left and right direction X and the front and back direction Y, the ink which is attached to the liquid receiving surface 116 is guided up to the inlet port 73 along the incline.

When the introduction of the ink is finished, the introduction operation is finished by covering the inlet port 73 of the liquid holding body 33 with the covering body 120 which is loaded on the rear surface 74*a* of the opening and closing cover 74 as shown in FIG. 9A and displacing the opening and closing cover 74 to the closed lid position as shown in FIG. 2.

Figure 27:
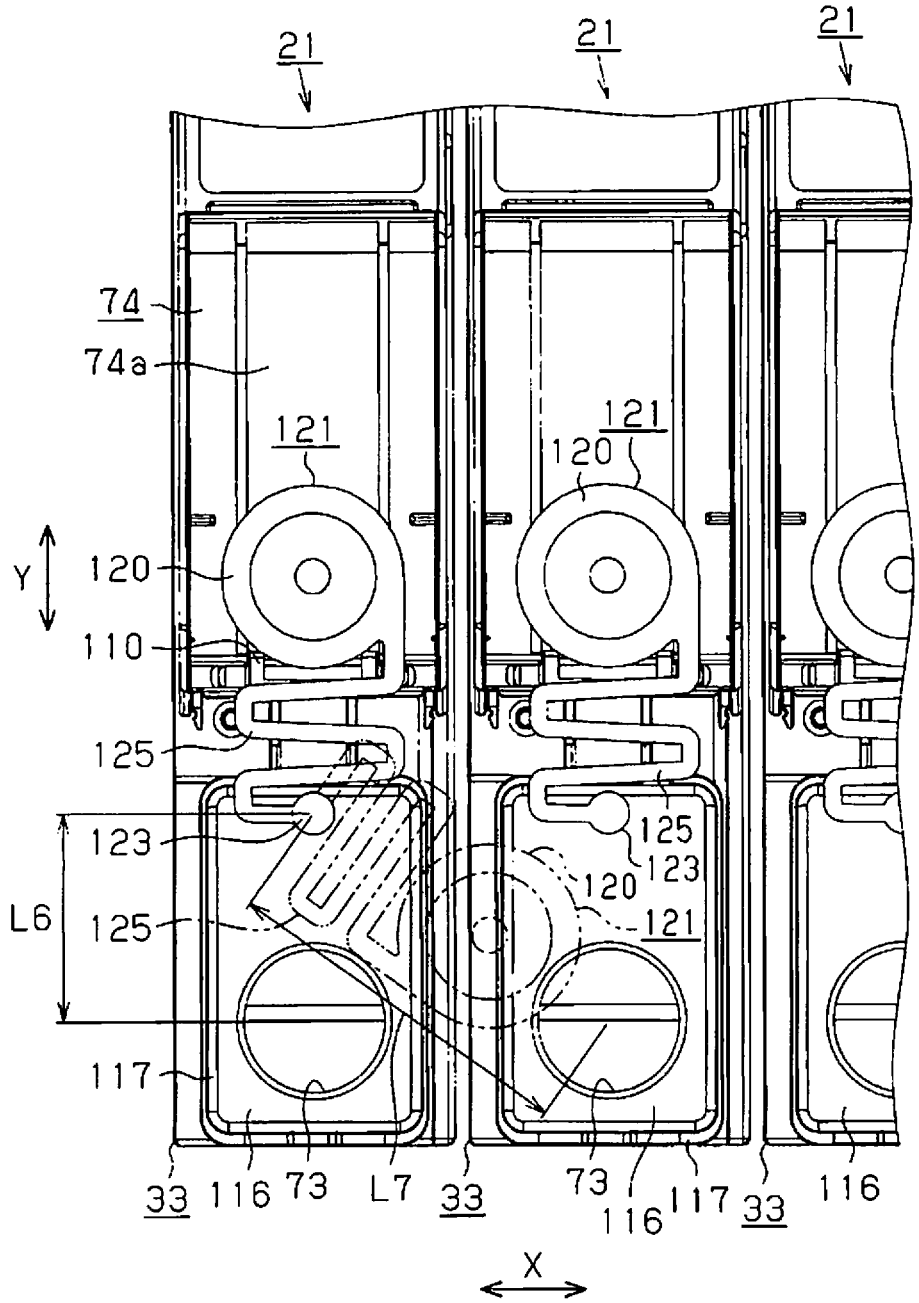
FIG. 27 is a planar diagram illustrating a rotation range which is centered on a fixing section of the covering member which is provided in the liquid holding container.

In addition, as shown in FIG. 27, in a state where a plurality of liquid holding container 21 are provided side by side and used, a distance L6 from the fixing section 123 (the fixing hole 124) of the covering member 121 in one of the liquid holding containers 21 (for example, the left end) up to the inlet port 73 is shorter than a distance L7 from the fixing section 123 in one of the liquid holding containers 21 up to the inlet port 73 in the another of the liquid holding containers 21 which is provided side by side with the one liquid holding container 21. By doing so, as shown in FIG. 27, it is not possible for the covering body 120 to cover the inlet port 73 even when the covering body 120 of the covering member 121 which is provided to correspond to the liquid holding body 33 which is positioned at the left end faces the inlet port 73 of the liquid holding body 33 which is provided at the side with the fixing section 123 as the center of rotation (illustrated by a two-dot chain line in FIG. 27). Here, the distances L6 and L7 indicate the distances which connect the center positions of the fixing section 123 (the fixing hole 124) and the inlet port 73 in a planar view as shown in FIG. 27.

Next, the operation inside the liquid holding body 33 when the ink is introduced from the inlet port 73 will be described.

Here, as shown in FIG. 14, when the ink is introduced from the inlet port 73, the liquid surface in the first ink chamber 151 rises and the ink flows into the second ink chamber 152 via the wall linking opening 155. Here, since the concave section 154 which is formed in the first ink chamber 151 is formed to shift a position from the inlet port 73 in the front and back direction Y, the rising up of the foreign material is suppressed even in a case where the foreign material is deposited in the concave section 154.

Here, the first ink chamber 151 and the second ink chamber 152 are linked via the wall ventilation opening 156. As a result, since the pressures inside the first ink chamber 151 and the second ink chamber 152 are substantially the same, the liquid surfaces of the ink in the first ink chamber 151 and the second ink chamber 152 are raised so as to be substantially the same height as each other in the up and down direction Z.

Since the rib linking opening 161 is formed at both ends in the third lateral inclined rib section 158*c* and the fourth lateral inclined rib section 158*d*, the ink passes through the rib linking opening 161 and the liquid surfaces of the ink are positioned at substantially the same position at both sides of the third lateral inclined rib section 158*c* and the fourth lateral inclined rib section 158*d*. Furthermore, the ink passes through gaps which are formed between the first lateral inclined rib section 158*a*, the second lateral inclined rib section 158*b*, and the film 133, and the liquid surfaces of the ink are moved up to positions which are above the first lateral inclined rib section 158*a* and the second lateral inclined rib section 158*b*. Then, when the liquid surface of the ink rises further, the ink spreads so as to rise up the inclined bottom surface 152*a* and the liquid surface is raised by the ink passing through the rib linking openings 161 of the fourth to ninth intersecting rib sections 157*d* to 157*i*.

Furthermore, rib ventilation openings 160 are formed in each of the intersecting rib sections 157*a* to 157*i*. As a result, pressures in the spaces at both sides of the intersecting rib sections 157*a* to 157*i* in the second ink chamber 152 are substantially the same. As a result, the liquid surface of the ink in the second ink chamber 152 is also raised so as to be substantially the same height in the up and down direction Z.

Here, in the liquid holding body 33 which has the inlet port 73, foreign material such as dirt, dust, or the like is mixed in from the inlet port 73, the foreign material itself is deposited, and the ink itself may become foreign material due to the ink drying at the interface with the atmosphere or the like. Here, the foreign material is deposited on the opposing surface 153 and the concave section 154 in the first ink chamber 151. Then, since the wall linking opening 155 is formed to be separated from the concave section 154, entry of the foreign material is suppressed compared to the inflow of ink into the second ink chamber 152. That is, out of the foreign material which enters from the inlet port 73, in particular, it is easy for foreign material with a large size and foreign material with a heavy weight to settle in the first ink chamber 151.

In addition, in the second ink chamber 152, the foreign material is deposited on the lateral inclined rib sections 158*a* to 158*d* in the region at the front side and the foreign material is deposited on the bottom surface 152*a* at the region at the rear side with the passing of time. Then, since the lateral inclined rib sections 158*a* to 158*d* and the bottom surface 152*a* where the foreign material is deposited are inclined so as to intersect with the front and back direction Y, the foreign material which is deposited is moved in one direction (the downward direction) along with the movement of the liquid surface when the liquid surface of the ink falls due to the ink being directed in from the directing port 69.

Furthermore, when the ink is introduced from the inlet port 73, bubbles may enter along with the introduction of the ink. Then, when the bubbles enter the second ink chamber 152 or the dissolved gas becomes bubbles in the second ink chamber 152, the bubbles move upward and reach the lateral inclined rib sections 158*a* to 158*d*. With regard to this point, in the present embodiment, since the lateral inclined rib sections 158*a* to 158*d* intersect with regard to the front and back direction Y, the bubbles are moved along the lateral inclined rib sections 158*a* to 158*d* which are inclined and directed to the liquid surface.

In addition, the ink in the second ink chamber 152 flows from the flow path opening 162 to the directing flow path 138 and is directed in from the directing port 69. That is, first, foreign matter and bubbles in the ink which is directed in from the flow path opening 162 are captured by the filter 166. After that, the ink flows to the bent flow path section 163 via the second joining flow path section 164*b* and the third joining flow path section 164*c*.

Here, since the flow direction of the ink changes in the bent flow path section 163, it is easy for the gas which is dissolved in the ink to turn into bubbles. In this regard, due to this configuration, since the cross section area of the bent flow path section 163 is large compared to the cross section area of the third joining flow path section 164*c*, the bubbles which are generated move to the inclined flow path section 165 side along with the flow of the ink. Furthermore, the cross section area of the inclined flow path section 165 is larger than the cross section area of the third joining flow path section 164*c* and the inclined flow path section 165 is a surface which is upwardly inclined toward the directing port 69 side. As a result, the bubbles which are generated in the bent flow path section 163 are moved to the directing port 69 side through the inclined flow path section 165 and are directed from the directing port 69 along with the ink.

Next, the operation of the float valve 131 will be described.

Here, the state shown in FIG. 19 indicates a state where a liquid surface line IL of the ink inside the ink chamber 137 is equivalent or above a threshold remaining amount time line EL, that is, a state where the remaining amount of the ink inside the ink chamber 137 is sufficient for what is necessary to continue printing by ejecting ink from the liquid ejecting head 24 with regard to the paper S. As a result, in the state shown in FIG. 19, since the sum of the second pressing force of the coil spring 195 and the buoyancy of the float member 181 is equal to or more than the first pressing force of the coil spring 184, the valve body 182 does not abut against the valve opening 192 by the float member 181 being pushed downward by the first pressing force of the coil spring 184.

That is, in this case, as shown in FIG. 19, there is a state where the sum of the buoyancy which is generated by each of the gas chambers 187 of the float member 181 exceeds the first pressing force of the coil spring 184, and the float member 181 is in a state of being suspended at a position which is separated upwardly from the valve body 182. On the other hand, since the valve body 182 is pressurized downward due to the coil spring 184 via the float member 181, only the second pressing force which is upward from the coil spring 195 is received, and the valve body 182 is upwardly separated from the valve opening 192 and positioned at the open valve position where the directing flow path 138 is open.

Then, when the remaining amount of ink inside the ink chamber 137 is gradually reduced and the liquid surface line IL of the ink approaches the threshold remaining amount time line EL due to continuing the printing from the state shown in FIG. 19, the sum of the buoyancy of the float member 181 and the second pressing force of the coil spring 195 is in a state of mutual balance with the first pressing force of the coil spring 184 as shown in FIG. 28. As a result, the float member 181 is pressurized downward by the first pressing force of the coil spring 184, and the pressurizing section 189 which is the lower surface of the float member 181 is in a state of abutting against the valve body 182, which is in the open valve position, from above. Here, at this time, the float member 181 abuts against the valve body 182 from above, but the valve body 182 is not yet displaced toward the closed valve position which is downward.

Then, when the remaining amount of the ink inside the ink chamber 137 is further reduced and the liquid surface line IL of the ink is lower than the threshold remaining amount time line EL due to further continuing the printing from the state which is shown in FIG. 28, the sum of the buoyancy of the float member 181 and the second pressing force of the coil spring 195 is smaller than first pressing force of the coil spring 184 as shown in FIG. 29. As a result, the float member 181 is further pressurized downward by the first pressing force of the coil spring 184 and the valve body 182, which is in the open valve position, is pressurized downward by the pressurizing section 189 which is the lower surface of the float member 181. As a result, the valve body 182 is displaced to a closed valve position where the valve opening 192 is closed off.

By doing so, the directing flow path 138 is closed off and ink does not flow to the downstream side of the valve opening 192 since the valve opening 192 is blocked. As a result, due to the ink not flowing into the liquid chamber 53 which is disposed at the downstream side of the directing flow path 138, a state is maintained so that the light is interrupted between the light emitting section and the light receiving section of the sensor 68 due to moving of the remaining amount detection rod 45, and thus it is detected that the remaining amount of the ink is less than the threshold remaining amount using the sensor 68. Then, when the ink is newly introduced from the inlet port 73 into the ink chamber 137 in response to the detection result, the float member 181 floats so as to be separated upward from the valve body 182 as the buoyancy exceeds the first pressing force of the coil spring 184 since the liquid surface line IL of the ink inside the ink chamber 137 rises again above the threshold remaining amount time line EL.

At this time, regarding the valve body 182, which was in the closed valve position where the valve opening 192 is blocked by being pressurized downward by the pressurizing section 189 of the float member 181 which is pressed downward due to the first pressing force of the coil spring 184, there may be a state where the valve body 182 is stuck with regard to the valve opening 192 even after pressurizing from above due to the float member 181 is released in a case where the valve body 182 was in a state of being in the closed valve position for a long time. With regard to this point, in the case of the present embodiment, since the second pressing force of the coil spring 195 presses the valve body 182 which is at the closed valve position toward the open valve position which is upward, the valve body 182 becomes unstuck from the valve opening 192 and the state of being stuck is released even when, for example, the valve body 182 is temporarily stuck to the valve opening 192.

In addition, when the ink is vigorously introduced from the inlet port 73 into the ink chamber 137, there is a possibility that the flow pressure of the ink into the ink chamber 137 during introduction will also be strong. As a result, there is a concern that the thin film member 186, which forms the gas chambers 187 by blocking the opening section 185*a* of the frame body 185 in the float valve 131, may be damaged such as being harmed when directly receiving such strong introduction pressure. With regard to this point, in the case of the present embodiment, the float valve 131 is arranged inside the second ink chamber 152 which is partitioned by the partition wall 150 from the first ink chamber 151 where the inlet port 73 is formed. As a result, a situation is avoided where the ink which is introduced from the inlet port 73 falls directly from above with regard to the float valve 131.

In addition, there is a concern that the thin film member 186 of the float member 181 in the float valve 131 will be damaged by the introduction pressure even in a case where the ink is vigorously introduced from the first ink chamber 151 side to the second ink chamber 152 side via the wall linking opening 155 which is formed in the partition wall 150. With regard to this point, in the present embodiment, the float member 181 is arranged inside the second ink chamber 152 so as to be in a state of not opposing with regard to the front and back direction Y which is the introduction direction of the ink into the second ink chamber 152 via the wall linking opening 155, that is, such that the thin film member 186 is in a state along the front and back direction Y. As a result, the introduction pressure of the ink which is introduced from the wall linking opening 155 into the second ink chamber 152 operates to flow in the front and back direction Y along the film surface with regard to the thin film member 186 of the float member 181.

Here, if the thin film member 186 in the float member 181 is partially damaged due to the passing of time or the like, it is possible that several out of the plurality (four in the present embodiment) of gas chambers 187 will lose a sealed structure. Then, in this case, since the buoyancy of the float member 181 as a whole is reduced, there is also a possibility that an impediment to the valve function of the float valve 131 may be generated. However, in the present embodiment, even in a case where there is only one of the gas chambers 187, the sum of the buoyancy which is produced by the one gas chamber 187 and the second pressing force of the coil spring 195 are set to be equal to or more than the first pressing force of the coil spring 184 when the remaining amount of the ink is the threshold remaining amount or more. As a result, the float valve 131 exhibits the valve function without impediment even in a case where there is only one of the gas chambers 187.

In addition, when the float member 181 floats in the up and down direction Z along with the changes in the remaining amount of the ink inside the ink chamber 137, the float member 181 is positionally aligned in the front and back direction Y and the left and right direction X due to inserting the rod shaped section 190 into the insertion hole 198*a* of the cylindrical section 198. Then, since the convex section 188, which protrudes from both side surfaces at the front and back of the frame body 185, is inserted into the guide slot 201 of the regulating case 183, the rotation of the float member 181 centering on the rod shaped section 190 is regulated. Furthermore, the floating of the float member 181, which is in the state where the coil spring 184 is loaded, to a position which is further above the open valve position of the valve body 182 is regulated by the upper wall of the cylindrical section 198 in the regulating case 183.

Furthermore, in a case where the float member 181 is floated in the front and back direction Y and the left and right direction X inside the ink chamber 137, for example, surface contact of the thin film member 186 with the side wall 196*a* which opposes the regulating case 183 is regulated by the inner side surfaces of the plate shaped section 191 with a cross shape and the cylindrical section 198 abutting against each other in the horizontal direction. That is, in a state where the rod shaped section 190 is inserted into the insertion hole 198*a* of the cylindrical section 198, the float member 181 is set such that the gap distance between the front end edge of the plate shaped section 191 in the outward direction and the inner side surface of the cylindrical section 198 is smaller than the gap distance between the thin film member 186 and the inner surfaces of each of the left and right side walls 196*a* of the regulating case 183. Accordingly, surface contact of the thin film member 186 with both of the side walls 196*a* which oppose the thin film member 186 in the regulating case 183 is regulated by the float member 181. In this regard, the plate shaped section 191 functions as an example of a regulating abutting section which regulates the surface contact of the opposing surfaces of the regulating case 183 and the float member 181 which oppose each other in the horizontal direction.

In addition, in this case, in regard to the side walls 196*a* of the regulating case 183 and the thin film member 186 of the float member 181 which oppose each other in the left and right direction X, since a cut away section 199 with a rectangular shape is formed in the side wall 196*a* of the regulating case 183, the thin film member 186 is suppressed from being damaged by sliding on the inner surface of the side wall 196*a* of the regulating case 183.

In addition, in particular, when the float member 181 floats above the inside of the regulating case 183, there is a concern that the ink pressure inside the regulating case 183 will become higher than the ink which is pressurized from below by the float member 181. With regard to this point, in the present embodiment, in regard to higher ink pressure in this manner, the ink pressure is suppressed from increasing unnecessarily since the ink is allowed to flow out from the through hole 202 and the cut away section 199 which are formed in a plurality of locations in the regulating case 183.

According to the embodiment described above, it is possible to obtain the following effects.

(1) In the liquid holding container 21, since the inlet port 73 is formed in the first part (the first holding body section 37) which is positioned outside the printer 11 in the liquid holding body 33, it is possible to introduce ink in a state where the liquid holding body 33 is fixed to the printer 11. Accordingly, it is possible to suppress damage during the ink introduction operation and spillage of the liquid which remains inside. In addition, due to the second part (the second holding body section 38) which is positioned inside the printer 11 in the liquid holding body 33, there is a higher probability of the liquid holding body 33 being held in the printer 11 without being dropped when the fixed state is released.

(2) In the liquid holding container 21, it is possible to move the circuit substrate 75, which records the relationship information on the ink which is introduced into the liquid holding body 33 which is fixed to be unable to move, from the outside of the printer 11 to the inside of the printer 11 using the slider 34 which slides with regard to the liquid holding body 33. As a result, when the circuit substrate is moved inside the liquid consuming apparatus, it is possible to correctly transfer the relationship information on the ink which is introduced into the liquid holding body 33 to the printer 11 as long as the circuit substrate is set to be, for example, in contact with the electric terminal 78 and the like which are provided inside the liquid consuming apparatus. In addition, after the circuit substrate 75 is loaded with regard to the holder 76 which is provided in the moving part of the slider 34 while outside of the printer 11, it is possible to easily insert the circuit substrate 75 which is loaded inside the printer 11 by sliding the slider 34.

(3) Since the inlet port 73 is covered by the slider 34, it is possible to suppress entry of foreign material into the inlet port 73 without separately providing a lid for the inlet port 73.

(4) In a state where the slider 34 covers the inlet port 73, it is possible to cover or expose the inlet port 73 by displacing the opening and closing cover 74 which is provided, even without sliding the slider.

(5) In a state where the opening and closing cover 74 is displaced from the closed lid position to the open lid position, the opening and closing cover 74 is positioned at the printer 11 side with regard to the inlet port 73. Accordingly, it is possible to set the opening and closing cover 74 so as not to be an obstruction with regard to the operation when the ink is introduced to the inlet port 73.

(6) Since it is possible to stably maintain the opening and closing cover 74 at the closed lid position, it is possible to suppress the inlet port 73 from being exposed due to the opening and closing cover 74 being opened inadvertently.

(7) Since the holder 76 is positionally aligned inside the printer 11 in a direction which intersects with the movement direction of the moving part, the circuit substrate 75 which is loaded in the holder 76 is also positionally aligned inside the printer 11 with high precision. Accordingly, for example, since the electric terminal 78 which is provided in the printer 11 comes into contact with regard to the circuit substrate 75 in a state where position shifting is suppressed, the transfer of the relationship information which is recorded in the circuit substrate 75 to the printer 11 is performed with high reliability.

(8) Since the holder 76 is suppressed from moving in the sliding direction of the slider 34, the holder 76 is positionally aligned with high precision inside the printer 11 with regard to the sliding direction of the slider 34. In addition, since the circuit substrate 75 which is loaded on the holder 76 is set to an inclined state with regard to the sliding direction of the slider 34, the electric terminal 78 which is provided in the printer 11 is, for example, electrically connected with the circuit substrate 75 by being moved while rubbing the top of the circuit substrate 75 (the terminal (which include the contact section 75*b*) 75*a*). Accordingly, the reliability of the electrical conduction is increased.

(9) When the user introduces the ink into the first ink chamber 151 (the ink chamber 137) of the liquid holding body 33 via the inlet port 73, it is possible to receive the ink on the liquid receiving surface 116 even when the ink drips onto the surroundings of the inlet port 73. Then, since the liquid receiving surface 116 is inclined downward (in the direction of gravity) toward the inlet port 73, the ink which is received by the liquid receiving surface 116 is guided along the top of the liquid receiving surface 116 which is inclined up to the inlet port 73. Accordingly, when the ink is introduced into the inlet port 73 of the liquid holding container 21, it is possible to suppress the ink from traveling from the surroundings of the inlet port 73 along the outer surface of the liquid holding container 21 and fouling the surroundings even in a case where the ink drips to the surroundings of the inlet port 73.

(10) Due to the circumference wall section 117 which encloses the surroundings of the liquid receiving surface 116, it is possible to suppress the ink from leaking out to the outside of the liquid receiving surface 116 when the ink is introduced into the first ink chamber 151 of the liquid holding body 33.

(11) When the user introduces the ink into the first ink chamber 151 from the liquid introduction source 126 via the inlet port 73, it is possible to positionally align the liquid introduction source 126 by the liquid introduction source 126 abutting against the cut away groove 118 of the circumference wall section 117. Due to this, it is possible to stably introduce the ink when the user introduces the ink from the liquid introduction source 126 to the first ink chamber 151.

(12) The covering body 120 which covers the inlet port 73 is fixed to the liquid holding body 33 via the joining section 125 and the fixing section 123. As a result, when the covering body 120 is detached from the inlet port 73, it is possible to reduce concerns that the covering body 120 will be misplaced. In addition, by the covering body 120 covering the inlet port 73, it is possible to suppress the ink from evaporating from the first ink chamber 151 or foreign material from being mixed into the first ink chamber 151.

(13) It is possible to load the covering body 120 on the rear surface 74*a* of the opening and closing cover 74 which is positioned in the open lid position when introducing the ink. Due to this, when the user introduces the ink into the first ink chamber 151, it is possible to suppress the introduction operation of the ink in a state where, for example, one hand is occupied due to the covering body 120 being held in that hand.

(14) When the covering body 120 is loaded on the opening and closing cover 74 which is positioned in the open lid position, it is possible to suppress the ink from leaking out to the outside of the opening and closing cover 74 using a shielding section even when ink is attached to the covering body 120.

(15) It is possible to load the covering body 120 so as to fit inside the surface region of the rear surface 74*a* of the opening and closing cover 74 which is positioned at the open lid position. Furthermore, since the rear surface 74*a* of the opening and closing cover 74 is inclined downward (in the direction of gravity) toward the inlet port 73, it is possible to suppress ink from spreading over all of the rear surface 74*a* even when ink is attached to the covering body 120 which is loaded.

(16) Since the joining section 125 of the covering member is bent, it is possible to load with easy accommodation on the liquid receiving surface 116. In addition, compared to a case where the joining section 125 is formed in a straight line, it is possible for it to be difficult for the ink to travel along the joining section 125 in a case where ink is attached to the covering body 120 when the covering body 120 is detached from the inlet port 73.

(17) Since the fixing section 123 is fixed on the liquid receiving surface 116 at a location which is higher than the inlet port 73, it is possible for it to be difficult for ink which flows on the liquid receiving surface 116 to become attached to the fixing section 123 of the covering member 121 when introducing the ink to the liquid holding body 33. Due to this, for example, it is possible to suppress influencing of the fixing state of the fixing section 123 by the ink being attached to and solidified on the fixing section 123.

(18) When the user attempts to introduce a plurality of types of ink into a plurality of liquid holding containers 21 (the ink chambers 137), it is possible to suppress the covering body 120 which is provided to correspond to one of the liquid holding containers 21 from covering the inlet port 73 of another of the liquid holding containers 21 which is provided to the side of the one liquid holding container 21. Due to this, by covering the inlet port 73 of the other liquid holding container 21 with the covering body 120 which is provided to correspond to one of the liquid holding containers 21, it is possible to suppress the inks from being mixed inside the ink chamber 137 of the other liquid holding container 21 via the covering body 120.

(19) The wall linking opening 155 is positioned at a position which is twisted with regard to the inlet port 73 and a position which is separated from the opposing surface 153. As a result, the ink which is introduced from the inlet port 73 flows into the second ink chamber 152 via the wall linking opening 155, while it is difficult for foreign material which is mixed in from the inlet port 73 or foreign material which is generated inside the first ink chamber 151 to pass through the wall linking opening 155 compared to the ink. That is, since it is possible to easily retain the foreign material in the first ink chamber 151, ink where the mixing of foreign material is suppressed flows into the second ink chamber 152. Accordingly, even in a case where foreign material from the inlet port 73 is mixed in or a case where foreign material is generated inside, it is possible to effectively direct the ink while reducing concerns that the mixed-in foreign material will be directed from the directing port 69.

(20) Since the concave section 154, where the opposing surface 153 is recessed in the direction of gravity, is formed, it is possible for the foreign material to be deposited inside the concave section 154 even in a case where the foreign material which is accumulated in the first ink chamber 151 settles over time. That is, in a case where the ink is introduced from the inlet port 73 in a state where the foreign material is deposited inside the concave section 154, it is possible to suppress the foreign material which is deposited from rising up from inside the concave section 154 to the outside of the concave section 154.

(21) It is possible to deposit foreign material, which is mixed in or generated, in the concave section 154. Then, since the concave section 154 is provided at a position which is shifted from the inlet port 73 in a direction which intersects with the direction of gravity, it is possible to further suppress the rising up of the foreign material which is deposited in the concave section 154 when the ink is introduced from the inlet port 73.

(22) By the distance L1 between the flow path opening 162 and the partition wall 150 being smaller than the distance L2 between the upper end of the concave section 154 and the lower end of the wall linking opening 155, it is possible to form the flow path opening 162 at a position which is close to the partition wall 150. As a result, it is possible to reduce concerns that the foreign material, which passes through the wall linking opening 155 with the ink from the first ink chamber 151 to the second ink chamber 152, will settle inside the flow path opening 162 and enter the directing flow path 138.

(23) Even in a case where foreign material enters the second ink chamber 152 or in a case where foreign material is generated inside the second ink chamber 152, it is possible for the foreign material which settles in the second ink chamber 152 to be deposited on the lateral inclined rib sections 158*a* to 158*d*. Accordingly, it is possible to further suppress the mixing of the foreign material into the ink which is directed from the flow path opening 162, which is positioned more to the side in the direction of gravity than the lateral inclined rib sections 158*a* to 158*d*, to the directing flow path 138.

(24) Since the lateral inclined rib sections 158*a* to 158*d* extend along the direction which intersects with regard to the up and down direction Z and the front and back direction Y, it is possible to gather the foreign material, which is deposited on the lateral inclined rib sections 158*a* to 158*d* along with the reduction of the ink which is accommodated in the second ink chamber 152, in one direction.

(25) There are concerns that, for example, when the foreign material is deposited on the float member 181, the float valve 131, which displaces the valve body 182 using the float member 181 which floats according to the changes in the remaining amount of the ink, will malfunction due to the weight of the foreign material which is deposited. In this regard, since it is possible to deposit the foreign material on the lateral inclined rib sections 158*a* to 158*d* which are provided more to the direction against gravity than the float valve 131, it is possible to suppress foreign material which settles in the second ink chamber 152 from being deposited on the float member 181.

(26) It is possible for the foreign material to fall so as to avoid the float valve 131 even in a case where the foreign material, which settles on the third lateral inclined rib section 158*c* and the fourth lateral inclined rib section 158*d* along with the changes in the remaining amount of the ink which is accommodated in the second ink chamber 152, moves and falls from the third lateral inclined rib section 158*c* and the fourth lateral inclined rib section 158*d*.

(27) It is possible for the ink which is directed from the flow path opening 162 to flow to the float valve 131 side after passing through the filter 166. That is, for example, out of the foreign material which is mixed in the ink inside the first ink chamber 151 from the inlet port 73, the foreign material with a comparatively large size is accumulated in the first ink chamber 151 and deposited on the lateral inclined rib sections 158*a* to 158*d* in the second ink chamber 152. As a result, since the foreign material, which is mixed into the ink which is directed from the flow path opening 162 to the directing flow path 138, is comparatively small in size, clogging of the directing flow path 138 is suppressed compared to the case where foreign material which is large in size enters even in a case where, for example, the foreign material enters from the flow path opening 162. Furthermore, by the ink passing through the filter 166 which is provided in the directing flow path 138, it is possible to further reduce the foreign material which is mixed in the ink which is directed from the directing port 69.

(28) Since the area of the wall linking opening 155 is smaller than the area of the inlet port 73, it is possible to reduce concerns that the foreign material will rise over the wall linking opening 155 and enter the second ink chamber 152 in a case where the foreign material with a large size is mixed in from the inlet port 73.

(29) The bubbles in the ink do not easily accumulate in the portion which is bent in the directing flow path 138. In this regard, the bubbles which are positioned in the bent flow path section 163 are directed to the directing port 69 side via the inclined flow path section 165. Accordingly, since it is possible to reduce concerns that the bubbles which are accumulated in the bent flow path section 163 will, for example, become large and block the directing flow path 138, it is possible to direct the ink while reducing the effects of the bubbles.

(30) By passing through the filter 166 before the ink flows up to the bent flow path section 163 where it is easy for bubbles to accumulate, it is possible for bubbles which are already generated to be captured in advance.

(31) Since the bubbles which are generated in the ink chamber 137 move to the upper side in the direction of gravity, it is possible to reduce concerns that the bubbles will enter the directing flow path 138 from the flow path opening 162 by opening the flow path opening 162 to the bottom surface 152*a*.

(32) It is possible to reinforce the ink chamber 137 by forming the lateral inclined rib sections 158*a* to 158*d*. Furthermore, since the lateral inclined rib sections 158*a* to 158*d* extend along the direction which intersects with the horizontal direction, it is possible to move the bubbles along the lateral inclined rib sections 158*a* to 158*d* in a case where bubbles are generated in the ink which is accommodated in the ink chamber 137. That is, it is possible to reduce concerns that the bubbles will be captured by the lateral inclined rib sections 158*a* to 158*d*.

(33) It is possible for the bottom surface 152*a* of the ink chamber 137 to be inclined along the inclined flow path section 165. That is, since the inclined flow path section 165 is formed so that the flow path opening 162 side is lower, it is possible to gather the ink inside the ink chamber 137 at the flow path opening 162 side.

(34) Since the cross sectional area of the inclined flow path section 165 is large, it is possible to reduce concerns that the inclined flow path section 165 will be blocked by the bubbles which are generated in the bent flow path section 163. (35) Even in a case where bubbles are generated in the wall linking opening 155, it is possible to reduce concerns that bubbles will be accumulated in the wall linking opening 155 since the upper surface 155*c* of the side in the direction against gravity is inclined.

(36) Due to the wall ventilation opening 156 which is formed in the partition wall 150, it is possible to reduce the difference in the pressures between the first ink chamber 151 and the second ink chamber 152. Furthermore, since the wall ventilation opening 156 which is formed in the partition wall 150 is formed to be closer to the ceiling surface 137*b* than the rib ventilation opening 160 which is formed in the intersecting rib sections 157*a* to 157*i*, it is possible to reduce concerns that the ink inside the second ink chamber 152 will enter the first ink chamber 151 from the wall ventilation opening 156.

(37) By forming the position aligning ridge 141, it is possible to suppress shifting of the air flow path forming film 147 and to easily adhere the air flow path forming film 147 onto the meandering groove 142 and 143.

(38) By attaching the filter 166 to the first flow path forming concave section 168*a* which is formed on the lower surface 40 of the holding body case 130, it is possible to easily replace the filter 166.

(39) Regarding the float valve 131 which is arranged inside the second ink chamber 152 of the liquid holding body 33, the thin film member 186 which blocks the opening section 185*a* of the gas chambers 187 does not directly receive inflow pressure of the ink which flows inside the second ink chamber 152 due to the introduction from the inlet port 73. That is, the inflow pressure of the ink operates along the film surface with regard to the thin film member 186. As a result, even in a case where the ink from outside is vigorously introduced inside the first ink chamber 151 of the ink chamber 137 via the inlet port 73, it is possible for the inflow pressure of the ink to be suppressed from strongly operating in the direction which pressurizes the thin film member 186 with regard to the thin film member 186 of the float member 181 inside the second ink chamber 152 by being passed through the first ink chamber 151. Accordingly, it is possible to maintain a suitable valve operation without the float valve 131 which is arranged inside being damaged due to the inflow pressure of the ink which is introduced from the outside.

(40) Since the float valve 131 is arranged in the second ink chamber 152 which is partitioned from the first ink chamber 151 where the inlet port 73 is formed by the partition wall 150, it is possible to avoid the ink which is introduced from the outside via the inlet port 73 directly falling onto the float valve 131, and in this regard, it is possible to further reduce concerns that the float valve 131 will be damaged.

(41) Even supposing that the sealed state is broken due to damage or the like to one of the gas chambers 187 out of the plurality (four as an example) of gas chambers 187, it is possible to effectively maintain the function of the float valve 131 as long as the volume of the gas chambers 187 is set such that the total volume of the other gas chambers 187 which remain generate the desired buoyancy in the float member 181.

(42) In particular, in a case where the remaining amount of the ink is equal to or more than the threshold remaining amount due to the introduction of the ink via the inlet port 73 from a state where the remaining amount of the ink is less than the threshold remaining amount and the valve body 182 is at the closed valve position for a long period of time, it is possible to suppress a state where the valve body 182 is stuck at the closed valve position and it is possible to quickly displace the valve body 182 from the closed valve position to the open valve position.

(43) It is possible to reduce concerns that movement resistance will be generated by the sliding in the surface contact state with regard to the annular wall section 196 of the regulating case 183 when the float member 181 floats in the up and down direction Z while suppressing direct application of the inflow pressure of the ink, which flows into the second ink chamber 152, to the float member 181 using the annular wall section 196 of the regulating case 183.

(44) It is possible to reduce concerns that the thin film member 186 will be damaged by sliding against the annular wall section 196 of the regulating case 183 when the float member 181 floats in the up and down direction.

(45) Since the ink is allowed to flow between the inner side and the outer side of the annular wall section 196 of the regulating case 183 via the through hole 202 in a case where the float member 181 floats in the up and down direction Z, it is possible to ensure a smooth buoyancy state of the float member 181 according to changes in the remaining amount of the ink.

(46) Since it is possible to reduce concerns that the opposing surfaces of the regulating case 183 and the float member 181 which oppose each other in the horizontal direction, that is, the thin film member 186 and the side wall 196*a*, will be fixed due to the surface tension of the ink, it is possible to effectively maintain a suitable valve operation of the float valve 131.

(47) Since it is possible to operate the valve body 182 to be displaced between the open valve position and the closed valve position simply by pressurizing the float member 181 with small strokes with regard to the valve body 182, it is possible to contribute to the compactness of the float valve 131.

(48) Since the liquid holding container 21 is configured to have a first part which is positioned outside the printer 11 and a second part which is inserted into the printer 11 so that the bottom section of the first part where the inlet port 73 is formed is lower than the bottom section of the second part, it is possible to prevent a problem such that the size of the entirety of the printer 11 which includes the liquid holding container 21 is larger in the horizontal direction compared to, for example, a case of a configuration where the bottom surface of the first part and the bottom surface of the second part are the same height and the first part extends in the horizontal direction. In addition, when the first part which is positioned outside the printer 11 extends in the horizontal direction, a force which is applied to the second part is increased to the extent that the distance from the second part which is inserted in the printer 11 is lengthened, and there is a possibility that the second part will be damaged or the like compared to, for example, a case where the bottom section of the first part is lower than the bottom section of the second part (a case where the first part is extended in the direction of gravity). In addition, for the same reason, there is a possibility that, for example, the printer 11 will be inclined to the first part side. Due to this, it is possible to reduce the possibility that the problems of damage to the second part, inclining of the printer 11, and the like will occur by the bottom section of the first part being lower than the bottom section of the second part.

(49) Since the first part with a large volume compared to the second part is positioned outside the printer 11, it is easy for the user to grasp the remaining amount of ink in the liquid holding container 21, and it is possible to reduce the possibility that problems will occur such that printing goes ahead regardless of whether the ink is overflowing from the liquid holding container 21 due to excessive introduction of ink or the remaining amount of ink being small compared to a case where the second part with a small volume compared to the first part is positioned outside the printer 11.

(50) Since the height of the ceiling surface of the first part and the height of the ceiling surface of the second part are equal, it is possible to achieve an increase in the volume of the liquid holding container 21 and to prevent the position of the inlet port being raised along with an increase in the volume of the liquid holding container 21. When the height of the inlet port 73 is raised, it is possible to prevent problems such as that it is necessary for the container where the ink for introduction is accommodated to be lifted up to the height of the inlet port 73 when the user introduces the ink.

(51) Since the lengths of the first part and the second part in the short side direction are equal, it is easy for the user to estimate the remaining amount in the second part which is inserted into the printer 11 and where it is difficult to grasp the remaining amount of ink in the inner section of the second part and it is possible to reduce the possibility that problems will occur such that printing goes ahead regardless of whether the ink is overflowing from the liquid holding container 21 due to excessive introduction of ink or the remaining amount of ink is small.

(52) Since the outlet port 52 which is connected to the printer 11 is provided in the second part which is inserted in the printer 11, it is possible to reduce the possibility of problems will occur such as that the connection between the printer 11 and the outlet port 52 may be disconnected compared to a case where the outlet port 52 is provided in the first part which is positioned outside the printer 11. In detail, since the first part is positioned outside the printer 11, there are cases where an impact is directly applied to the first part due to the user placing an object on the upper section of the first part and there being an accidental collision or the like. In this case, when the outlet port 52 is provided in the first part, it is possible that the connection between the printer 11 and the outlet port 52 may be disconnected due to such an impact. On the other hand, when the outlet port 52 is provided in the second part, impacts are indirectly applied to the second part, but it is possible to weaken the impacts which are received compared to a case where the outlet port 52 is provided in the first part.

(53) Since the fixed section 37*a* which is an engaging section which engages with the printer 11 is provided on the first surface of the insertion direction side of the liquid holding container 21 in the first part, it is possible to prevent an increase in the size of the printer 11 compared to a case where the fixed section 37*a* is provided on the second surface which opposes the first surface. In addition, since the first surface is positioned on the insertion direction side, it is possible to reduce the possibility that problems will occur such that the fixed section 37*a* will inhibit the user from observing the remaining amount inside the liquid holding container 21 from the outside.

(54) Since the inlet port 73 is formed in the first part at a position which is closer to the second surface, which opposes the first surface, than the first surface of the second part side, it is possible to reduce the possibility that problems will occur such that the ink will be attached to and foul the printer 11 even in a case where ink accidentally overflows to the outside of the inlet port 73 when the user introduces the ink. In addition, since the first surface is the surface which is close to the printer 11 compared to the second surface, it is possible to reduce the possibility that problems will occur such that it is not possible for the user to recognize the state of the introduction due to the printer 11 by providing the inlet port at a position which is close to the second surface.

(55) Since the atmosphere linking port 140 is formed in the first part between the inlet port 73 and the second part, it is possible to reduce the possibility that problems will occur such that, when the user introduces ink from an ink refill container where ink for introduction is accommodated, ink which drips downward along a portion of the ink refill container which may be a blind spot of the user enters the atmosphere linking port 140 and blocks the atmosphere linking port 140.

(56) Since the second part of the liquid holding container 21 and the printer 11 are connected so as to be able to swing, it is possible to maintain a connection even in a case where force is applied to the first part when the ink is introduced, and it is possible to reduce the possibility that problems will occur such that the connection will be disconnected.

Here, the embodiments described above may be changed to the following other embodiments.

In the embodiment described above, the second part (the portion of the liquid holding container 21 which is positioned inside the apparatus body 14) may be a portion which comes into contact with the guiding groove 84 which is provided in the mounting section 31 in the liquid holding container 21. Accordingly, the first part (the portion of the liquid holding container 21 which is positioned outside the apparatus body 14) may be a portion of the liquid holding container 21 excluding the second part or a portion, which does not contact the guiding groove 84 which is provided in the mounting section 31, in the liquid holding container 21.

In the embodiment described above, it is possible for the attached member 50 to swing with regard to the liquid holding body 33, but it is sufficient if the liquid holding body 33 and the printer 11 are connected so as to be able to swing without being limited to the attached member, and the ability to swing is not necessarily limited to the attached member 50.

In the embodiment described above, the holder 76 may be provided in the slider 34 by being inserted in the direction along the sliding direction with regard to the liquid holding body 33 of the slider 34 with regard to the slider 34, that is, from the direction along the longitudinal direction. In addition, the circuit substrate 75 which is attached to the holder 76 may be loaded on the holder 76 in, for example, a state of being parallel to the sliding direction or a state of intersecting with the sliding direction instead of being in a state of being inclined with regard to the sliding direction of the slider 34.

In the embodiment described above, when the moving part of the slider 34 is moved inside the printer 11, the groove shaped section 107 which is an example of a position aligning shaped section which is positionally aligned inside the printer 11 need not be provided in the holder 76. The position aligning shaped section is not necessary in a case where, for example, the slider 34 is inserted into the mounting section 31 in a state of being positionally aligned with regard to the communication section 77.

In the embodiment described above, the engaging section (the groove section 112) with the opening and closing cover 74 need not be provided in the slider 34. The engaging section is not necessary in a case where, for example, the shaft receiving section 90 of the opening and closing cover 74 is configured to engage in a state of being tightly fitted to the rotation shaft 89 of the slider 34 since it is possible to obtain a rotation load due to the tight fitting.

In the embodiment described above, the opening and closing cover 74 need not be configured to rotate with the axis which extends along the short side direction of the liquid holding body 33 as the center of rotation. For example, the opening and closing cover 74 may have a configuration which is displaced from the closed lid position to the open lid position by moving in parallel with regard to the slider 34 in the longitudinal direction.

In the embodiment described above, the opening and closing cover 74 need not be provided on the slider 34 which is provided in a state of covering the inlet port 73. In this case, it is sufficient if the inlet port 73 of the ink is exposed by taking out the slider 34 from the printer 11 (the mounting section 31).

In the embodiment described above, the inlet port 73 need not be provided on the upper surface 39 which is the side in direction against gravity in the liquid holding body 33. For example, the inlet port 73 may be provided on the side surface which is positioned at the horizontal direction side. In addition, the slider 34 need not be provided in a state where the inlet port 73 is covered. In this case, the inlet port 73 may be configured to be covered by a member which is separate from the slider 34.

In the embodiment described above, the holder 76 is not limited to a configuration of being attached to the holder attachment section 86 of the slider 34. For example, the holder 76 may be configured to be integrally formed with a portion of the slider 34. In addition, the circuit substrate 75 which is supported by the holder 76 may be a flexible circuit board. Furthermore, the circuit substrate 75 may be a combination of a flexible material and a substrate. That is, the circuit substrate 75 has the meaning of both of a substrate where a circuit, a terminal, a memory, and the like are structurally separate and a substrate where a circuit, a terminal, a memory, and the like are integrally provided.

In the embodiment described above, the medium is not limited to the paper S, and may be a member with a plate shape where a metal plate, a resin plate, cloth, or the like is set as the material. That is, it is possible to adopt any medium as long as it is a member where it is possible to perform recording (printing) using the liquid which is ejected by the liquid ejecting head 24.

In the embodiment described above, the liquid consuming apparatus is not limited to the printer 11 which is a serial printer where the liquid ejecting head 24 moves reciprocally along with the carriage 25, and the printer 11 may be a line head printer which is able to print over the maximum width range of the paper with the liquid ejecting head 24 which remains fixed.

In the embodiment described above, it is sufficient if the covering member 121 is provided with at least the covering body 120.

In the embodiment described above, an absorbing member which is able to absorb ink may be arranged on the rear surface 74*a* of the opening and closing cover 74.

In the embodiment described above, the joining section 125 need not be a shape which is folded back a plurality of times on the liquid receiving surface 116. For example, the joining section 125 may be formed in an L-shape in a planar view by bending a portion of the joining section 125 only once. In addition, the joining section 125 may be formed as a chain or the like made of metal and loaded on the liquid receiving surface 116.

In the embodiment described above, the rear surface 74*a* of the opening and closing cover 74 need not be a surface with a downward gradient toward the inlet port 73 when the opening and closing cover 74 is positioned at the open lid position. In this case, it is desirable that the ink absorbing material described above be arranged at a portion where the covering body 120 is loaded in the rear surface 74*a* of the opening and closing cover 74.

In the embodiment described above, the covering body 120 of the covering member 121 need not be loaded on the rear surface 74*a* of the opening and closing cover 74.

In the embodiment described above, the cut away groove 118 may be provided at a position at the vicinity of the inlet port 73 other than the circumference wall section 117. For example, the cut away groove 118 may be formed at the opening edge 73*a* of the inlet port 73. In addition, instead of the cut away groove 118 as the concave section, a convex section which protrudes upward from the circumference wall section 117 may be provided. Here, in this case, it is desirable to provide two convex sections which are able to positionally align the liquid introduction source 126 from both sides.

In the embodiment described above, the area of the wall linking opening 155 may be the same size as the area of the inlet port 73. In addition, the area of the wall linking opening 155 may be larger than the area of the inlet port 73.

Figure 30:
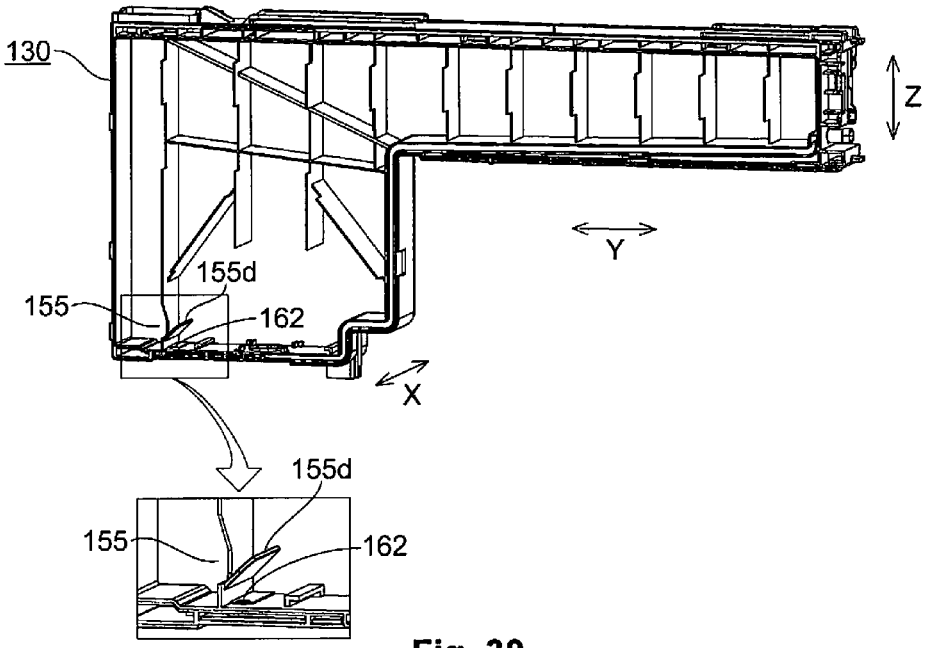
FIG. 30 is a perspective diagram and an enlarged diagram illustrating an example of a liquid holding section which is different to the liquid holding section shown in FIG. 13.

In addition, as shown in FIG. 30, a protrusion 155*d* which extends in the insertion direction between the wall linking opening 155 and the flow path opening 162 may be provided inside the second ink chamber 152. Due to this, even in a case where it is assumed that foreign material is generated or mixed inside the liquid holding container 21, it is possible to prevent the foreign material from reaching the flow path opening 162.

In the embodiment described above, a configuration may be adopted where the filter 166 is not provided. In addition, the filter 166 may be provided in the second ink chamber 152 so as to cover the flow path opening 162.

In the embodiment described above, a configuration may be adopted where the float valve 131 is not provided.

In the embodiment described above, a configuration may be adopted where the lateral inclined rib sections 158*a* to 158*d* are not provided. In addition, a configuration where the lateral inclined rib sections 158*a* to 158*d* are separately provided may be adopted, and it is possible to arbitrarily select which of the lateral inclined rib sections 158*a* to 158*d* are provided. For example, a configuration may be adopted where only one of the lateral inclined rib sections out of the lateral inclined rib sections 158*a* to 158*d* is provided. In addition, for example, a configuration may be adopted where any two of the lateral inclined rib sections such as the third lateral inclined rib section 158*c* and the fourth lateral inclined rib section 158*d* are provided or any three of the lateral inclined rib sections such as the first to third lateral inclined rib sections 158*a* to 158*c* are provided.

In the embodiment described above, the lateral inclined rib sections 158*a* to 158*d* may be partially bent or curved instead of simply extending along one direction. That is, for example, the lateral inclined rib sections 158*a* to 158*d* may combine a portion which extends along the direction of gravity and a portion which intersects with the direction of gravity.

In the embodiment described above, the third lateral inclined rib section 158*c* and the fourth lateral inclined rib section 158*d* need not be line symmetric. That is, for example, the third lateral inclined rib section 158*c* and the fourth lateral inclined rib section 158*d* may be formed such that one is shifted in the up and down direction Z. In addition, the axis which is the reference of line symmetry between the third lateral inclined rib section 158*c* and the fourth lateral inclined rib section 158*d* may pass through the float valve 131 at any position as long as it is along the direction of gravity. Then, the third lateral inclined rib section 158*c* and the fourth lateral inclined rib section 158*d* may be partially line symmetric with the axis as a reference.

In the embodiment described above, the lateral inclined rib sections 158*a* to 158*d* may be formed so as to extend along the front and back direction Y. In addition, the lateral inclined rib sections 158*a* to 158*d* may be formed so as to extend in the direction which intersects with the left and right direction X.

In the embodiment described above, the lateral inclined rib sections 158*a* to 158*d* may be provided at a position which is shifted from the flow path opening 162 in the up and down direction Z.

In the embodiment described above, the flow path opening 162 may be formed at a position other than the bottom surface 152*a*. For example, the flow path opening may be formed in the side wall 130*b*. In addition, the flow path opening 162 may be formed at a position which is separated from the partition wall 150. That is, the distance L1 may be longer than the distance L2.

In the embodiment described above, a configuration may be adopted where the concave section 154 is not provided on the opposing surface 153. In addition, the concave section 154 may be formed so as to be recessed in a direction which intersects with the direction of gravity. Furthermore, the concave section 154 may be formed so as to match the introduction virtual line M. That is, the concave section 154 may be formed at a position on the direction of gravity side of the inlet port 73. Here, the concave section 154 and the inlet port 73 have different shapes in a top surface view, and the size of the concave section 154 is larger than the inlet port 73 in the left and right direction X. As a result, even when the concave section 154 is formed at a position on the direction of gravity side of the inlet port 73, a portion of the concave section 154 is positioned at a position which is shifted from the inlet port 73 in a direction which intersects with the direction of gravity. Therefore, the concave section 154 may be formed to be smaller than the inlet port 73 in the top surface view, and in addition, the inlet port 73 and the concave section 154 may be formed with the same shape.

In the embodiment described above, the liquid holding container 21 may have a configuration where the slider 34 is not provided. That is, the liquid holding container 21 may be configured only with the liquid holding body 33.

In the embodiment described above, the partition wall 150 may be provided so as to intersect with the up and down direction Z.

In the embodiment described above, the holding body case 130 may be configured so that the intersecting rib sections 157*a* to 157*i* are not provided.

In the embodiment described above, the holding body case 130 may be configured so that the partition wall 150 is not provided.

In the embodiment described above, the upper surface 155*c* of the wall linking opening 155 may be formed along the horizontal direction.

In the embodiment described above, the cross sectional area of the inclined flow path section 165 may be the same size as the cross sectional area of the joining flow path section 164. In addition, the cross sectional area of the inclined flow path section 165 may be larger than the cross sectional area of the bent flow path section 163. In addition, the cross sectional area of the inclined flow path section 165 may be smaller than the cross sectional area of the joining flow path section 164 and the cross section area of the bent flow path section 163.

In the embodiment described above, the inclined flow path section 165 may be provided at a position which is shifted from the lower side position of the ink chamber 137 in the direction of gravity. That is, for example, the inclined flow path section 165 may be provided so as to be adjacent to the ink chamber 137 via the side wall 130*b*.

In the embodiment described above, the valve body 182 which is fixed to the bottom surface 152*a* of the second ink chamber 152 is omitted, and the pressurizing section 189 which protrudes vertically downward from the lower surface of the float member 181 may fulfill a function as a valve body which is able to close off the valve opening 192 when the pressurizing section 189 is moved downward.

In the embodiment described above, the plate shaped section 191 which functions as an example of a regulating abutting section with regard to the regulating case 183 in the float member 181 may have a cross sectional shape which is other than a cross shape. In other words, it is possible to arbitrarily change the shape of the float member 181 as long as there is a relationship where the gap distance between the part which configures the regulating abutting section and the inner surface of the cylindrical section 198 is smaller than the gap distance between the thin film member 186 and the inner surface of the annular wall section 196.

In the embodiment described above, the shape of the through hole 202 in the regulating case 183 is not limited to a rectangular shape and may be a circular shape, a triangular shape, or a cut away shape. In other words, it is possible to arbitrarily change the shape of the through hole 202 as long as the through hole 202 has a shape which allows the passage of ink in a case where the float member 181 is floating.

In the embodiment described above, the cut away section 199 which is formed in the side wall 196*a* along the front and back direction Y of the regulating case 183 may be omitted. Alternatively, the cut away section 199 may be formed in the side walls 196*b* along the left and right direction X. Also in this case, in addition to allowing the flow of ink by linking the inside and outside of the regulating case 183, it is possible for the cut away section 199 to fulfill a function of reducing concerns that sliding will occur when the float member 181 is floating.

In the embodiment described above, the coil spring 195, which has the second pressing force which presses the valve body 182 toward the valve open position above, may be omitted.

In the embodiment described above, it is sufficient if there is at least one gas chamber 187 in the float member 181. That is, the number of gas chambers 187 is not necessarily limited to four, and it is sufficient if the number of gas chambers 187 is at least one or more, such as two, three, or five.

In the embodiment described above, the partition wall 150, which partitions the ink chamber 137 into the first ink chamber 151 and the second ink chamber 152, may be omitted. That is, the ink chamber 137 of the liquid holding body 33 may be configured as a single ink chamber, with the float valve 131 arranged inside the single ink chamber 137.

In the embodiment described above, the shape of the regulating case 183 is not limited to a box shape, and it is possible to arbitrarily change the shape of the regulating case 183 as long as the regulating case 183 has the annular wall section 196 which encloses the float member 181 so as to protect the float member 181 with regard to the inflow pressure of the ink which flows into the second ink chamber 152.

In the embodiment described above, the regulating member may have a frame body shape instead of a box shape such as the regulating case 183. In other words, in a case where the float member 181 floats upward along with the rising of the liquid surface of the ink, it is possible to arbitrarily change the shape of the regulating member as long as the regulating member has a structure which abuts against and regulates the float member 181 so as to stop the floating upward at a position which is lower than the ceiling of the ink chamber 137.

In the embodiment described above, the thin film member 186 which forms the gas chambers 187 by blocking the opening section 185*a* of the float member 181 may be, for example, a thin sheet made of resin, a plate, or the like other than the film.

Figure 31:
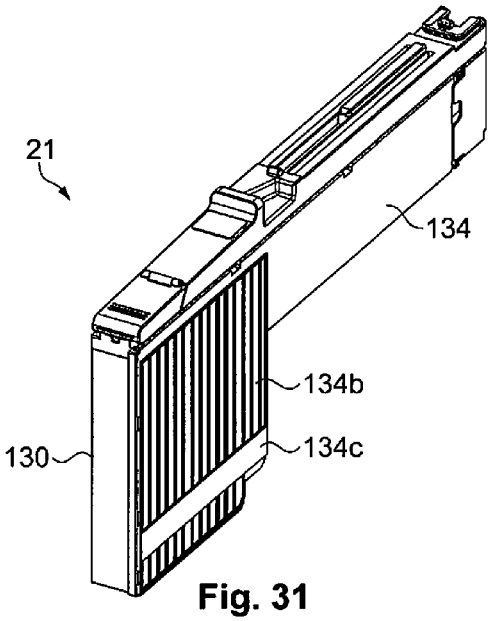
FIG. 31 is a perspective diagram illustrating an example of a liquid holding container which is different to the liquid holding container shown in FIG. 3.

In the embodiment described above, the cover 134 made of resin does not have any irregularities on the surface as in FIG. 13, but a reinforcing rib 134*b* which has strip shapes on the surface may be formed and a reinforcing plate 134*c* may be arranged at the inner side of the reinforcing rib 134*b* as shown in FIG. 31. Due to this, it is possible to prevent the cover 134 made of resin from being detached from the liquid holding container due to the water head pressure even in a case where the capacity of the liquid holding container is increased. In addition, it is possible to prevent the film 133 which is positioned on the inner side of the resin cover 134 made of resin and is adhered to the holding body case 130 from being peeled off from the holding body case 130 by the water head pressure. Here, the reinforcing rib 134*b* may have a grid shape instead of a strip shape. In addition, the reinforcing plate 134*c* may be outside and not inside the cover 134 made of resin. Examples of the material of the reinforcing plate 134*c* include metals and the like (for example, SUS).

In the embodiment described above, other than a state where the liquid holding container 21 is fixed to be unable to move with regard to the printer 11 by being mounted on the mounting section 31 of the printer 11, the posture state of the liquid holding container 21 during use may be a form of use where the liquid is supplied using a tube so as to be able to be supplied in a state where the liquid holding container 21 is loaded at the side of the printer 11.

In the embodiment described above, the ink was described, but the inks which are able to be used in the printer 11 according to the present invention are not particularly limited and examples include aqueous inks where the water content is 10% or more and non-aqueous inks where the water content is less than 10%. Here, the aqueous inks and the non-aqueous inks described above may include a photo-polymerizable compound. The components which are included in each of the inks are not particularly limited and various coloring materials, various solvents, and the like may be included.

The coloring materials are not particularly limited and may be either pigments or dyes. Here, the pigments refers to pigments which are insoluble or poorly soluble in either water or organic solvents, and for example, examples include compounds which are classified as "Pigments" in the color index. On the other hand, the dyes refer to dyes which dissolve in water or organic solvents and water-soluble dyes and oil-soluble dyes are known. Examples of water -soluble dyes include compounds which are classified in the color index as "Acid Dyes", "Basic Dyes", "Direct Dyes", "Food Dyes", and "Reactive Dyes". Examples of the oil -soluble dyes include compounds which are classified in the color index as "Solvent Dyes", "Disperse Dyes", and "Vat Dyes". The coloring material may be appropriately selected depending on the purpose, and for example, in a case where it is desired to obtain recorded material with excellent resistance to light, it is sufficient to select a pigment, and in a case where it is desired to record on hydrophobic material such as polyester or acetate, it is sufficient to select an oil-soluble dye. The solvents are not particularly limited, and it is possible to use water or an organic solvent. Examples of the organic solvents include heterocyclic compounds such as γ-butyrolactone and 2-pyrrolidone; glycol ethers such as triethylene glycol monomethyl ether, diethylene glycol monohexyl ether, and tetraethylene glycol dimethyl ether; alkane diols such as 1,2-hexane diol, 1,6-hexane diol, and 1,3-ethyl-1,3-hexane diol; fatty acid esters such as oleic acid ethyl; and the like. The solvent may be appropriately selected depending on the purpose, and for example, if the purpose is record onto a vinyl chloride sheet or the like which has no ink absorption, it is sufficient to select a non-aqueous ink, and if the purpose is to record onto normal paper or the like, it is sufficient to select an aqueous ink. In addition, in a case where there is a desire to suppress clogging in the nozzle opening of the head, it is sufficient to select a polyhydric alcohol, and in a case where there is a desire to suppress beading, it is sufficient to select an organic solvent where the Hansen solubility parameter is 26.0 ($J/cm^3$) 0.5 or less. Here, in a case where there is more than one purpose, it is preferable to use a combination of a plurality of solvents. In a case where printing is performed for a long time, peeling of the nozzle plate may occur due to the interaction of the components which are included in the ink and the adhesive, but this is thought to be caused by the adhesive melting or swelling due to compounds which has high hydrophobicity.

Examples of the compound which has high hydrophobicity include the oil-soluble dyes described above, organic solvents with a Hansen solubility parameter of 21.0 or less, photopolymerizable compounds, and the like. With the printer 11 according to the present invention, it is possible to perform printing for a long time even if an ink which includes a compound which has high hydrophobicity is used since the problems described above are suppressed.

Here, it is possible to increase the affinity of bubbles by lowering the surface tension of the ink and increase the bubble discharge property. It is preferable that the surface tension of the ink be 20 to 30 mN/m or less, and more preferably 21 to 25 mN/m.

In the embodiment described above, the liquid holding container and the liquid introduction source were described, but it is possible for both to be referred to as a liquid holding container.

In the embodiment described above, the liquid consuming apparatus may be a liquid ejecting apparatus which ejects or discharges other liquids other than ink. Here, the states of the liquid, which is discharged from the liquid ejecting apparatus as droplets in minute amounts, include droplets with a granular shape, a tear shape, and a trailing shape. In addition, here, it is sufficient if the liquids are material which is able to be ejected from the liquid ejecting apparatus. For example, it is sufficient if the state is when the substance is in the liquid phase, and the substance may be a body with a fluid form such as a liquid body with high or low viscosity, a sol, a gel water, another inorganic solvent, an organic solvent, a solution, a liquid resin, or a liquid metal (a metal melt). In addition, not only liquid as one state of matter, but states are included where the particles of the functional material which is formed of solid matter such as pigments, metal particles, or the like are dissolved, dispersed, or mixed into a solvent, or the like. Typical examples of the liquids include inks, liquid crystals, or the like as described in the embodiments described above. Here, the inks include various types of liquid compositions such as general aqueous ink, oil-based inks, gel inks, and hot melt inks. Specific examples of the liquid ejecting apparatus include, for example, liquid crystal displays, EL (electroluminescence) displays, surface-emitting displays, terminals (which include abutting sections) which are used in the manufacturing or the like of color filters, or liquid ejecting apparatuses which eject liquids which include materials such as material or coloring materials in a dispersed or dissolved form. In addition, the liquid ejecting apparatus may be a liquid ejecting apparatus which ejects bio -organic material which is used in biochip manufacturing, a liquid ejecting apparatus which is used as a precision pipette and which ejects liquids which are samples, a printing apparatus, a micro dispenser, or the like. Furthermore, the liquid ejecting apparatus may be a liquid ejecting apparatus which ejects a lubricant in a pin point manner in precision machines such as watches or cameras, or a liquid ejecting apparatus which ejects a transparent resin liquid such as a UV -curing resin onto a substrate in order to form a minute hemispherical lens (an optical lens) or the like which is used in optical communication elements or the like. In addition, the liquid ejecting apparatus may be a liquid ejecting apparatus which ejects an etching liquid such as an acid or an alkali in order to etch a substrate or the like.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid holding container adapted to hold liquid to be supplied to a liquid consuming apparatus, the liquid holding container comprising:

a liquid holding body including a first part and a second part configured to accommodate the liquid therein, at least a portion of the first part being positioned to be outside the liquid consuming apparatus in a state where the liquid holding container is mounted in the liquid consuming apparatus, and at least a portion of the second part being inserted into the liquid consuming apparatus in the state where the liquid holding container is mounted in the liquid consuming apparatus; and an inlet port through which the liquid is introduced to the liquid holding body, the inlet port being accessible from outside of the liquid holding container, wherein at least a portion of a bottom section of the first part is lower than at least a portion of a bottom section of the second part.

2. The liquid holding container according to claim 1, wherein a volume of the first part is larger than a volume of the second part.

3. The liquid holding container according to claim 2, wherein a height of an upper section of the first part and a height of an upper section of the second part are equal.

4. The liquid holding container according to claim 3, wherein a length of the first part in a short side direction and a length of the second part in a short side direction are equal.

5. The liquid holding container according to claim 4, further comprising an outlet port configured to be connected with the liquid consuming apparatus and where the liquid flows out to the liquid consuming apparatus, wherein the outlet port is provided in the second part.

6. The liquid holding container according to claim 5, further comprising an engaging section configured to engage with the liquid consuming apparatus, wherein the first part is configured by at least a first surface on an insertion direction side of the liquid holding container and a second surface which opposes the first surface, and the engaging section is provided on the first surface.

7. The liquid holding container according to claim 6, wherein the first part is configured by at least an upper section, a first surface on a second part side, and a second surface which opposes the first surface, and the inlet port is formed in the first part at a position closer to the second surface than the first surface.

8. The liquid holding container according to claim 7, further comprising an atmosphere linking port that links at least one of the first part and the second part to the outside, wherein the atmosphere linking port is formed in the first part between the inlet port and the second part.

9. The liquid holding container according to claim 8, wherein the second part is configured to be connected with the liquid consuming apparatus so as to be able to swing.

10. A liquid consuming apparatus mounted with the liquid holding container according to claim 9.

11. A liquid consuming apparatus adapted to be mounted with a liquid holding container comprising:

a liquid holding body including a first part and a second part configured to accommodate the liquid therein, at least a portion of the first part being positioned to be outside the liquid consuming apparatus in a state where the liquid holding container is mounted in the liquid consuming apparatus, at least a portion of the second part being inserted into the liquid consuming apparatus in the state where the liquid holding container is mounted in the liquid consuming apparatus, and an inlet port through which the liquid is introduced to the liquid holding body, the inlet port being accessible from outside of the liquid holding container, at least a portion of a bottom section of the first part is lower than at least a portion of a bottom section of the second part.

12. The liquid consuming apparatus according to claim 11, wherein a volume of the first part is larger than a volume of the second part.

13. The liquid consuming apparatus according to claim 12, wherein a height of an upper section of the first part and a height of an upper section of the second part are equal.

14. The liquid consuming apparatus according to claim 13, wherein a length of the first part in a short side direction and a length of the second part in a short side direction are equal.

15. The liquid consuming apparatus according to claim 14, wherein the liquid holding container has an outlet port connected with the liquid consuming apparatus and where the liquid flows out to the liquid consuming apparatus, and the outlet port is provided in the second part.

16. The liquid consuming apparatus according to claim 15, wherein the liquid holding container has an engaging section that engages with the liquid consuming apparatus, the first part is configured by at least a first surface on an insertion direction side of the liquid holding container and a second surface which opposes the first surface, and the engaging section is provided on the first surface.

17. The liquid consuming apparatus according to claim 16, wherein the first part is configured by at least an upper section, a first surface on a second part side, and a second surface which opposes the first surface, and the inlet port is formed in the first part at a position closer to the second surface than the first surface.

18. The liquid consuming apparatus according to claim 17, wherein the liquid holding container includes an atmosphere linking port, which links at least one of the first part and the second part to the outside, and the atmosphere linking port is formed in the first part between the inlet port and the second part.

19. The liquid consuming apparatus according to claim 18, wherein the second part is connected with the liquid consuming apparatus so as to be able to swing.

* * * * *